US006345170B1

(12) United States Patent
Nakazato et al.

(10) Patent No.: US 6,345,170 B1
(45) Date of Patent: Feb. 5, 2002

(54) IMAGE FORMING APPARATUS FOR SINGLE-SIDED OPERATION INCLUDING A REVERSING DEVICE

(75) Inventors: Yasushi Nakazato, Tokyo; Takashi Seto, Kanagawa; Masakazu Muranaka, Tokyo, all of (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 09/628,716

(22) Filed: Jul. 28, 2000

(30) Foreign Application Priority Data

| | | |
|---|---|---|
| Jul. 29, 1999 | (JP) | 11-214663 |
| Jul. 30, 1999 | (JP) | 11-216210 |
| Jul. 30, 1999 | (JP) | 11-216557 |
| Aug. 26, 1999 | (JP) | 11-239672 |
| Jul. 14, 2000 | (JP) | 12-215038 |

(51) Int. Cl.[7] ..... G03G 15/00
(52) U.S. Cl. ..... 399/388; 399/21
(58) Field of Search ..... 399/16, 20, 21, 399/124, 388, 394, 396, 397, 401, 402

(56) References Cited

U.S. PATENT DOCUMENTS

| | | | | |
|---|---|---|---|---|
| 4,928,127 A | * | 5/1990 | Stemmle | 399/401 X |
| 5,057,874 A | * | 10/1991 | Miyazaki et al. | 399/396 |
| 5,134,443 A | * | 7/1992 | Sumi et al. | 399/124 X |
| 5,225,881 A | * | 7/1993 | Goto et al. | 399/402 |
| 5,268,728 A | * | 12/1993 | Sugiyama et al. | 399/20 |
| 5,742,890 A | * | 4/1998 | Kato et al. | 399/403 |

FOREIGN PATENT DOCUMENTS

| | | |
|---|---|---|
| JP | 6-49534 | 6/1994 |
| JP | 6-236086 | 8/1994 |
| JP | 7-120984 | 5/1995 |
| JP | 7-129057 | 5/1995 |
| JP | 7-261608 | 10/1995 |
| JP | 2941021 | 6/1999 |

* cited by examiner

*Primary Examiner*—Sandra Brase
(74) *Attorney, Agent, or Firm*—Oblon, Spivak, McClelland, Maier & Neustadt, P.C.

(57) ABSTRACT

An image forming apparatus of the present invention includes a printer engine for forming an image on a paper sheet fed from a paper cassette. A paper feeder feeds the paper sheet from the paper cassette to the printer engine while separating it from the other paper sheets stacked on the cassette. A switchback path branches off the transport path of the paper feeder for temporarily storing the paper sheet fed from the paper cassette. The paper sheet fed from the paper cassette enters the switchback path with its leading edge at the head. A roller pair is positioned on the switchback path for switching back the paper sheet received in the switchback path such that the paper sheet leaves the switchback path toward the printer engine with its trailing edge at the head.

92 Claims, 47 Drawing Sheets

IMAGE FORMING APPARATUS FOR SINGLE-SIDED OPERATION INCLUDING A REVERSING DEVICE

BACKGROUND OF THE INVENTION

The present invention relates to an image forming apparatus including a temporary paper storage positioned on a transport path, which extends to an image forming section, and conveying a paper sheet into the paper storage with the leading edge of the paper sheet at the head and then switching it back toward the image forming section with the trailing edge at the head. The image forming apparatus may be implemented as a printer, a copier, a facsimile apparatus, or a combination thereof.

It is a common practice with an electrophotographic image forming apparatus to sequentially feed paper sheets from a paper stack to an electrophotographic image forming section along a preselected transport path. The conventional apparatus uses a registration roller pair for matching the paper sheet and the position of an image at a position just short of the image forming section. This, however, brings about a problem when a plurality of paper sheets are continuously fed to the image forming section. Specifically, the paper sheets must be fed at the intervals of 10 mm or so due to irregularity in the position of the leading edge of the paper sheet separated from the other paper sheets, variation in paper conveying speed ascribable to aging and environment, and a period of time necessary for registration to be effected.

In light of the above, Japanese Patent Laid-Open Publication No. 5-289453, for example, teaches an image forming apparatus constructed to accelerate a paper sheet being conveyed along a transport path only for a preselected period of time. The acceleration reduces the interval between successive paper sheets without increasing the speed of an electrophotographic process and thereby enhances productivity as to image formation, However, when the length of the transport path to an accelerating position is great, all the paper sheets existing on the transport path must be accelerated to the same speed. As a result, the apparatus needs large-scale speed variation control and a sophisticated construction while aggravating noise.

Japanese Patent Laid-Open Publication Nos. 8-259045, 8-20106 and 5-97305 each disclose an image forming apparatus of the type forming an image on one side of a paper sheet, then guiding the paper sheet to a switchback path, and then switching back the paper sheet toward an image forming section in order to form an image on the other side of the paper sheet. None of these documents, however, teaches an arrangement in which paper sheets stacked on a cassette, tray or similar stacking section are directly fed to an image forming section by being switched back.

Particularly the apparatus taught in the above Laid-Open Publication No. 8-259045 cannot reduce the interval between successive paper sheets to a noticeable degree because three rollers are sequentially arranged to drive a paper sheet into and out of a paper reversing device such that the conveying speed is identical around the paper reversing device. Further, the position for effecting registration is remote from image forming means and is apt to cause the position of an image to be noticeably shifted due to conveyance errors. The apparatuses taught in Laid-Open Publication Nos. 8-20106 and 5-97305 also use three rollers and cannot reduce the interval between successive paper sheets.

When a paper jam occurs on the transport path of an image forming apparatus, It has been customary to interrupt paper conveyance in the apparatus in order to prevent the paper jam from being aggravated. Assume that a paper cassette loaded with paper sheets allows paper sheets to be replenished with a front-loading configuration, and that a paper sheet extends over both of the cassette and the transport path at the time of a paper jam Then, when the cassette is inadvertently pulled out of the apparatus, the above paper sheet tears and damages the apparatus or brings about another paper jam later.

Technologies relating to the present invention are also disclosed in Japanese Patent Laid-Open Publication Nos. 1-321231, 4-116570, 6-236086, 7-120984, 7-129057, and 7-261608.

SUMMARY OF THE INVENTION

It is therefore an object of the present invention to provide an image forming apparatus capable of reducing the interval between successive paper sheets to be fed to an image forming section and thereby enhancing productivity as to image formation.

It is another object of the present invention to provide an image forming apparatus capable of correcting irregularity in the above interval at the time of switchback by controlling a paper conveying speed, thereby further reducing the interval.

It is another object of the present invention to provide an image forming apparatus capable of continuously driving a roller pair, which is a substitute for a conventional registration roller pair, to thereby maintain the interval accurate without resorting to a registering operation.

It is another object of the present invention to provide an image forming apparatus capable of reducing the wear of an image forming section ascribable to a long interval between successive sheets. thereby enhancing productivity.

It is another object of the present invention to provide an image forming apparatus capable of conveying paper sheets in a stable manner.

It is another object of the present invention to provide an image forming apparatus capable of switching a paper conveying speed in a stable manner.

It is another object of the present invention to provide an image forming apparatus capable of obviating the deterioration of paper conveyance ascribable to, e.g., slip occurring when a paper sheet is brought to a stop.

It is still another object of the present invention to provide an image forming apparatus capable of preventing, when a paper sheet jams a transport path, the paper sheet from tearing and damaging the apparatus or bringing about another jam.

It is yet another object of the present invention to provide an image forming apparatus allowing the operator of the apparatus to easily deal with a jam.

It is further object of the present invention to provide an image forming apparatus capable of reducing production cost.

In accordance with the present invention, an image forming apparatus includes a printer engine for forming an image on a paper sheet, a paper cassette loaded with a stack of paper sheets, and a paper feeder for feeding one of the paper sheets toward the printer engine at a time while separating it from the other paper sheets. A temporary paper storage is positioned on a paper transport path for temporarily storing the paper sheet fed from the paper cassette. A paper reversing device positions the paper sheet fed from the paper cassette in the paper storage with its leading edge at the head and then switches back the paper sheet toward the printer engine with its trailing edge at the head. The paper feeder feeds the paper sheet at a particular speed on each of part of the transport path extending between the paper cassette and the paper storage and part of the transport path extending between the paper storage and the printer engine.

In accordance with the present invention, an image forming apparatus includes a printer engine for forming an image on a paper sheet, a paper cassette loaded with a stack of paper sheets, and a paper feeder for feeding one of the paper sheets toward the printer engine at a time while separating it from the other paper sheets. A temporary paper storage is positioned on a paper transport path for temporarily storing the paper sheet fed from the paper cassette. A paper reversing device positions the paper sheet fed from the paper cassette in the paper storage with its leading edge at the head and then switches back the paper sheet toward the printer engine with its trailing edge at the head. The paper feeder feeds the paper sheet from the paper storage toward the printer engine at a speed higher than a paper conveying speed for image formation assigned to the printer engine.

In accordance with the present invention, a printer includes an image forming apparatus, an input terminal for receiving image data, and a controller for causing the image forming device to form an image on a paper sheet in accordance with the image data. The image forming apparatus includes a printer engine for forming an image on a paper sheet, a paper cassette loaded with a stack of paper sheets, and a paper feeder for feeding one of the paper sheets toward the printer engine at a time while separating it from the other paper sheets. A temporary paper storage is positioned on a paper transport path for temporarily storing the paper sheet fed from the paper cassette. A paper reversing device positions the paper sheet fed from the paper cassette in the paper storage with its leading edge at the head and then switches back the paper sheet toward the printer engine with its trailing edge at the head. The paper feeder feeds the paper sheet at a particular speed on each of part of the transport path extending between the paper cassette and the paper storage and part of the transport path extending between the paper storage and the printer engine.

In accordance with the present invention, a copier includes an image scanner for reading a document image, an image forming apparatus, and a controller for controlling the image scanner and image forming apparatus such that the image forming apparatus forms an image on a paper sheet in accordance with image data output from the image scanner and representative of the document image. The image forming apparatus includes a printer engine for forming an image on a paper sheet, a paper cassette loaded with a stack of paper sheets. and a paper feeder for feeding one of the paper sheets toward the printer engine at a time while separating it from the other paper sheets. A temporary paper storage is positioned on a paper transport path for temporarily storing the paper sheet fed from the paper cassette. A paper reversing device positions the paper sheet fed from the paper cassette in the paper storage with its leading edge at the head and then switches back the paper sheet toward the printer engine with its trailing edge at the head. The paper feeder feeds the paper sheet at a particular speed on each of part of the transport path extending between the paper cassette and the paper storage and part of the transport path extending between the paper storage and the printer engine.

In accordance with the present invention, a facsimile apparatus includes an image scanner for reading a document image, an image forming apparatus, and a transmitter/receiver for interchanging image data with a remote station via a network. A controller controls the image scanner, image forming apparatus and transmitter/receiver such that image data output from the image scanner and representative of the document image are sent to the remote station via the network, or the image forming apparatus forms an image on a paper sheet in accordance with image data received from the remote station via the network and transmitter/receive. The image forming apparatus includes a printer engine for forming an image on a paper sheet, a paper cassette loaded with a stack of paper sheets, and a paper feeder for feeding one of the paper sheets toward the printer engine at a time while separating it from the other paper sheets. A temporary paper storage is positioned on a paper transport path for temporarily storing the paper sheet fed from the paper cassette. A paper reversing device positions the paper sheet fed from the paper cassette in the paper storage with its leading edge at the head and then switches back the paper sheet toward the printer engine with its trailing edge at the head. The paper feeder feeds the paper sheet at a particular speed on each of part of the transport path extending between the paper cassette and the paper storage and part of the transport path extending between the paper storage and the printer engine.

In accordance with the present invention, a multiplex machine includes an image scanner for reading a document image, an image forming apparatus, a transmitter/receiver for interchanging image data with a remote station via a network, an input terminal for receiving image data, and an output terminal for outputting image data. A controller controls the image scanner, image forming apparatus and transmitter/receiver such that the image forming apparatus forms an image in accordance with the image data received via the input terminal, or image data output from the image scanner and representative of the document image are output to the outside via the output terminal or sent to the remote terminal via the transmitter/receiver and network, or the image forming apparatus forms an image on a paper sheet in accordance with image data received from the remote terminal via the network and transmitter/receiver. The image forming apparatus includes a printer engine for forming an image on a paper sheet, a paper cassette loaded with a stack of paper sheets, and a paper feeder for feeding one of the paper sheets toward the printer engine at a time while separating it from the other paper sheets. A temporary paper storage is positioned on a paper transport path for temporarily storing the paper sheet fed from the paper cassette. A paper reversing device positions the paper sheet fed from the paper cassette in the paper storage with its leading edge at the head and then switches back the paper sheet toward the printer engine with its trailing edge at the head. The paper feeder feeds the paper sheet at a particular speed on each of part of the transport path extending between the paper cassette and the paper storage and part of the transport path extending between the paper storage and the printer engine.

In accordance with the present invention, a printer includes an image forming apparatus, and an input terminal for receiving image data. A controller causes the image forming apparatus to form an image on a paper sheet in accordance with the image data. The image forming apparatus includes a printer engine for forming an image on a paper sheet, a paper cassette loaded with a stack of paper sheets, and a paper feeder for feeding one of the paper sheets toward the printer engine at a time while separating it from the other paper sheets. A temporary paper storage is positioned on a paper transport path for temporarily storing the paper sheet fed from the paper cassette. A paper reversing device positions the paper sheet fed from the paper cassette in the paper storage with its leading edge at the head and then switches back the paper sheet toward the printer engine with its trailing edge at the head. The paper feeder feeds the paper sheet from the paper storage toward the printer engine at a speed higher than a paper conveying speed for image formation assigned to the printer engine.

In accordance with the present invention, a copier includes an image scanner for reading a document image and an image forming apparatus. A controller controls the image scanner and image forming apparatus such that the image forming apparatus forms an image on a paper sheet in accordance with image data output from the image scanner and representative of the document image, The image forming apparatus includes a printer engine for forming an image on a paper sheet, a paper cassette loaded with a stack of paper sheets, and a paper feeder for feeding one of the paper sheets toward the printer engine at a time while separating it from the other paper sheets. A temporary paper storage is positioned on a paper transport path for temporarily storing the paper sheet fed from the paper cassette. A paper reversing device positions the paper sheet fed from the paper cassette in the paper storage with its leading edge at the head and then switches back the paper sheet toward the printer engine with its trailing edge at the head. The paper feeder feeds the paper sheet from the paper storage toward the printer engine at a speed higher than a paper conveying speed for image formation assigned to the printer engine.

In accordance with the present invention, a facsimile apparatus includes an image scanner for reading a document image, an image forming apparatus, and a transmitter/receiver for interchanging image data with a remote station via a network. A controller controls the image scanner, image forming apparatus and transmitter/receiver such that image data output from the image scanner and representative of the document image are sent to the remote station via the network, or the image forming apparatus forms an image on a paper sheet in accordance with image data received from the remote station via the network and transmitter/receiver. The image forming apparatus includes a printer engine for forming an image on a paper sheet, a paper cassette loaded with a stack of paper sheets, and a paper feeder for feeding one of the paper sheets toward the printer engine at a time while separating it from the other paper sheets. A temporary paper storage is positioned on a paper transport path for temporarily storing the paper sheet fed from the paper cassette. A paper reversing device positions the paper sheet fed from the paper cassette in the paper storage with its leading edge at the head and then switches back the paper sheet toward the printer engine with its trailing edge at the head. The paper feeder feeds the paper sheet from the paper storage toward the printer engine at a speed higher than a paper conveying speed for image formation assigned to said printer engine.

In accordance with the present invention, a multiplex machine includes an image scanner for reading a document image, an image forming apparatus, a transmitter/receiver for interchanging image data with a remote station via a network, an input terminal for receiving image data, and an output terminal for outputting image data. A controller controls the image scanner, image forming apparatus and transmitter/receiver such that the image forming apparatus forms an image in accordance with the image data received via the input terminal, or image data output from the image scanner and representative of the document image are output to the outside via the output terminal or sent to the remote terminal via the transmitter/receiver and network, or the image forming apparatus forms an image on a paper sheet in accordance with image data received from the remote terminal via the network and transmitter/receiver. The image forming apparatus includes a printer engine for forming an image on a paper sheet, a paper cassette loaded with a stack of paper sheets, and a paper feeder for feeding one of the paper sheets toward the printer engine at a time while separating it from the other paper sheets. A temporary paper storage is positioned on a paper transport path for temporarily storing the paper sheet fed from the paper cassette, A paper reversing device positions the paper sheet fed from the paper cassette in the paper storage with its leading edge at the head and then switches back the paper sheet toward the printer engine with its trailing edge at the head. The paper feeder feeds the paper sheet from the paper storage toward the printer engine at a speed higher than a paper conveying speed for image formation assigned to the printer engine.

In accordance with the present invention, an image forming apparatus includes an image forming section for forming an image on a paper sheet, a paper stacking section for stacking paper sheets. thereon, and a paper feeder for feeding one of the paper sheets from the paper stacking section to the image forming section at a time while separating it from the other paper sheets. A temporary paper storage is positioned on a paper transport path for temporarily storing the paper sheet fed from the paper stacking section. A paper reversing device positions the paper sheet fed from the paper stacking section in the paper storage with its leading edge at the head and then switches back the paper sheet toward the image forming section with its trailing edge at the head. A registering device performs a registering operation for adjusting a timing at which the paper feeder should feed the paper sheet and a timing at which the paper reversing device should deliver the paper sheet. As a result, the timing of delivery of the paper sheet toward the image forming section is synchronized to image formation. A paper sensor is positioned in the paper storage for sensing the paper sheet. The paper feeder effects the feed of the paper sheet from the paper stacking section toward the paper storage and the feed of the paper sheet from the paper storage toward the image forming section independently of each other. The registering device performs the registering operation in response to the output of the paper sensor representative of the paper. When. the paper feeder temporarily stops conveying the paper sheet, the registering device conveys part of the paper sheet toward the image forming section to a position where the trailing edge of the paper sheet does not obstruct the entry of a paper sheet following the above paper sheet into the paper storage.

In accordance with the present invention, an image forming apparatus includes an image forming section for forming an image on a paper sheet, and a paper stacking section for stacking paper sheets thereon. A paper feeder feeds one of the paper sheets from the paper stacking section to the image forming section at a time while separating it from the other paper sheets. A temporary paper storage is positioned on a paper transport path for temporarily storing the paper sheet fed from the paper stacking section. A paper reversing device positions the paper sheet fed from the paper stacking section in the paper storage with its leading edge at the head and then switches back the paper sheet toward the image forming section with its trailing edge at the head A registering device performs a registering operation for adjusting a timing at which the paper feeder should feed the paper sheet and a timing at which the paper reversing device should deliver the paper sheet, As a result, the timing of delivery of the paper sheet toward the image forming section is synchronized to image formation. The paper feeder effects the feed of the paper sheet from the paper stacking section toward the paper storage and the feed of the paper sheet from the paper storage toward image forming section independently of each other. When the paper feeder temporarily stops conveying the paper sheet, the registering device conveys part of the paper sheet toward the image forming section to a position where the trailing edge of the paper sheet does not obstruct the entry of a paper sheet following the above paper sheet into the paper storage.

In accordance with the present invention, an image forming apparatus includes an image forming section for forming an image on a paper sheet, a paper stacking section for stacking paper sheets thereon, and a paper feeder for feeding one of the paper sheets from the paper stacking section to the image forming section at a time while separating it from the other paper sheets. A temporary paper storage is positioned on a paper transport path for temporarily storing the paper sheet fed from the paper stacking section. A paper reversing device positions the paper sheet fed from the paper stacking section in the paper storage with its leading edge at the head and then switches back the paper sheet toward the image forming section with its trailing edge at the head. A jam sensor is positioned on the transport path or a transport path following it for sensing a paper jam A stopping device stops the operation of the image forming section and the operation of the paper feeder when the jam sensor senses a paper jam A storing device causes, when the stopping device stops the above operations, the paper feeder to continuously convey the paper sheet being conveyed along the transport path between the paper stacking section and the paper storage to the paper storage. The paper stacking section has a front-loading configuration.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the image forming apparatus in accordance with the present invention will be described hereinafter.

First Embodiment

Figure 1:
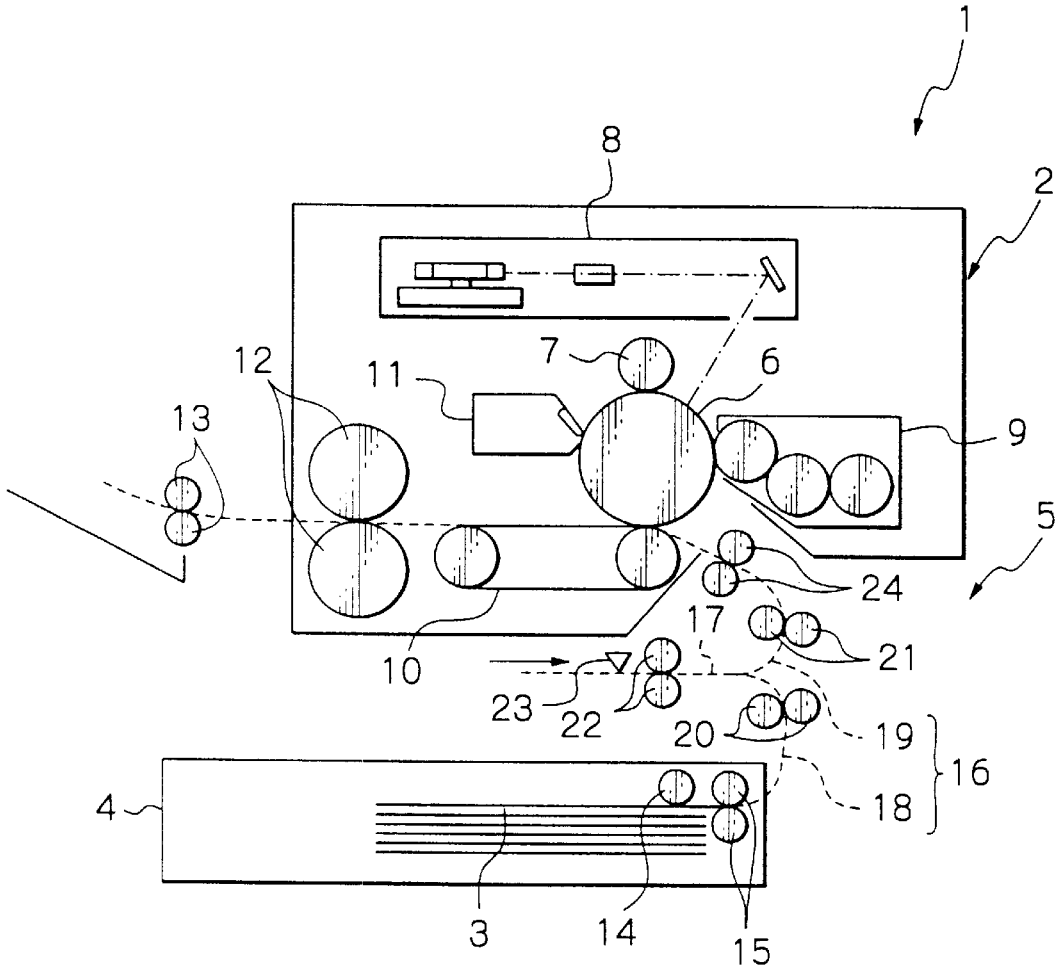
FIG. 1 is a view showing the general construction of a first embodiment of an image forming apparatus in accordance with the present invention.

Referring to FIG. 1 of the drawings, an image forming apparatus embodying the present invention is shown and generally designated by the reference numeral 1. As shown, the image forming apparatus 1 is generally made up of a printer engine or image forming section 2, a paper cassette 4, and a paper feeder 5. The printer engine 2 is constructed to electrostatically form an image. The paper cassette 4 is loaded with a stack of paper sheets 3 to be fed to the printer engine 2. The paper feeder 5 feeds the paper sheets 3 to the printer engine 2 one by one.

Specifically, the printer engine 2 includes a photoconductive element implemented as a drum 6. A charger 7 uniformly charges the surface of the drum 6. A digital optical writing unit 8 optically writes a latent image on the charged surface of the drum 6. A developing unit 9 develops the latent image with toner to thereby form a corresponding toner image. An image transfer unit 10 transfers the toner image from the drum 6 to the paper sheet 3 fed from the paper cassette 4. A cleaning unit 11 removes the toner left on the drum 6 after the image transfer. With these units, the printer engine 2 forms an image on the paper 3 with a digital electrophotographic process. A fixing unit 12 fixes the toner image on the paper sheet 3. An outlet roller pair 13 drives the paper sheet 3 with the fixed toner image out of the printer engine 2.

The paper feeder 5 includes a pickup roller 14 for paying out the paper sheets 3 stacked on the paper cassette 4. A separator roller pair 15 separates the top paper sheet 3 paid out by the pickup roller 14 from the underlying paper sheets 3, As a result, only the top paper sheet 3 is conveyed to the printer engine 3 along a transport path 16.

The transport path 16 comes to a dead-end at its deepest position as seen from the intermediate position of the path 16. That is, a switchback path 17 branches off the transport path 16, as illustrated. The switchback path 17 plays the role of a temporary paper storage for storing the paper sheet 3 for a moment. More specifically, the switchback path 17 divides the transport path 16 into a first and a second transport path 18 and 19. The transport path 18 extends between the paper cassette 4 and the inlet/outlet of the switchback path 17. A roller pair 20 is positioned on the transport path 18 and driven by a motor 26 (see FIG. 12) to convey the paper sheet 3. The transport path 19 extends between the inlet/outlet of the switchback path 17 and the printer engine 2. A roller pair 21 is positioned on the transport path 19 and driven by a motor 28 (see FIG. 12) to convey the paper sheet 3. A roller pair 22 is positioned on the switchback path 17 and reversibly driven by a reversible motor 30 (see FIG. 12). When the paper sheet 3 is conveyed from the paper cassette 18 into the switchback path 17 along the transport path 18, the roller pair 22 nips the leading edge of the paper sheet 3 and conveys it into the switchback path 17. The roller pair 22 then switches back the paper sheet 3, i.e., conveys the paper sheet 3 out of the switchback path 17 toward the printer engine 2 along the transport path 19 with the trailing edge of the paper sheet 3 at the head. In this sense, the roller pair 22 plays the role of a paper reversing device. A paper sensor 23 is positioned on the switchback path 17.

The separator roller pair 15 and roller pair 20 are rotated to convey the paper sheet 3 into the switchback path 17. A microcomputer 25 (see FIG. 12) calculates, based on the output of the paper sensor 3 responsive to the edge of the paper sheet 3, the time when the paper sheet 3 is to be fully received in the switchback path 17, and then ends the paper storing operation.

The roller pairs 22 and 21 are rotated to convey the paper sheet 17 out of the switchback path 17. A registration roller pair 24 is located in the vicinity of the printer engine 2. When the registration roller pair 24 performs a registering operation, the roller pair 21 temporarily stops conveying the paper sheet 3 or otherwise cooperates with the registration roller pair 24. In response to the output of the paper sensor 23, the microcomputer 25 calculates the time when the paper sheet 3 is to be fully driven out of the switchback path 17, and then ends the paper delivering operation.

A guide member, not shown, is positioned at the branching portion of the transport path 16 in such a manner as to guide the leading edge of the paper sheet 3 toward the printer engine 2. The guide member may be implemented as a flexible guide member that guides the leading edge of the paper sheet 3 upward. Alternatively, the guide member may be implemented as a gate driven by a solenoid or similar drive means for forcibly switching the path from the path 18 to the path 19.

A conventional image forming apparatus lacks the switchback path 17 and causes, during registration, the paper sheet 3 to remain in a halt with its trailing edge portion nipped by the roller pairs 20 and 21 and separator roller pair 15. This makes it impossible to, e.g., regulate beforehand the position of the leading edge of the next paper sheet 3 fed from the paper cassette 4. Further, the apparatus must be designed to stop and then start the movement of the paper sheet 3 while the trailing edge portion of the paper sheet 3 is nipped in the above-described manner. Moreover, loads to act on the registration roller pair 24 at the time of stop and start of conveyance of the paper sheet 3 are apt to vary. To prevent such variation in load from effecting the conveying speed, the registration roller pair 24 must be driven by a sufficient torque or must be provided with a sufficient nipping force. In addition, the variation in load is likely to bring about defective images, e.g., an image with horizontal stripes generally referred to as shock jitter and an image with density rendered irregular by a change in conveying speed.

In the illustrative embodiment, the switchback path 17 serves as a temporary paper storage for temporarily storing the paper sheet 3. Therefore, while the paper sheet 3 is held in a halt due to, e. g., registration, its trailing edge portion is clear of the role or pair 20 and separator roller pair 15. In this condition, the next paper 3 can be paid out and can have its leading edge adjusted in position. It is therefore possible to reduce the interval between successive paper sheets 3 and therefore to enhance productivity without resorting to the conventional transient acceleration of the movement of the paper sheet 3. Furthermore, because the separator roller pair 15 is free from separation loads, it can convey the paper sheet 3 at a constant speed and obviates defective images ascribable to changes in conveying speed. In addition, because the conveying force of, e.g., the registration roller pair 24 does not have to be increased, the service life of the apparatus is prevented from being reduced by the wear of the roller pair 24.

It is desirable to reduce the time up to the end of image formation by conveying the paper sheet 3 from the separator roller pair 15 to the printer engine 2 as rapidly as possible. However, in it the conventional apparatus whose separation roller pair 15 nips the trailing edge of the paper sheet 3 during registration, the conveying speed between the separator roller pair 15 and the printer engine 2 cannot be made as high as a conveying speed for image formation assigned to the printer engine 2 unless variable speed control is executed with all of the transport paths.

It is a common practice with an electrophotographic image forming apparatus to use DC servo motors or stopping motors, which are low cost and accurate in rotation, as drive sources. DC servo motors are, however, apt to make the displacement of a paper sheet irregular during variable speed control. Stepping motors would be brought out of synchronism and caused to stop conveying a paper sheet if they were unable to adapt to changes in load.

Figure 2:
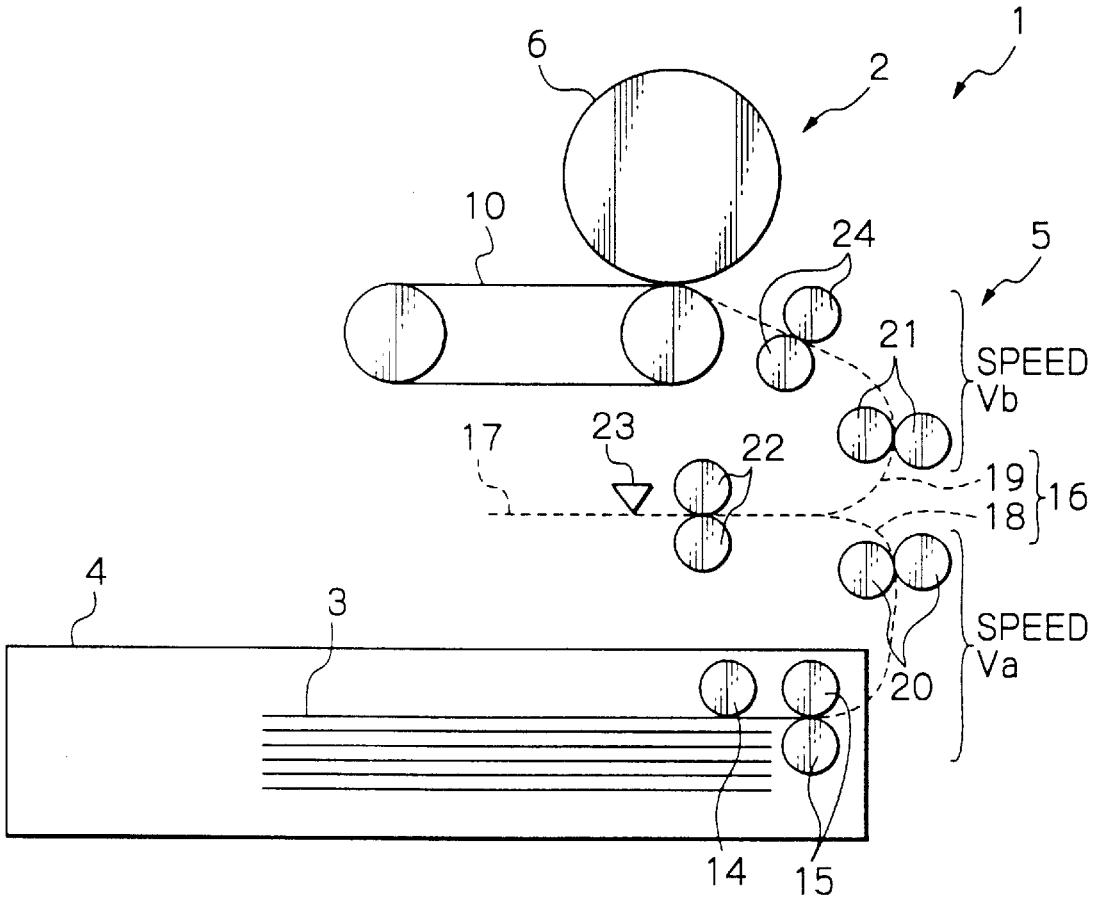
FIG. 2 is a view showing a sheet feeder included in the first embodiment.

In the illustrative embodiment, only the roller pair 22 positioned on the switchback path 17 is reversible and variable in speed. As shown in FIG. 2, the separator roller pair 15 and roller pair 20 are rotatable at a constant speed Va while the registration roller pair 24 and roller pair 21 are rotatable at a constant speed Vb (Va≠Vb)). That is, the roller pairs 15 and 20 do not need variable speed control. It is therefore possible to convey the paper sheet 3 at a speed higher than the conveying speed assigned to the printer engine. Only the roller pair 22 needs variable speed control. However, because the roller pair 21 cooperates with the roller pair 22 in conveying the paper sheet 3 into the switchback path 17 and because substantially no load acts during delivery of the paper sheet 3 from the path 17, a stopping motor can be used and prevented from being brought out of synchronism. In this manner, the illustrative embodiment is capable of switching the paper conveying speed in a stable manner.

Figure 3:
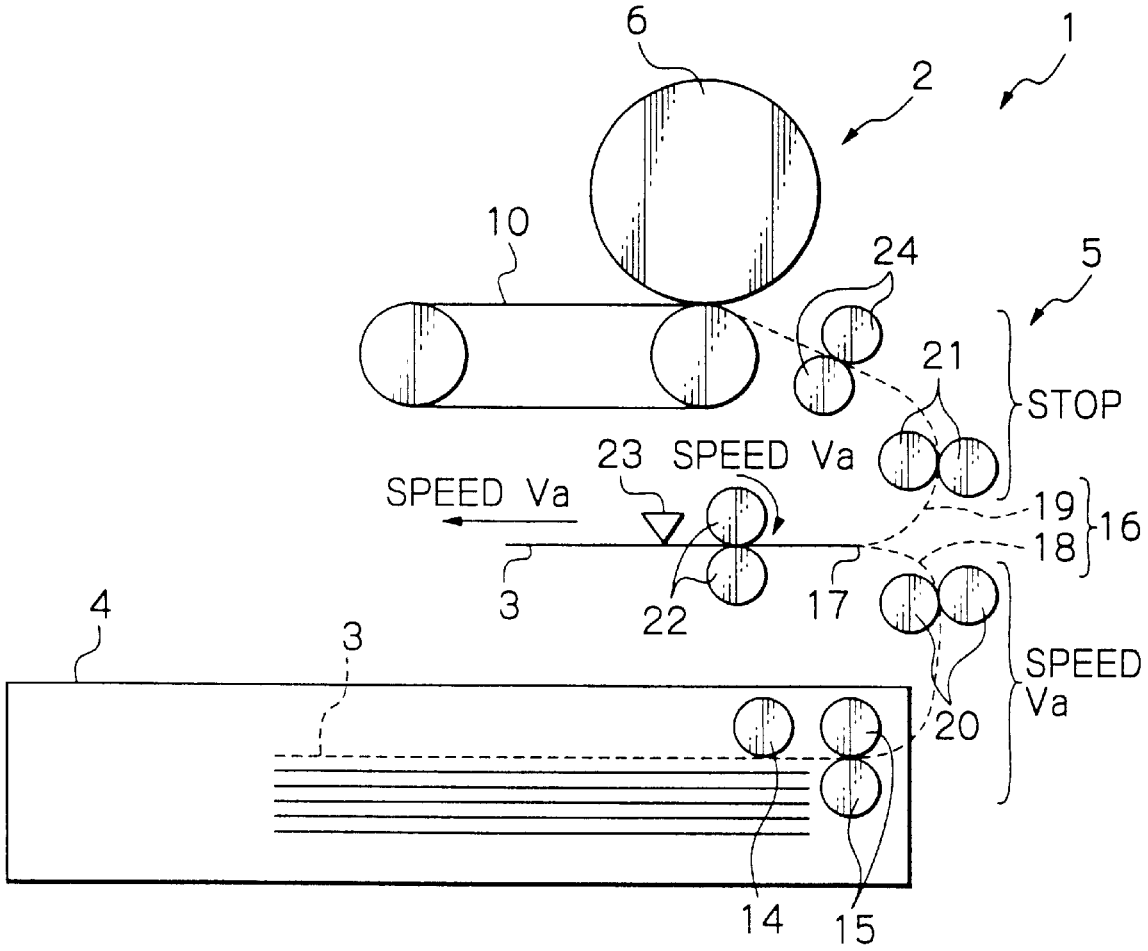
FIGS. 3 and 4 are views demonstrating the operation of the sheet feeder of FIG. 2.
Figure 4:
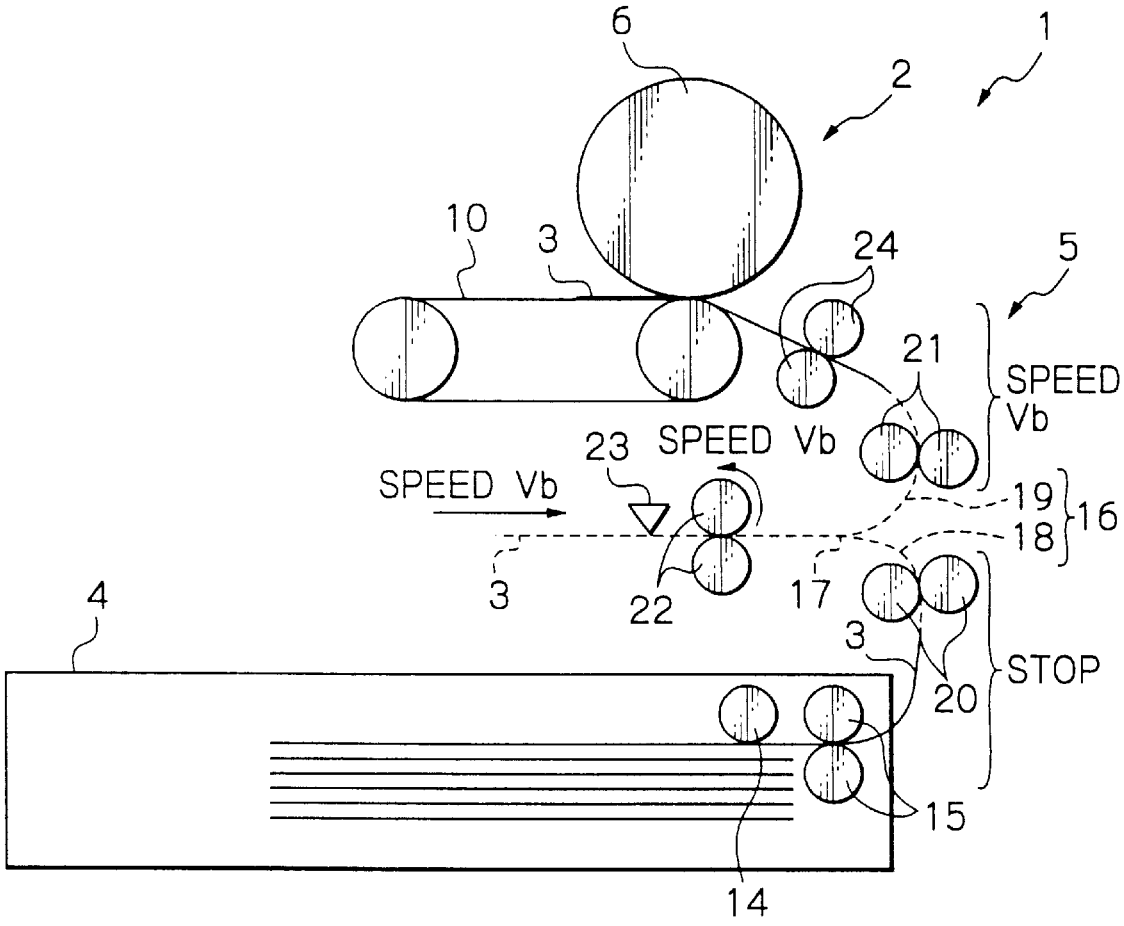
Figure 5:
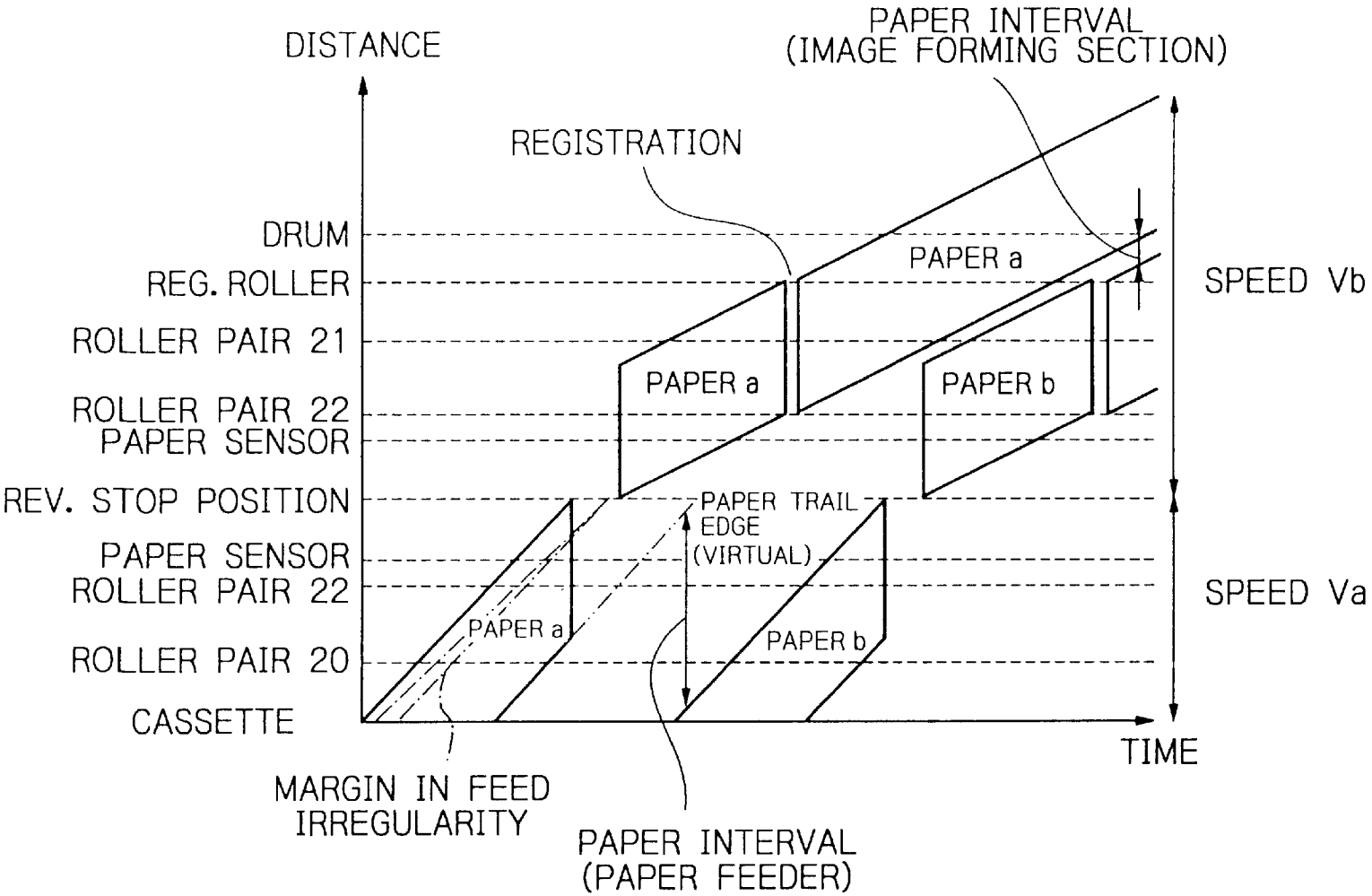
FIG. 5 is a diagram associated with FIGS. 3 and 4.

FIGS. 3 and 4 show how the paper sheet is conveyed more specifically. FIG. 5 is a diagram associated with FIGS. 3 and 4. In FIG. 5, the leading edge of the paper sheet 3 in the direction of conveyance is assumed to be the leading edge, so that the leading edge is shown as being apparently moved by the overall length of the paper sheet 3 around the time of switchback. A shared section corresponding to the length of the switchback path 17 exists around the position on the path 17 where the paper sheet 3 is brought to a stop (reversal stop position hereinafter). This is why the paper sensor 23 and roller pair 22 are shown as appearing two times in FIG. 5.

While the conventional apparatus corrects irregularity in paper feed by the registering operation, the illustrative embodiment corrects it on the basis of the duration of a stop of the paper sheet 3 at the reversal stop position. Irregularity in conveyance after the reversal stop position is so small, the registration operation can complete in an extremely short period of time.

As shown in FIG. 5, assume that paper sheets a and b are sequentially fed from the paper feeder 5 to the printer engine 2 in this order without any switchback. Then, the interval between paper sheets a and b is extremely great. By contrast, the illustrative embodiment switches the conveying speed and therefore makes the interval between the paper sheets a and b extremely small in the printer engine 2. This is successful to further enhance productivity.

Figure 6:
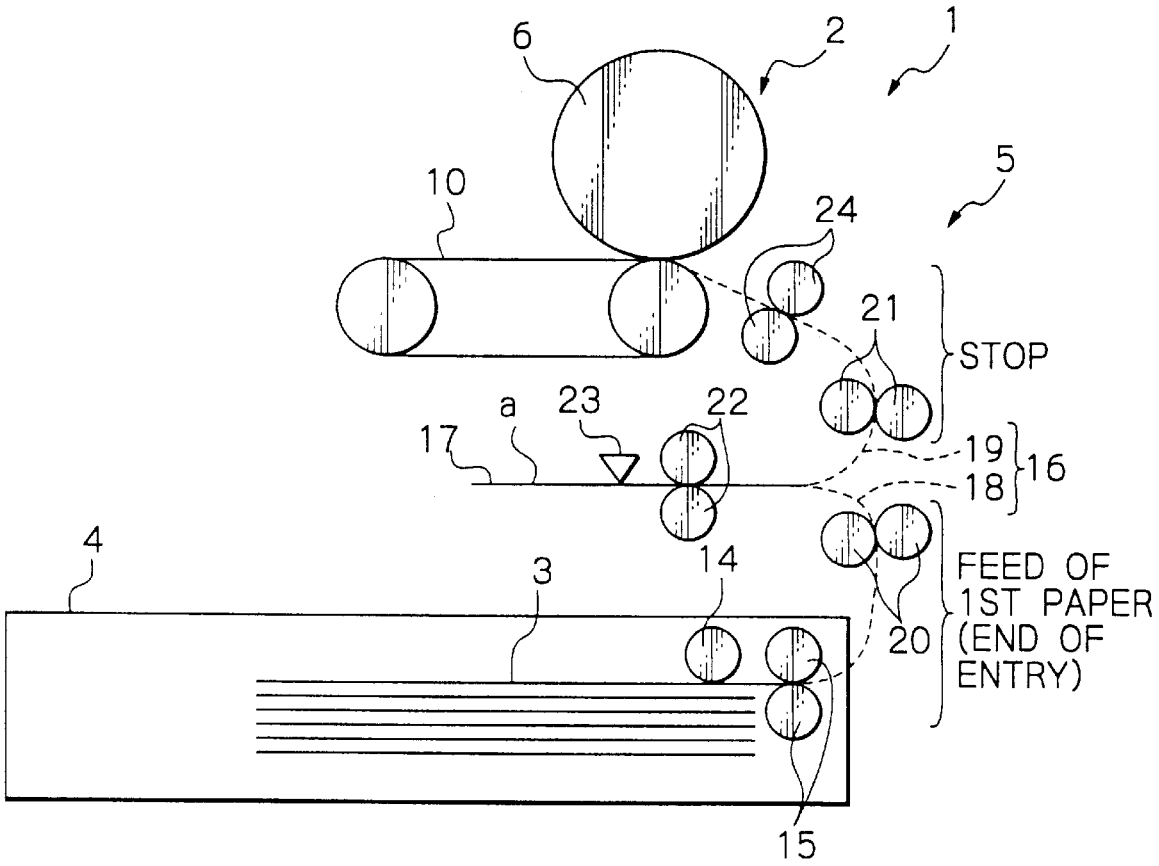
FIGS. 6 through 10 are views also demonstrating the operation of the sheet feeder of FIG. 2.
Figure 7:
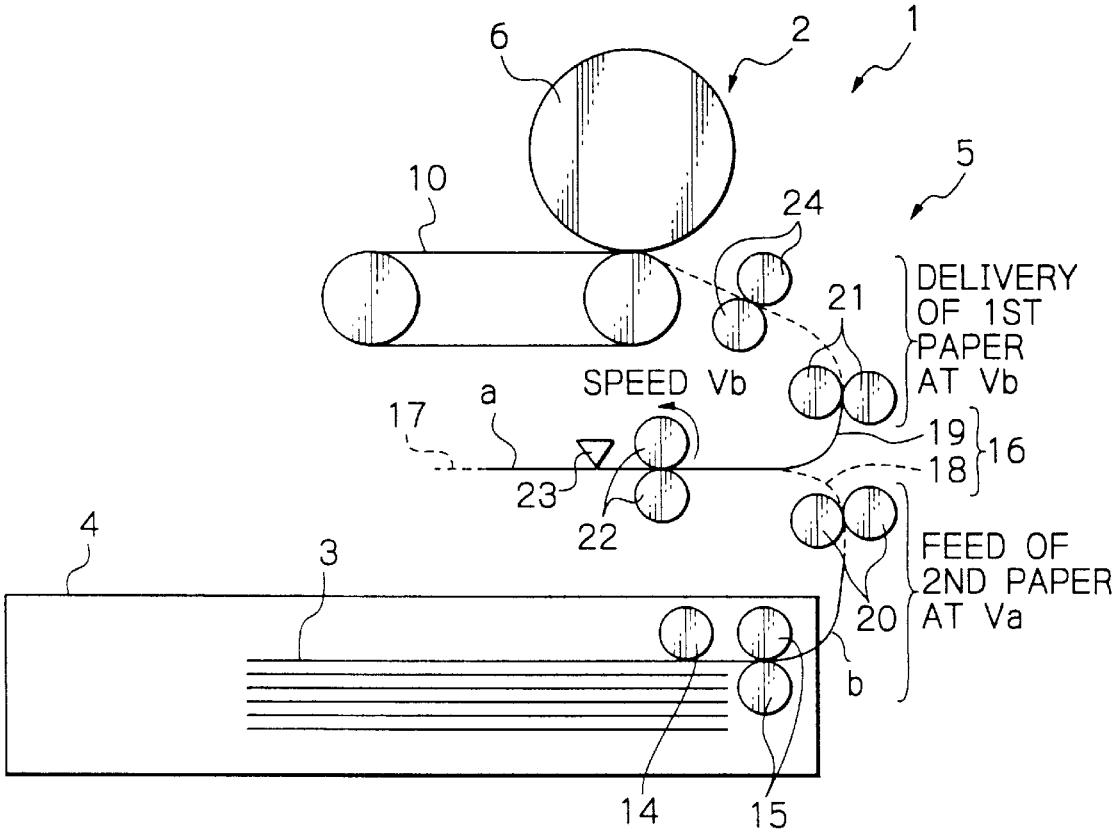

FIG. 5 shows a specific condition where in the interval between the paper sheets a and b is selected to be great enough to prevent them from being conveyed to the roller pair 22 at the same time. In this condition, it is not necessary to take account of the passing of the paper sheets a and b in relation to the positions of the roller pair 22 and paper sensor 223 on the switchback path 17. It follows that means for retracting the roller pair 22, as will be described later with reference to FIG. 6 and successive figures, is not necessary. The illustrative embodiment is therefore simple in configuration and low cost.

FIGS. 6 through 10 demonstrate how the paper sheets a and b and a paper sheet c following the paper sheet b are sequentially conveyed toward the printer engine 2. A solenoid, or pressing/releasing device, 32 (see FIG. 12) selectively presses the rollers 22 against each other in order to nip the paper sheet 3 or releases them from each other in order to release the paper sheet 3. This allows the paper sheet a being delivered from the switchback path 17 to the transport path 19 and the paper sheet b being introduced into the path 17 to exist together on the path 17. Therefore, the interval between the successive papers a and b can be further reduced in order to further enhance productivity.

Generally, when two or more paper sheets 3 are conveyed together in the same direction, it is extremely difficult to sense the edges of the paper sheets 3. In the illustrative embodiment, the paper sheets a and bare conveyed in opposite directions to each other although they pass each other at the roller pair 22. The paper sensor 23 can therefore sense the edge of the paper sheet a and that of the paper sheet b at one. This is another advantage achievable with the illustrative embodiment.

Figure 12:
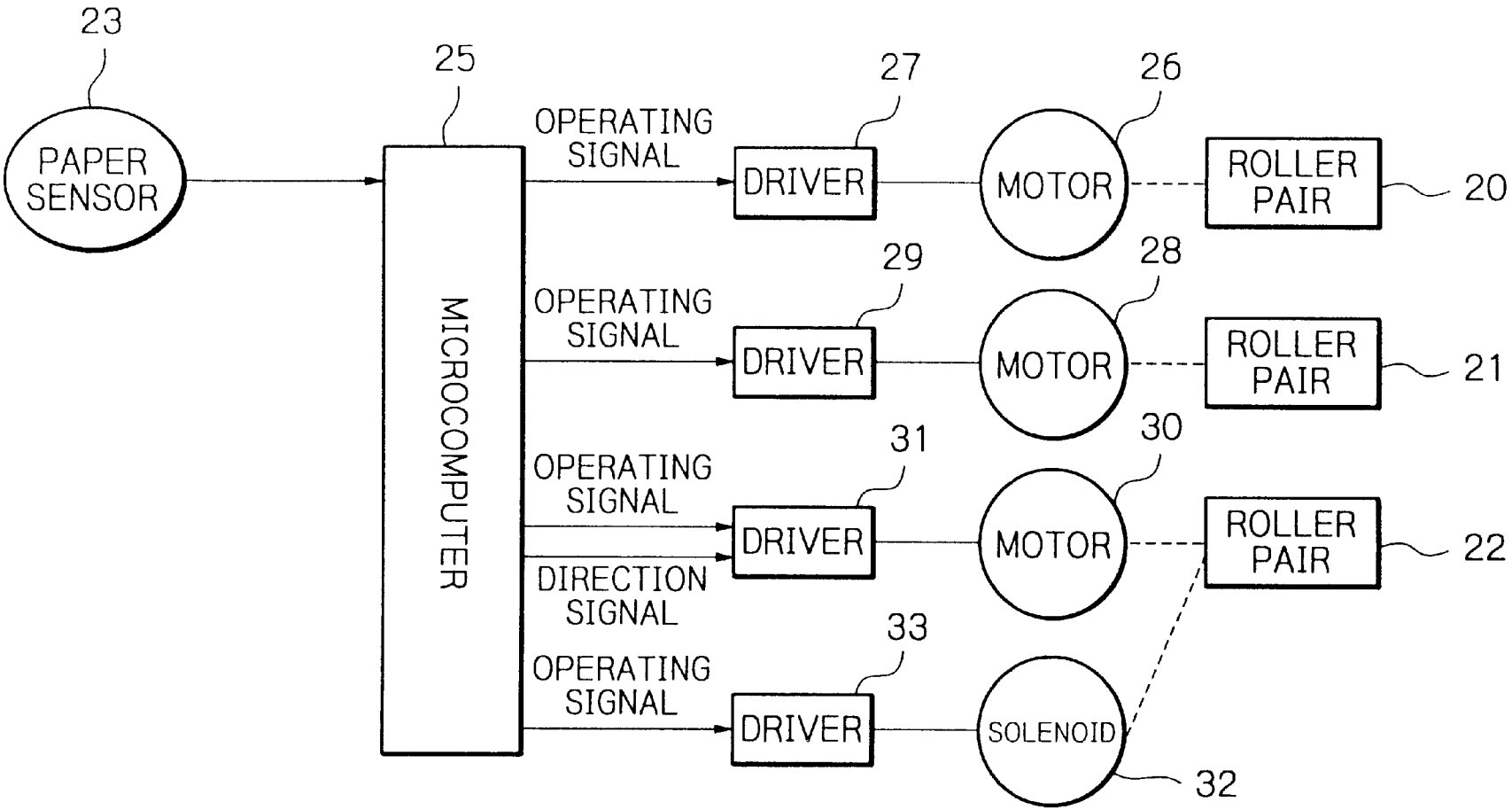
FIG. 12 is a block diagram schematically showing a control system included in the first embodiment.

FIG. 12 shows a control system included in the illustrative embodiment. As shown, the control system includes the microcomputer 25 controlling the entire paper feeder 5. Motor drivers 27 and 29 respectively drive the motors 26 and 28 drivably connected to the roller pairs 20 and 21, respectively. A motor driver 31 drives the motor 30 that, in turn, drives the roller pair 22. A solenoid driver 33 drives the solenoid 32 that selectively moves the rollers 22 into or out of contact with each other. The motor drivers 27, 29 and 31, solenoid driver 33 and paper sensor 23 are connected to the microcomputer 25.

The microcomputer 25 drives the roller pairs 20 and 21 on the transport paths 18 and 19. respectively, independently of each other. Stated another way, the microcomputer 25 controls the conveyance and stop of the paper sheet 3 at a particular timing for each of the transport paths 18 and 19. The roller pairs 20 and 21 are therefore rotatable at the constant speeds Va and Vb, respectively, as stated earlier.

Figure 11:
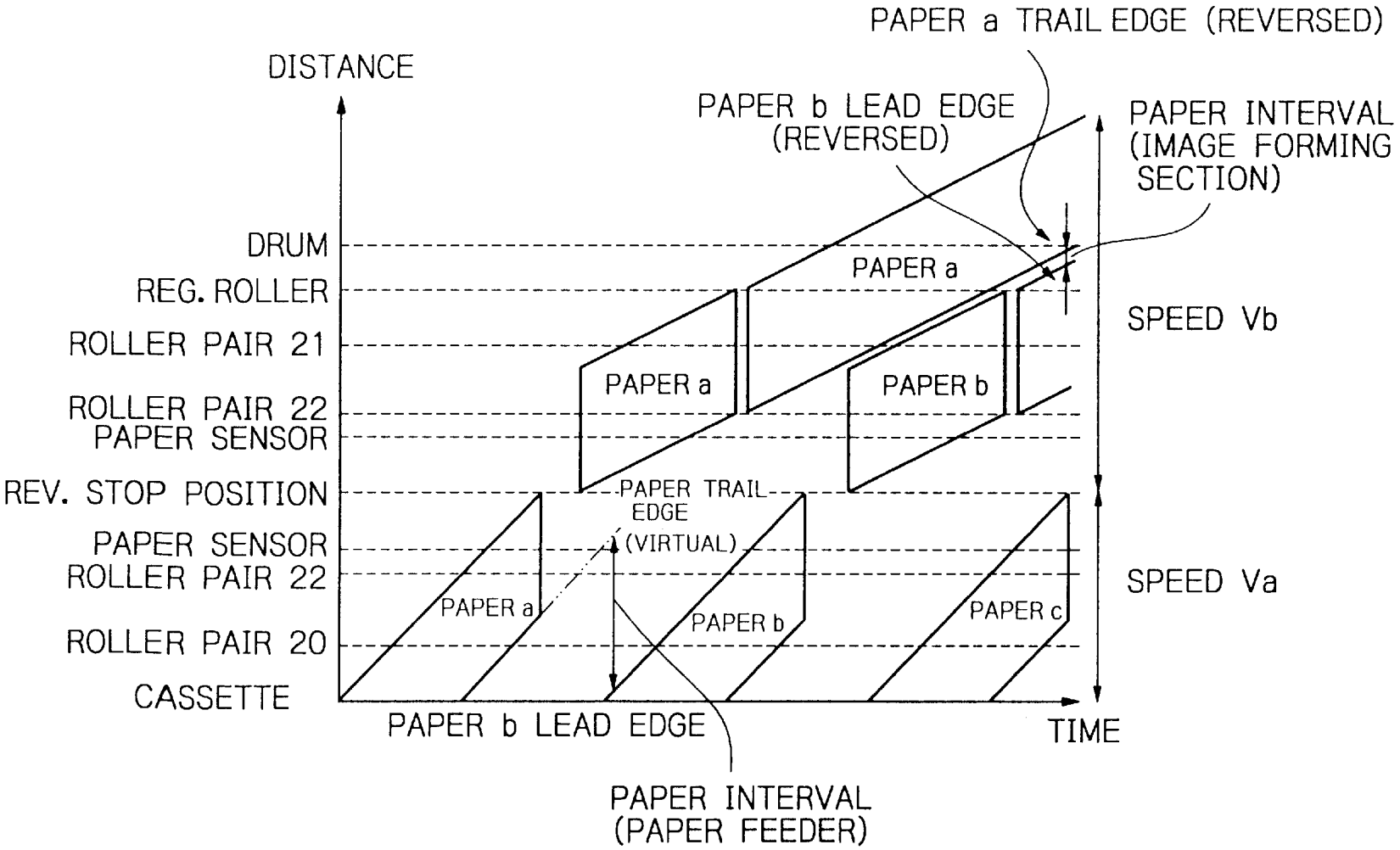
FIG. 11 is a diagram associated with FIGS. 6 through 10.

As shown in FIGS. 5 and 11. even when the roller pair 21 is caused to stop rotating for a moment for the registering operation, the roller pairs 20 and 15 continuously rotate. This obviates the need for a function of temporarily stopping the rotation of the separation roller pair 15 and thereby reduces the production cost while stabilizing the conveyance of the paper sheet 3. If desired, the roller pairs 20 and 21 may share a single motor in which case the roller pair 21 will be temporarily stopped via a clutch.

As shown in FIGS. 1, 3, 4 and 12, the roller pair 22 positioned on the switchback path 17 is rotatable at the speed Va when drawing the paper sheet 3 into the path 17 or at the speed Vb when driving it out of the path 17. The conveying speed can therefore be switched from Va to Vb when the paper sheet 3 received in the switchback path 17 is held only by the roller pair 22, and therefore at a minimum of cost.

Figure 8:
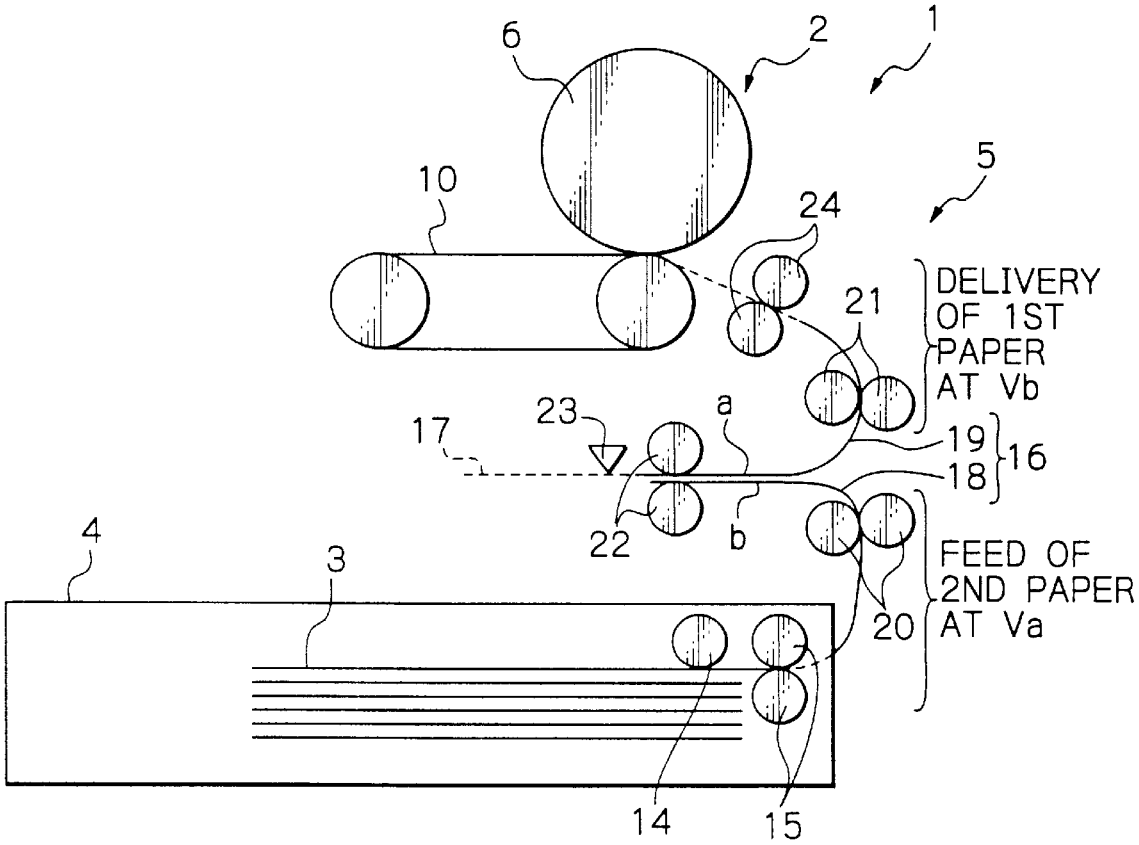
Figure 9:
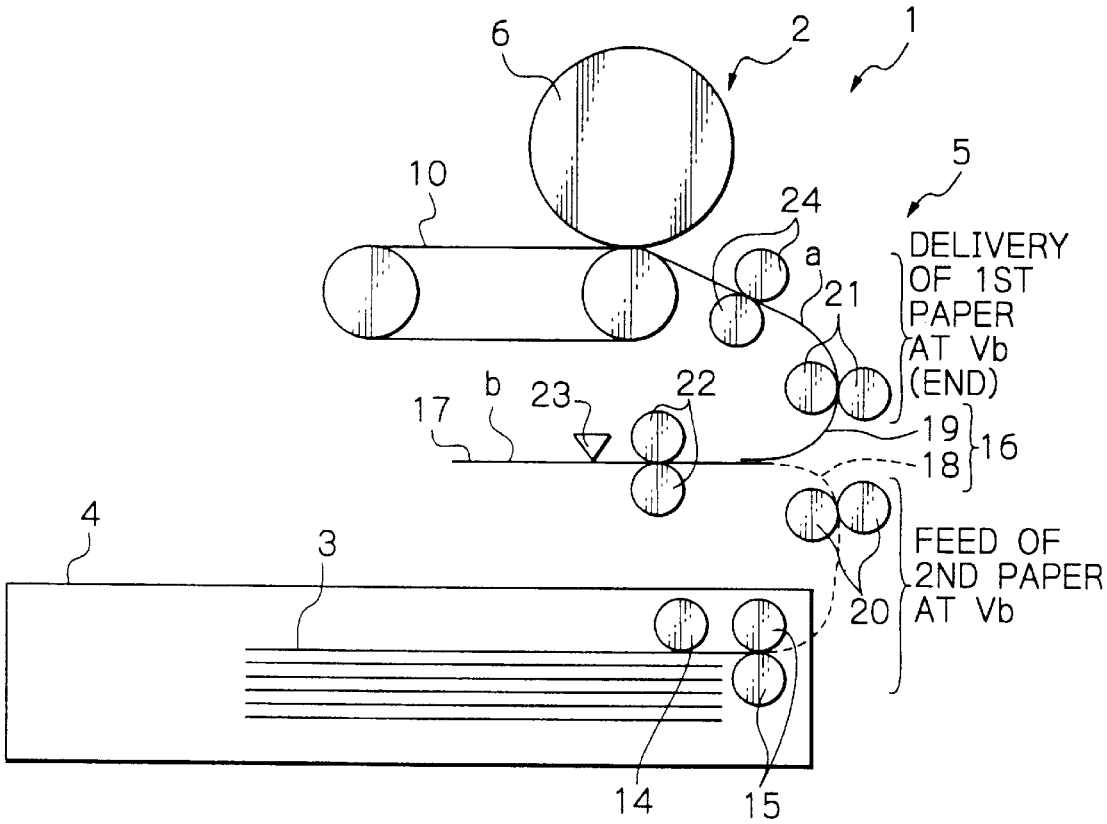
Figure 10:
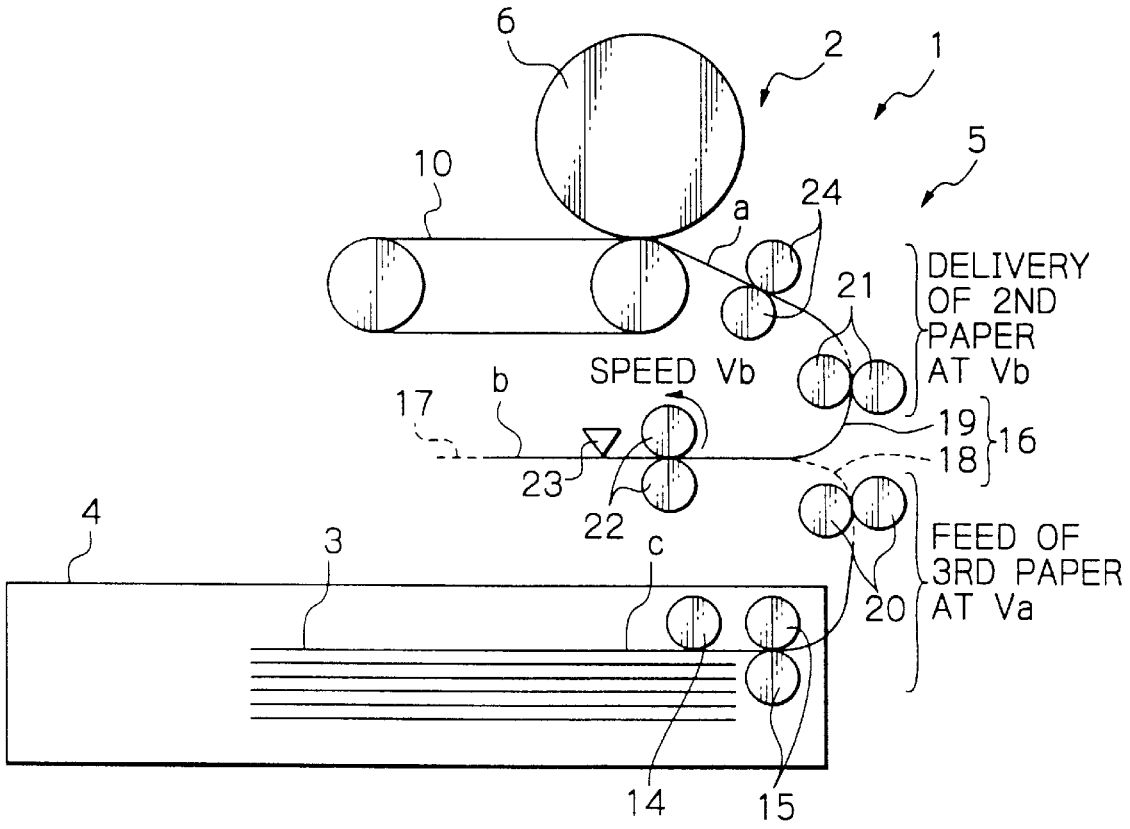
Figure 13A:
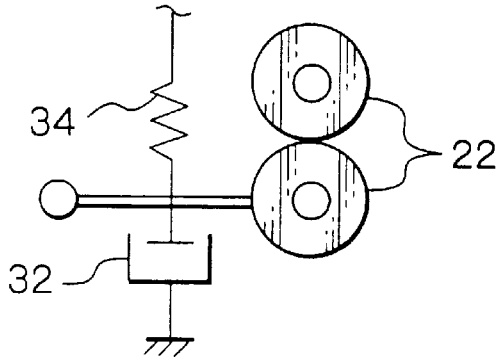
FIGS. 13A and 13B are views showing a specific configuration of a mechanism adjoining a switchback mechanism for driving a roller pair.
Figure 13B:
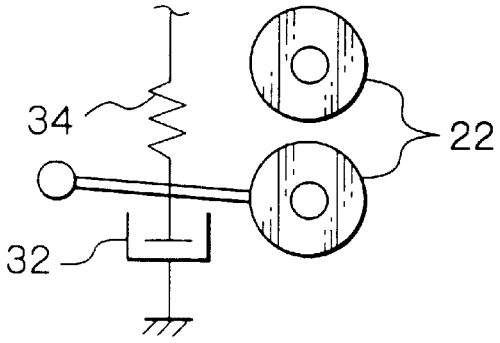

As shown in FIGS. 8, 13A and 13B, when the paper sheets a and b pass each other at the position of the roller pair 22, the friction of the roller pair 22 would obstruct the conveyance of the paper sheets a and b if driven in either direction or caused to stop rotating. In the illustrative embodiment, the rollers 22 are released from each other to obviate a frictional force and allow the paper sheets sand b to pass each other only on the basis of the conveying forces of the roller pairs 20 and 21. It is therefore possible to further reduce the interval between the paper sheets a and b that pass each other, as shown in FIG. 5, and therefore to further enhance productivity. As shown in FIGS. 13A and 13B specifically, the illustrative embodiment includes a spring 34 for constantly biasing one roller 22 toward the other roller 22. To release the rollers 22 from each other, the solenoid 32 pulls the roller 22 being biased by the spring 34 away from the other roller 22.

Figure 14:
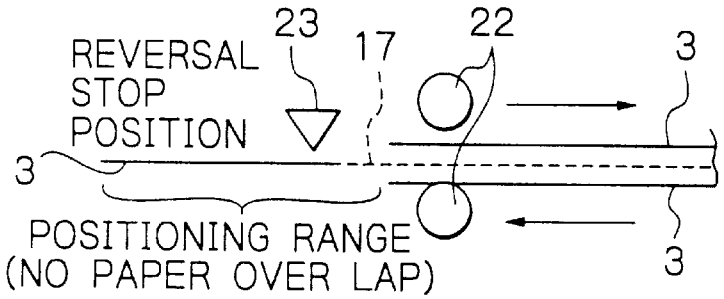
FIG. 14 is a view demonstrating a registering operation available with the sheet feeder.

As shown in FIGS. 8 and 14, the paper sensor 23 is positioned in the range of the switchback path 17 where the paper sheets a and b do not over lap each other. More specifically, when the paper sheets a and b pass each other, the paper sensor 23 senses the leading edge of the paper sheet b entering the switchback path 17 after the trailing edge of the paper sheet a has moved away from the sensor 23. Alternatively, the paper sensor 23 nay be so positioned as to sense the leading edge of the paper sheet b just when it reaches the reverse stop position. FIG. 14 shows the range in which the paper sensor 23 may be positioned.

The range shown in FIG. 14 prevents the paper sheets a and b from over lapping each other and being unable to be sensed by the paper sensor 23. The paper sheet b can therefore be surely stopped at the reverse stop position on the basis of the output of the paper sensor 23 representative of the leading edge of the paper sheet b. Further, the paper sensor 23 senses the leading edge of the paper sheet a leaving the switchback path 17 also, allowing, e.g., the conveyance error of the paper sheet a to be detected. In this manner, a single paper sensor 23 senses both of the leading edge of the paper sheet b entering the switchback path 17 and that of the paper sheet a leaving the path 17, contributing to the reduction of production cost. The paper sensor 23 may be implemented as any one of a transmission type sensor, a reflection type sensor, a feeler type sensor, and so forth.

While the operator of the apparatus 1 may input the length, or size, of the desired paper sheet 3 on the apparatus 1, the length may alternatively be calculated from a period of time necessary for the paper sheet 3 to move away from the paper sensor 23. In the specific procedure shown in FIG. 11, on the elapse of a preselected period of time since the arrival of the leading edge of the paper sheet a at the registration roller pair 24, the paper sheet a is stopped for a moment for the registering purpose.

Figure 15:
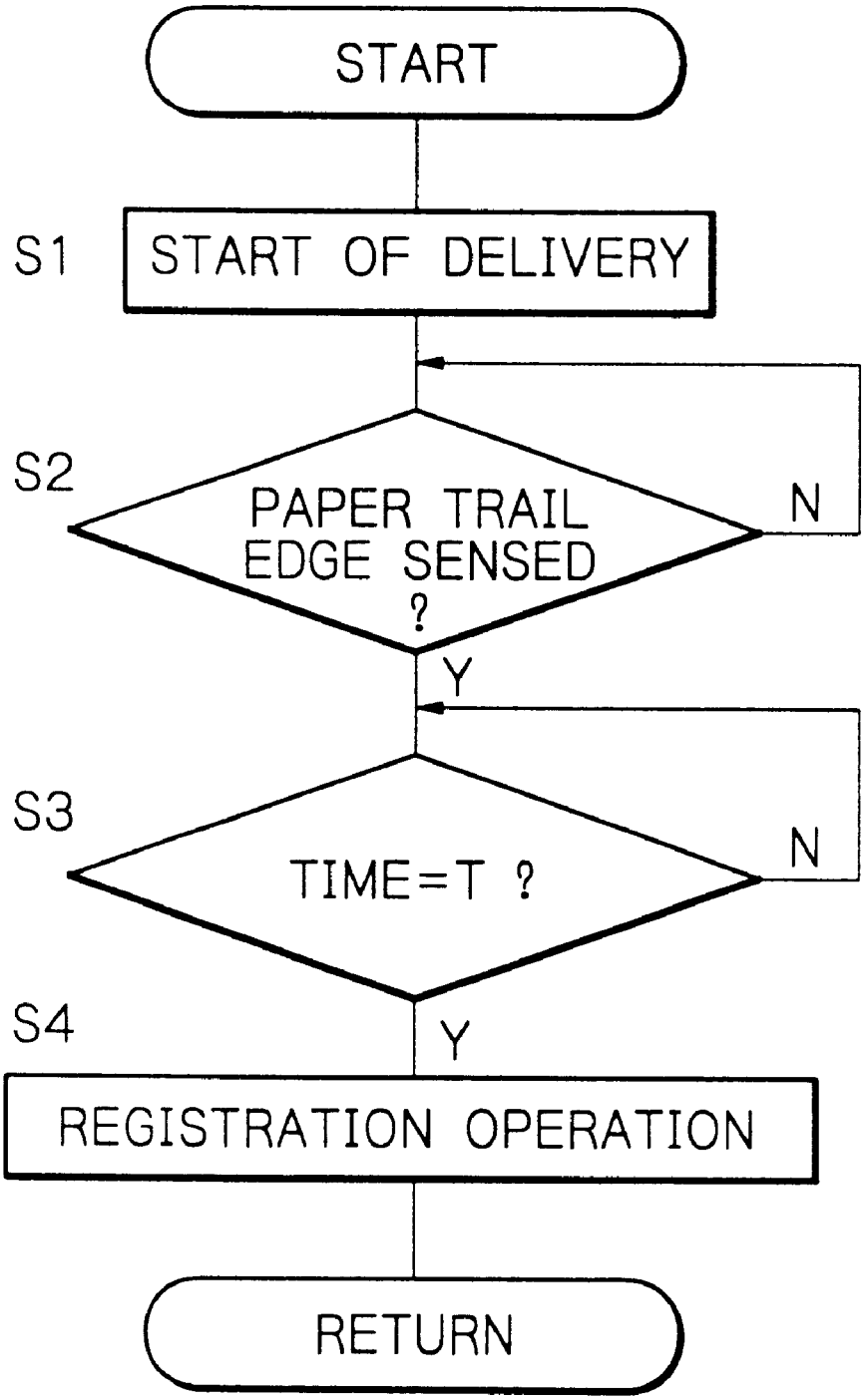
FIG. 15 is a flowchart showing the registering operation more specifically.

It has been customary with an image forming apparatus to sense the paper sheet 3 expected to arrive at the registration roller pair 24 by using an exclusive registration sensor. The illustrative embodiment does not need the registration sensor. Specifically, paying attention to the fact that the paper sensor 23 senses the trailing edge of the paper sheet a slightly earlier than a registration sensor would sense the paper sheet a, the illustrative embodiment causes the sensor 23 to function as a registration sensor at the same time. More specifically, as shown in FIG. 15, the microcomputer 25 causes the paper sheet a to begin to be paid out from the switchback path 17 (stop S1). After the paper sensor 23 has sensed the trailing edge of the paper sheet a in the direction of delivery (step S2), the microcomputer 25 calculates a conveying time T (step S3):

T=(distance between paper sensor 23 and roller pair 24)−(paper length/Vb)

When the leading edge of-the paper sheet a arrives at the registration roller pair 24 (Y (Yes), step S3), the microcomputer 25 executes the registering operation (step S4). Such a procedure obviates the need for a registration sensor and thereby reduces the production cost.

As far as an ink jet printer or similar line printer is concerned, an image forming operation can be readily interrupted between successive paper sheets and therefore does not deteriorate a printer engine. However, when it comes to the apparatus 1, e.g., a laser beam printer or similar page printer; it is impossible to interrupt the operation of a printer engine, which is represented by a photoconductive element, between successive paper sheets; the printer engine idles and therefore wears as during actual image formation. In this respect, the apparatus 1 noticeably reduces the interval between the paper sheets 3 and therefore the idle period between them. This minimizes the deterioration of the printer engine of the apparatus 1.

Today, high-speed printer technologies are implemented as digital electrophotographic image forming apparatuses. However, in a laser beam printer or similar image forming apparatus of the type including a digital optical writing unit, factors represented by the rotation speed of a polygonal motor limit the paper conveying speed available with the printer engine 2 during image formation. By contrast, in the apparatus 1 with the digital optical writing unit 8, the interval between successive paper sheets 3 and therefore the idle period between them is reduced to such a degree that the paper conveying speed in the printer engine 2 can be increased during repeated image formation.

Second Embodiment

Figure 16:
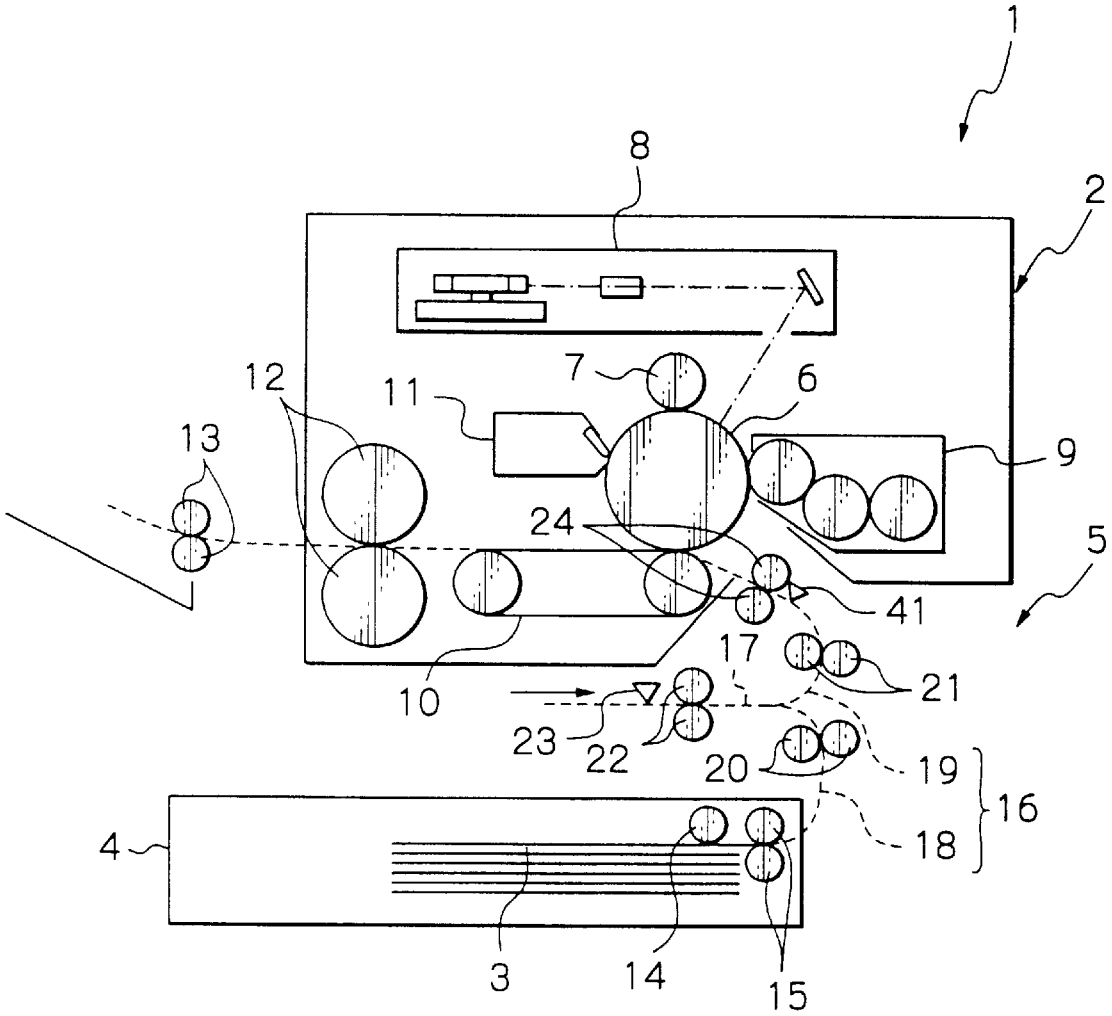
FIG. 16 is a view showing a second embodiment of the image forming apparatus in accordance with the present invention.

Reference will be made to FIG. 16 for describing an alternative embodiment of the present invention. In FIG, 16, structural elements identical with the structural elements shown in FIG. 1 are designated by identical reference numerals, and a detailed description will not be made in order to avoid redundancy. This is also true with structural elements included in a control system shown in FIG. 17.

Figure 17:
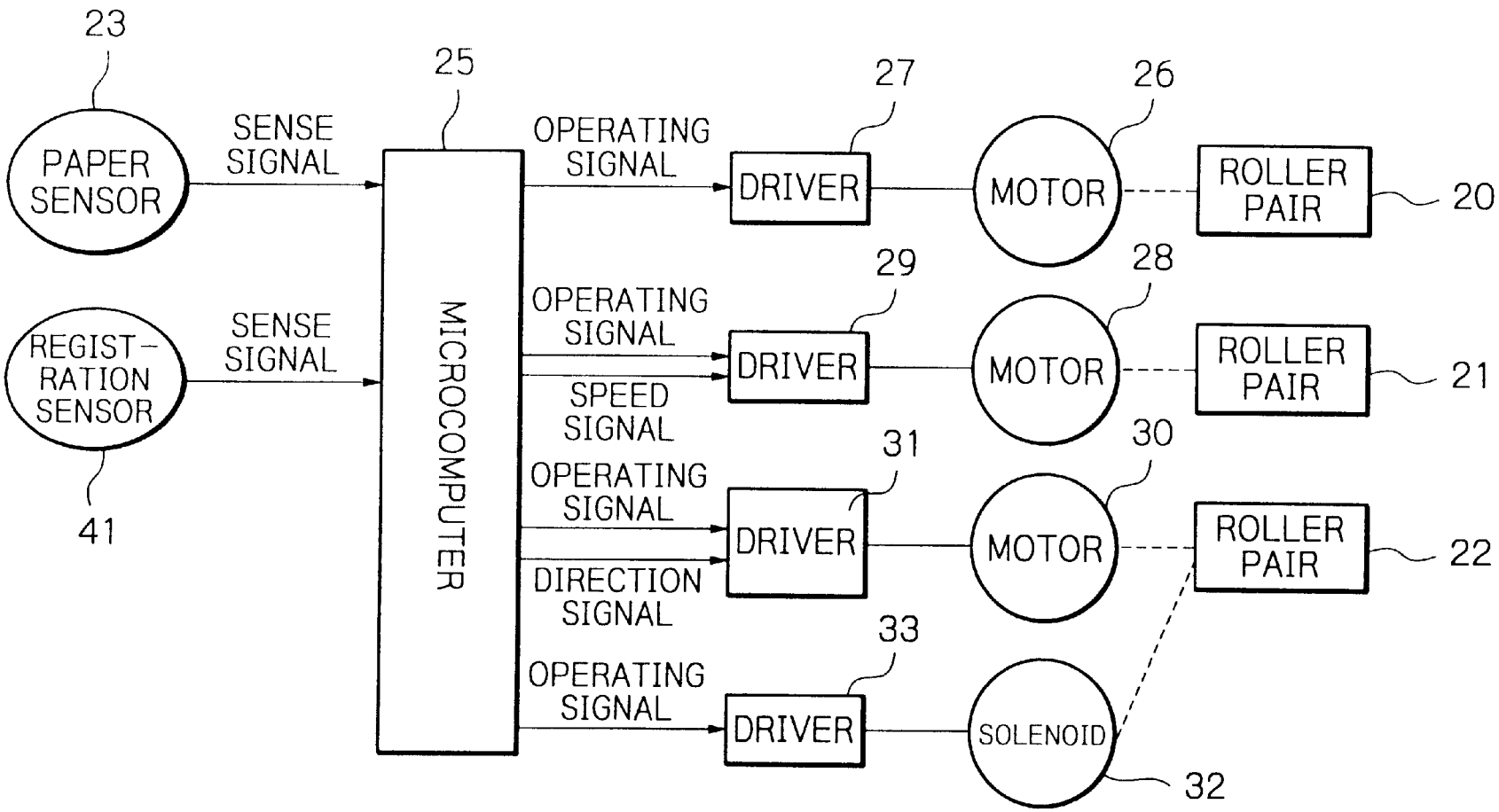
FIG. 17 is a block diagram schematically showing a control system included in the second embodiment.

As shown in FIGS. 1B and 17, this embodiment is identical with the previous embodiment except for a registration sensor 41 located on the transport path 19 upstream of the registration roller pair 24 in the direction of paper conveyance. The registration sensor 41 senses the leading edge of the paper sheet 3 delivered to the transport path 19 by the roller pair 22. The microcomputer 25 causes the registration roller pair 24 to start conveying the paper sheet 3 toward the printer engine 2 in synchronism with image forming operation.

Figure 18:
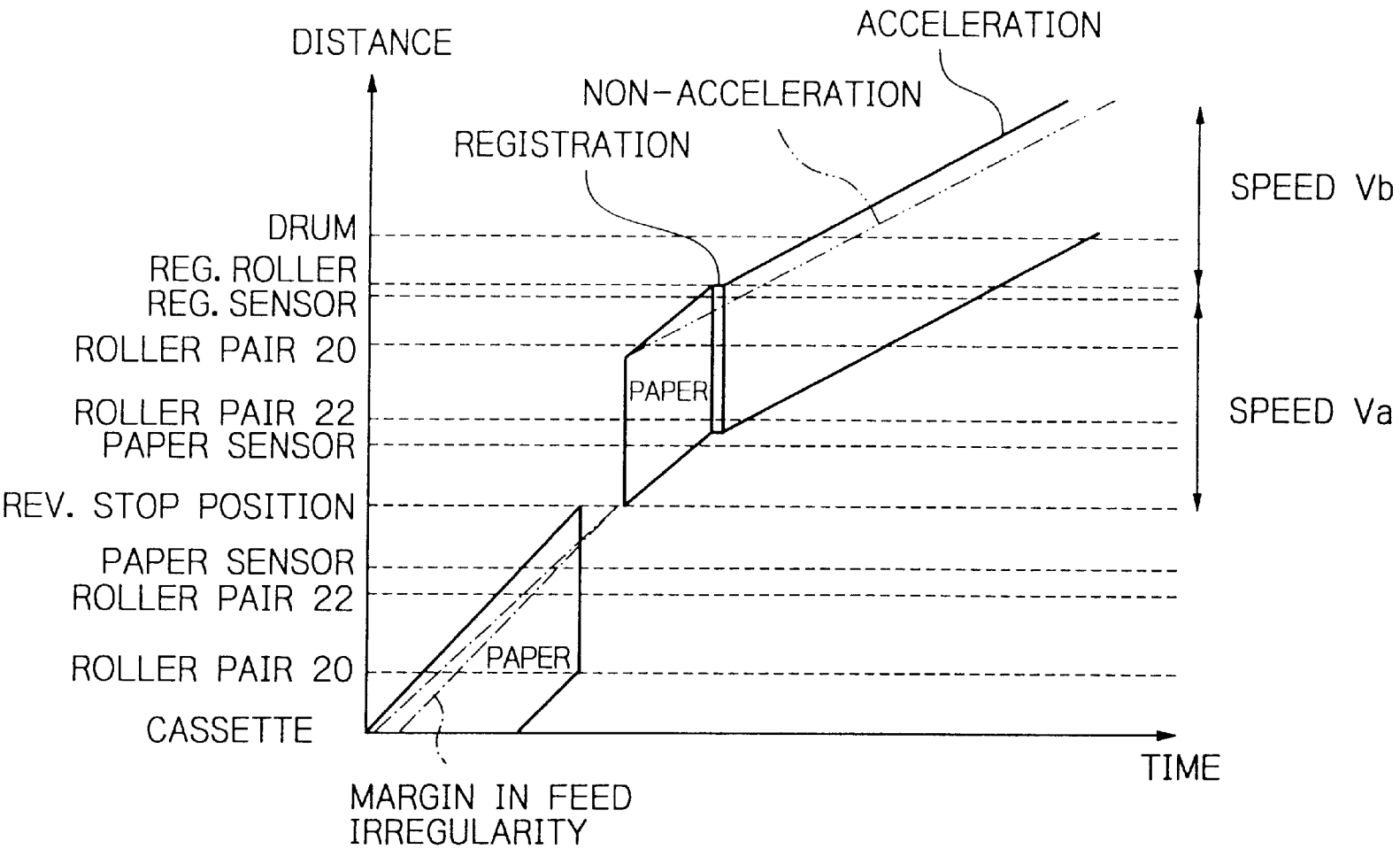
FIG. 18 is a diagram showing a paper conveying procedure particular to the second embodiment.

FIG. 18 is a diagram showing a specific paper conveying procedure particular to the illustrative embodiment. As shown, the speed Va at which the paper sheet 3 is delivered from the switchback path 17 toward the printer engine 2 is higher than the speed Vb at which it is conveyed in the printer engine 2 during image formation. More specifically, the roller pair 21 conveys the paper sheet 3 fed from the roller pair 22 to the transport path 19 at the speed Va while the registration roller pair 24 and successive roller pairs convey the paper sheet 3 at the speed Vb. The speed Va is variable in order to implement paper interval adjusting means.

The speed Va higher than the speed Vb, as stated above, makes it possible to reduce the interval between successive paper sheets 3. The illustrative embodiment can therefore reduce the wear of the printer engine 2 ascribable to the interval between the paper sheets 3, thereby enhancing accurate conveyance and productivity. Moreover, the fact that the speed Va and therefore the interval between the papers 3 is variable further enhances accurate conveyance and productivity.

Third Embodiment

Figure 19:
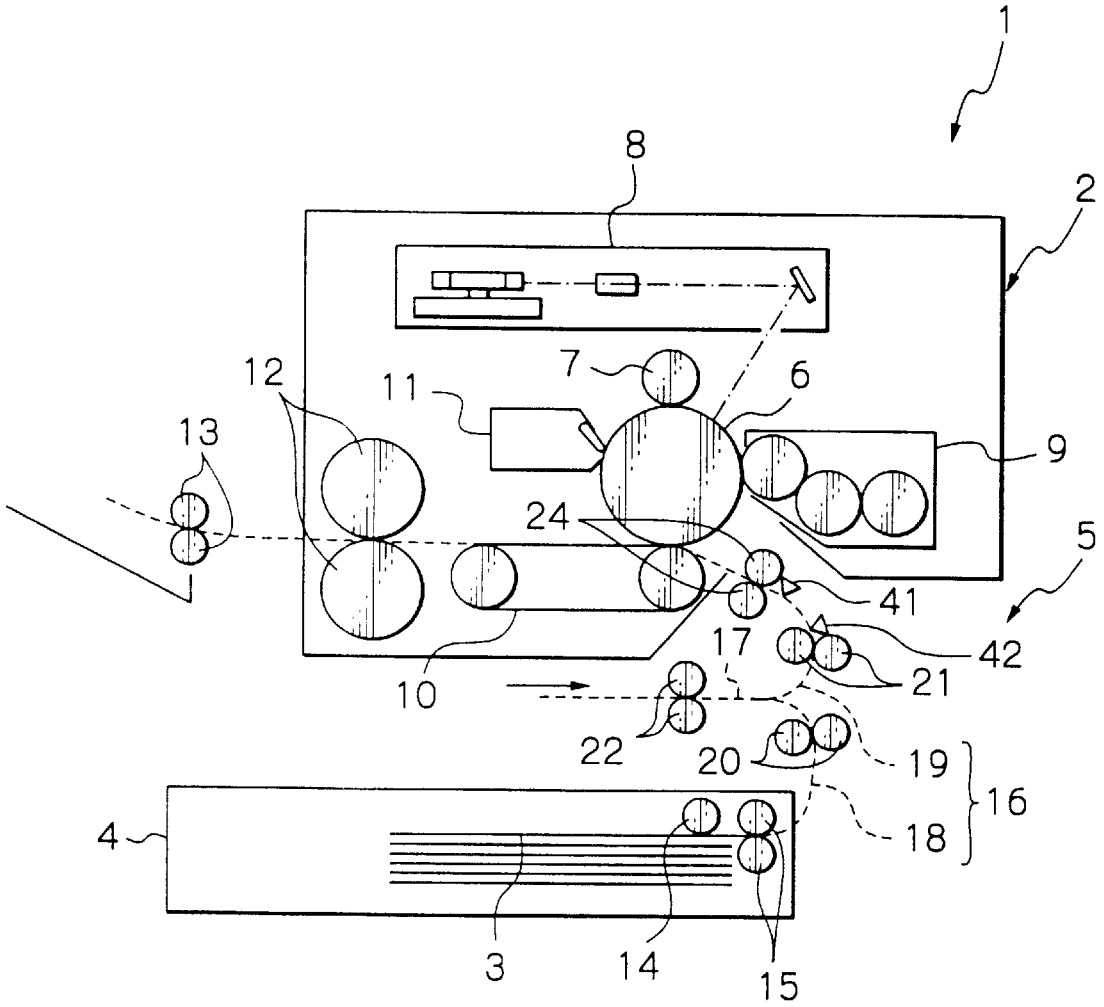
FIG. 19 is a view showing a third embodiment of the image forming apparatus in accordance with the present invention.

Referring to FIG. 19, another alternative embodiment of the present invention will be described. In FIG. 19, structural elements identical with the structural elements shown in FIG. 16 are designated by identical reference numerals, and a detailed description will not be made in order to avoid redundancy. This is also true with structural elements included in a control system shown in FIG. 20.

Figure 20:
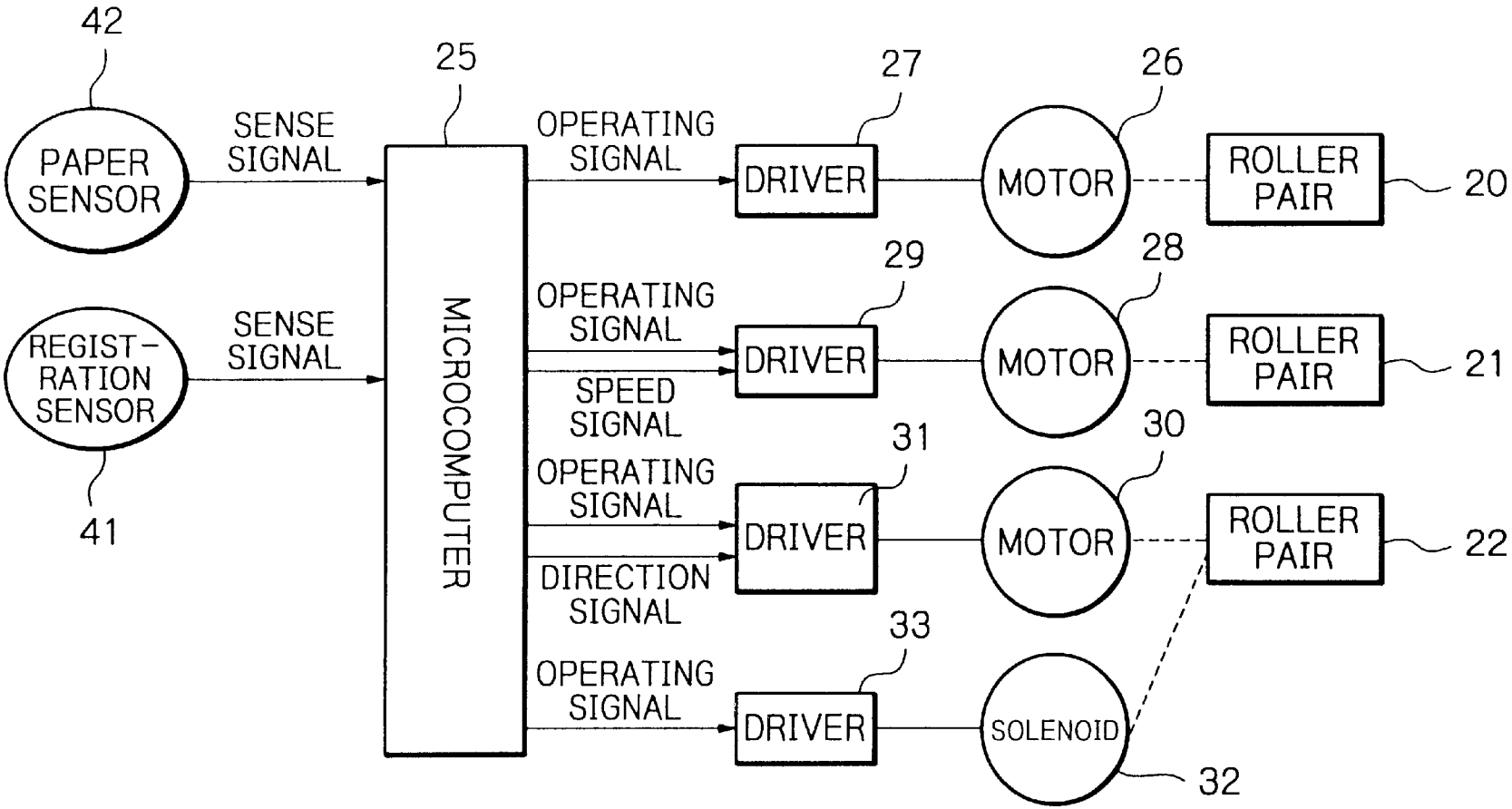
FIG. 20 is a block diagram schematically showing a control system included in the third embodiment.

As shown in FIGS. 19 and 20, this embodiment is identical with the second embodiment except that the paper sensor 23 is replaced with a paper sensor 42 located on the transport path downstream of the roller pair 21 in the direction of paper conveyance. The paper sensor 23 senses the leading edge of the paper sheet 3 brought thereto by the roller pairs 22 and 21.

When the paper sheet 3 is fully received in the switchback path 17, the conveying forces of the roller pairs 20 through 22 do not act on the paper sheet 3 for a moment. As a result. the paper sheet 3 slightly advances due to inertia. The reversal stop position therefore differs from one paper sheet 3 to another paper sheet 3, making the interval between successive paper sheets 3 irregular.

Figure 21:
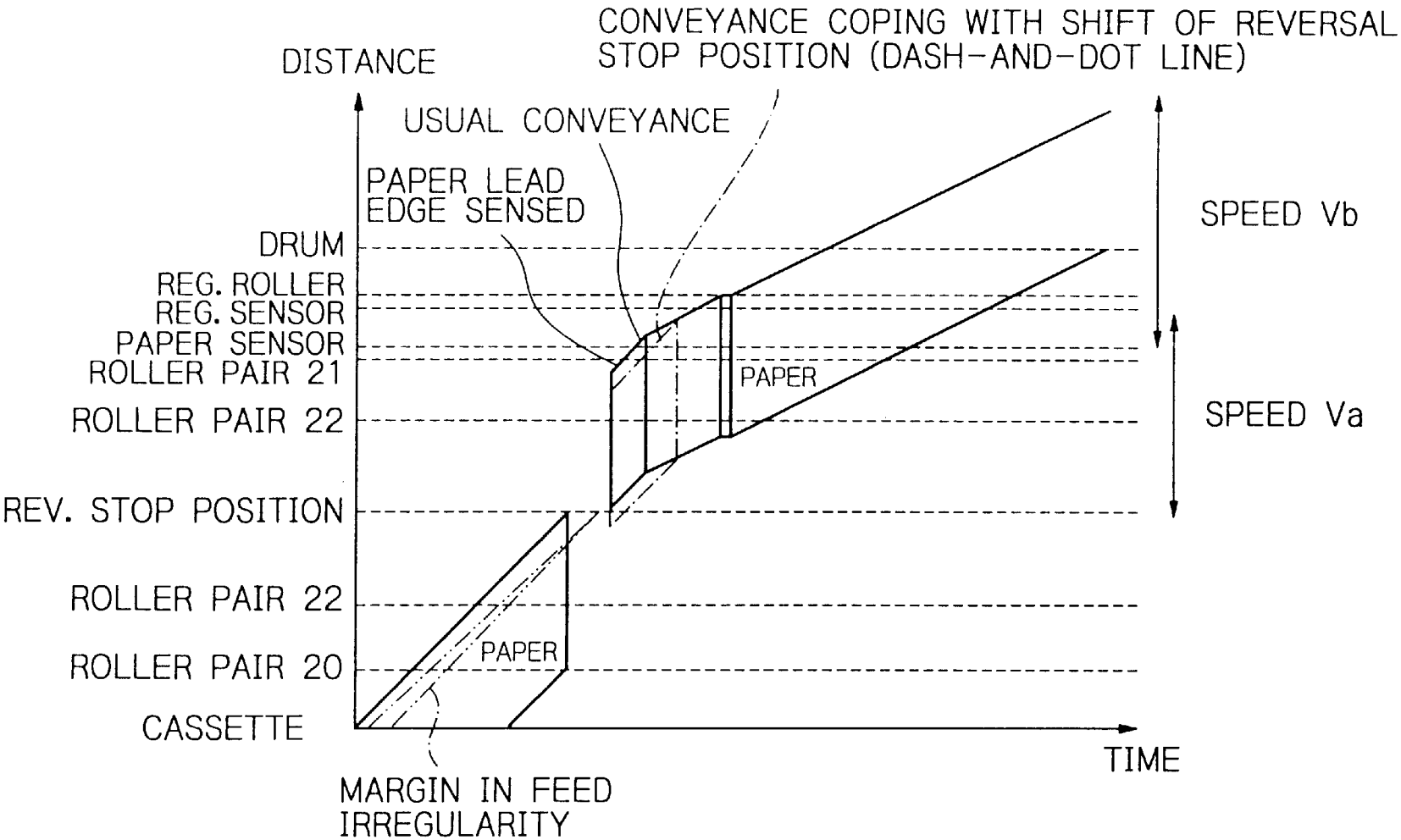
FIG. 21 is a diagram showing a paper conveying procedure particular to the third embodiment.

In light of the above, in the illustrative embodiment, the microcomputer 25 counts a period of time T between the time when the roller pair 22 is reversed to start driving the paper sheet 3 out of the switchback path 17 and the time when the paper sensor 42 senses the leading edge of the same paper sheet 3. The microcomputer 25 then compares the period of time T with a reference period of time T0 stored in a ROM (Read Only Memory) included in the microcomputer 25. The microcomputer 25 adjusts, based on the result of comparison, the position where the conveying speed should be reduced from Va to Vb. More specifically, the microcomputer 25 calculates a delay in paper conveyance on the basis of the reference period of time T0 and the actual period of time T. As the delay increases, the microcomputer 25 shifts the above speed reduction position more to the downstream side in the direction of paper conveyance. For example, assume that the paper sheet 3 stops at a position on the switchback path 17 deeper than the preselected reversal stop position. as indicated by a dash-and-dot line in FIG. 21. Then, the microcomputer 25 reduces the conveying speed from Va to Vb at a position downstream of the reference speed reduction position in the direction of paper conveyance.

Figure 22:
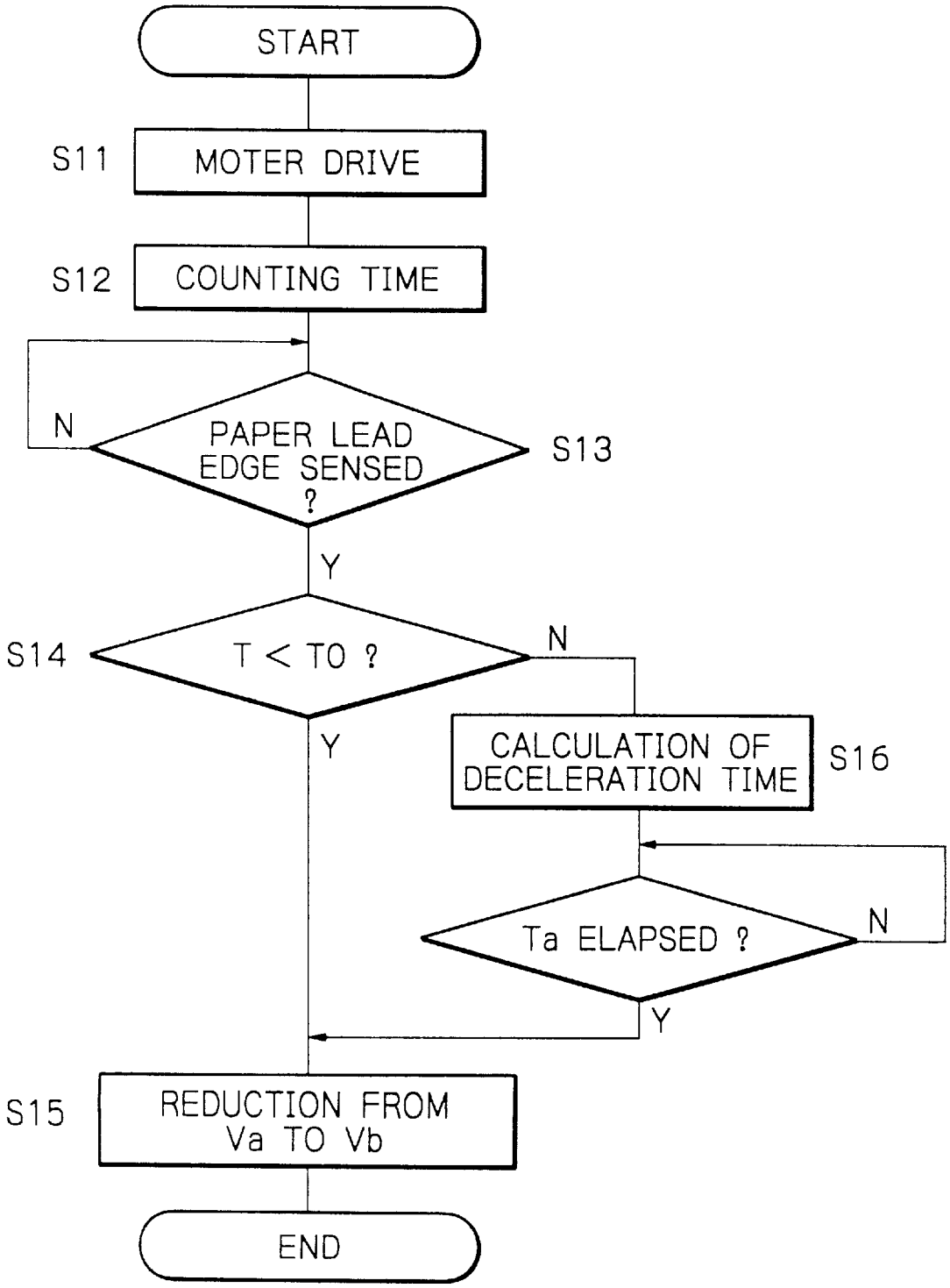
FIG. 22 is a flowchart showing control available with the third embodiment specifically.

FIG. 22 demonstrates a specific operation of the illustrative embodiment, particularly the microcomputer 25. As shown, the microcomputer 25 drives the motor 28 in order to rotate the roller pair 21 (step S11). As a result, the roller pair 21 starts conveying the paper sheet 3 at the speed Va. The microcomputer 25 starts counting time after it has started driving the motor 28 (step S12). The microcomputer 25 then determines whether or not the paper sensor 42 has sensed the leading edge of the paper 3 (step S13).

If the answer of the step S13 is positive (Y), the microcomputer 25 determines whether or not the period of time T is shorter than the reference period of time T0 (step S14). If the answer of the step S14 is Y, the microcomputer 25 reduces the conveying speed from Va to Vb at the reference position stored in the microcomputer 25 (step S15). If the answer of the step S14 is negative (N), the microcomputer 25 calculates a period of time Ta over which the paper sheet 3 should be conveyed at the speed Va on the basis of the periods of time T and T0 (stop S18). The microcomputer 25 then causes the paper sheet 3 to be continuously conveyed at the speed Va until the above period of time Ta expires. When the period of time Ta expires (Y, step S17), the microcomputer 25 reduces the conveying speed from Va to Vb (step S15). The steps S14 through S17 implement the function of paper interval adjusting means.

As stated above, assume that the interval between the paper sheets 3 to be delivered from the switchback path 17 becomes irregular due to, e.g., the inertia of the paper sheet 3 or slip between it and the roller pair 22. Then, the illustrative embodiment adjusts the period of time over which the paper sheet 3 should be conveyed at the speed Va higher than the speed Vb between the reversal stop position and the paper sensor 42. This is successful to maintain the interval between the paper sheets 3 constant on the path following the paper sensor 42 and therefore to insure accurate paper conveyance.

Fourth Embodiment

This embodiment is identical with the third embodiment except for the following. Identical structural elements are designated by identical reference numerals, and a detailed description thereof will not be made in order to avoid redundancy. Assume that the interval between successive sheets 3 is short due to, e.g., the length of the paper sheets 3 greater than an expected length. Then, errors are apt to occur when the leading edge and trailing edge of the paper sheet 3 are sensed or when the route extending from the transport path 18 to the switchback path 17 is switched.

In light of the above, in the illustrative embodiment, the microcomputer 25 counts a period of time T between the time when the roller pair 22 is reversed to start driving the-preceding paper sheet a out of the switchback path 17 and the time when the paper sensor 42 senses the trailing edge of the same paper sheet a. The microcomputer 25 then compares the period of time T with a reference period of time T0 stored therein. The microcomputer 25 adjusts, based on the result of comparison, the position where the conveying speed should be reduced from Va to Vb. More specifically, the microcomputer 25 calculates the length of the paper sheet 3 on the basis of the output of the paper sensor 42 and determines that the length is greater as the delay from the reference period of time T0 increases. The microcomputer 25 then advances the timing, or position, for reducing the speed of the following paper sheet b and thereby maintains the interval between the successive paper sheets a and b adequate.

Figure 23:
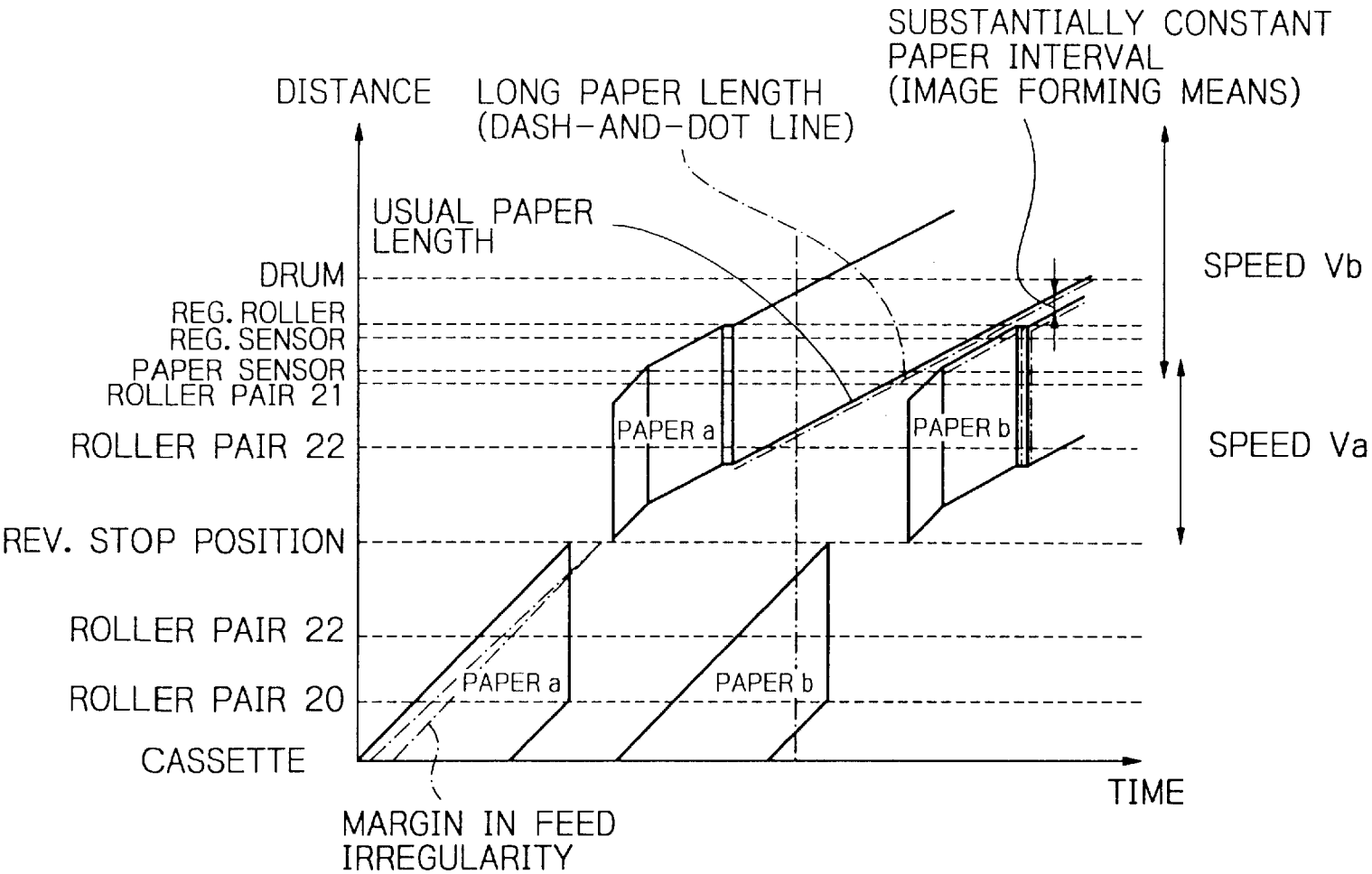
FIG. 23 is a diagram representative of a fourth embodiment of the image forming apparatus in accordance with the present invention.

Specifically, assume that the paper sheet 3 has a length greater than an expected length. Then, the microcomputer 25 reduces the speed of the following paper sheet b at a position short of the reference position, as indicated by a dash-and-dot line in FIG. 23. Consequently. even when the paper sheet 3 is longer than expected, the interval between successive paper sheets 3 is prevented from becoming short. The illustrative embodiment therefore obviates errors ascribable to the irregular lengths of the paper sheets 3 during image formation, realizing accurate paper conveyance.

Figure 24:
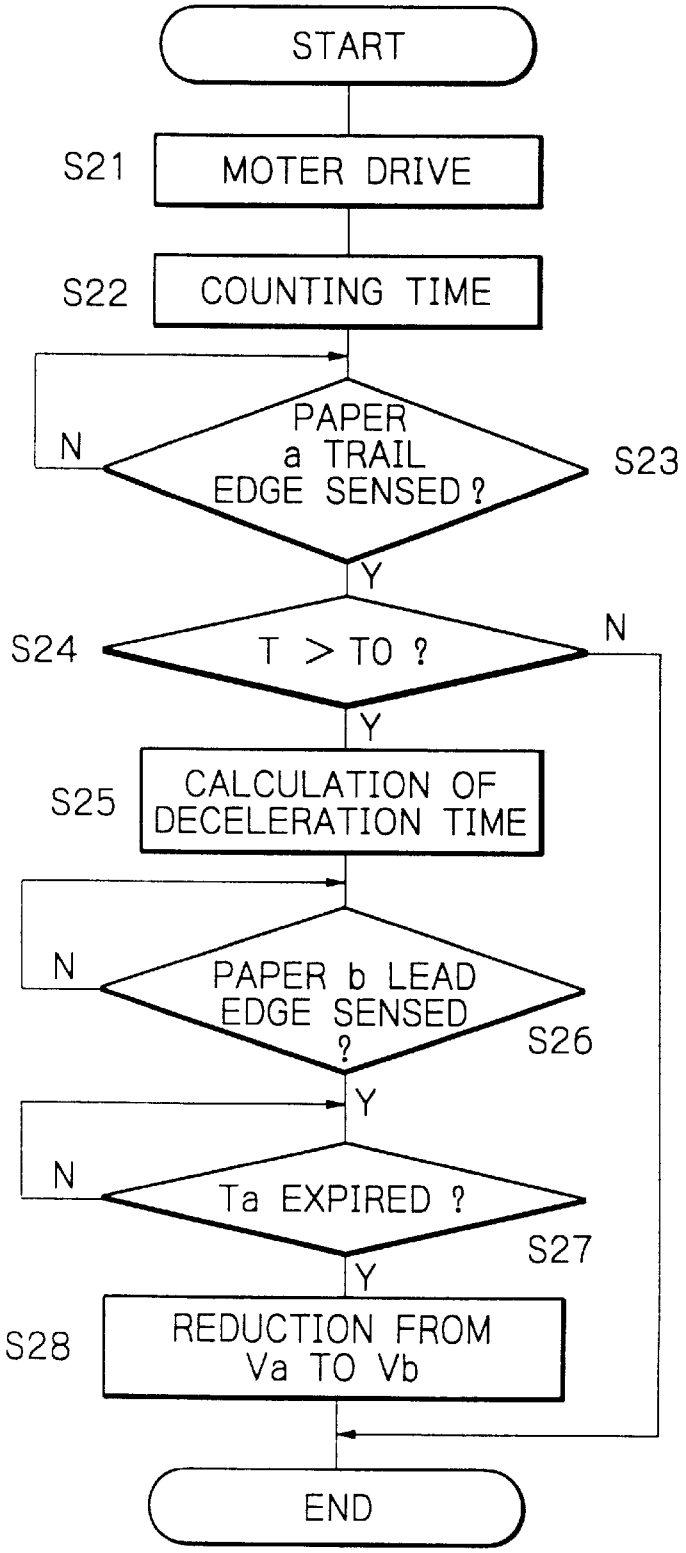
FIG. 24 is a flowchart showing control available with the fourth embodiment specifically.

FIG. 24 shows a specific operation of the illustrative embodiment. particularly the microcomputer 25. As shown, the microcomputer 25 drives the motor 28 in order to rotate the roller pair 21 (step S21). As a result, the roller pair 21 starts conveying the preceding paper sheet a at the speed Va. The microcomputer 25 starts counting time after it has started driving the motor 28 (step S22). The microcomputer 25 then determines whether or not the paper sensor 42 has sensed the leading edge of the preceding paper sheet a (step S23).

If the answer of the step S23 is positive (Y). the microcomputer 25 determines whether or not a period of time T counted in the step S21 is shorter than a reference period of time T0 (step S24). If the answer of the stop S24 is Y, the microcomputer 25 calculates a period of time Ta up to the time when the following paper sheet b should be decelerated from Va to Vb (step S25). The microcomputer 25 then determines whether or not the paper sensor 42 has sensed the leading edge of the following paper sheet b (step S28). If the answer of the step S26 is Y, the microcomputer 25 determines whether or not the period of time Ta calculated in the step S25 has expired (step S27). If the answer of the step S27 is Y. the microcomputer 25 decelerates the following paper sheet b from Vs to Vb (step S28).

The steps S24 through S28 implement the function of paper interval adjusting means. Even when the paper sheet 3 is longer than expected, the interval between successive paper sheets 3 is prevented from becoming short. The illustrative embodiment therefore obviates errors ascribable to the irregular lengths of the paper sheets 3 during image formation, realizing accurate paper conveyance. On the elapse of a preselected period of time since the paper sensor 42 has sensed the leading edge of the decelerated paper sheet b, the microcomputer 25 stops driving the motor 28 and waits for image formation with the leading edge of the paper sheet b abutting against the registration roller pair 24.

Fifth Embodiment

This embodiment is also identical with the third embodiment except for the following. Identical structural elements are designated by identical reference numerals, and a detailed description thereof will not be made in order to avoid redundancy. Generally, when a long period of time is necessary for the optical writing unit 8 to generate a writing signal, the paper sheet 3 being conveyed toward the printer engine 2 must be brought to a stop for a moment.

Figure 25:
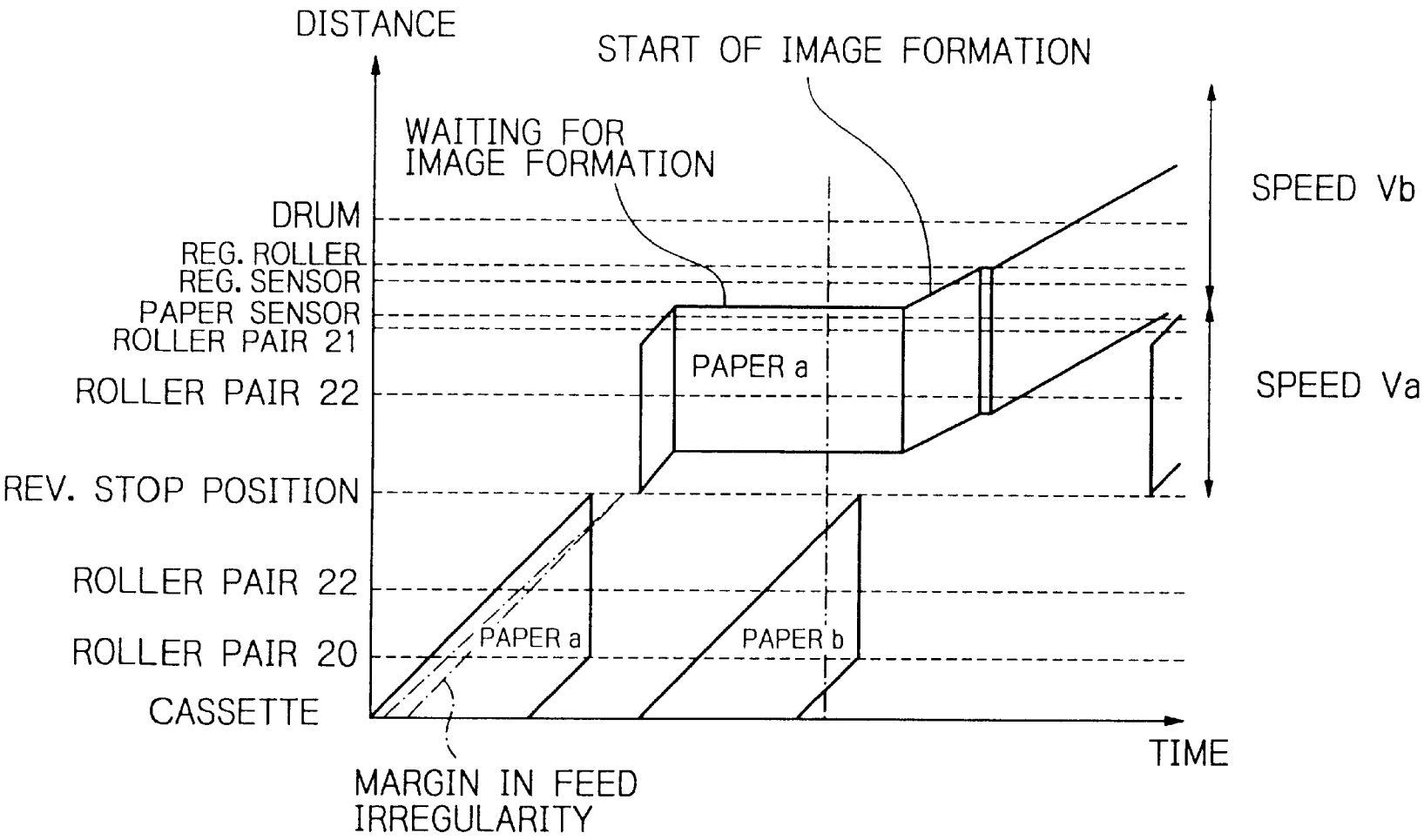
FIGS. 25 and 26 are diagrams representative of a fifth embodiment of the image forming apparatus in accordance with the present invention.

In the above situation, the illustrative embodiment interrupts the conveyance of the paper sheet 3 on the elapse of a preselected period of time since the paper sensor 42 has sensed the leading edge of the paper sheet 3. The paper sheet 3 can therefore be temporarily stopped at a constant position at all times. This obviates the need for an extra period of time for correcting the timing for delivering the paper sheet 3 to the printer engine 2 and therefore allows image formation to start immediately after the generation of the writing signal. As shown in FIG. 25 specifically, the preceding paper sheet a is nipped by the roller pair 21. It is therefore not necessary for the roller pair 22 to exert a conveying force on the paper sheet a. It follows that the following paper sheet b can be conveyed to the reversal stop position even when part of the preceding paper sheet a exists on the switchback path 17.

Figure 26:
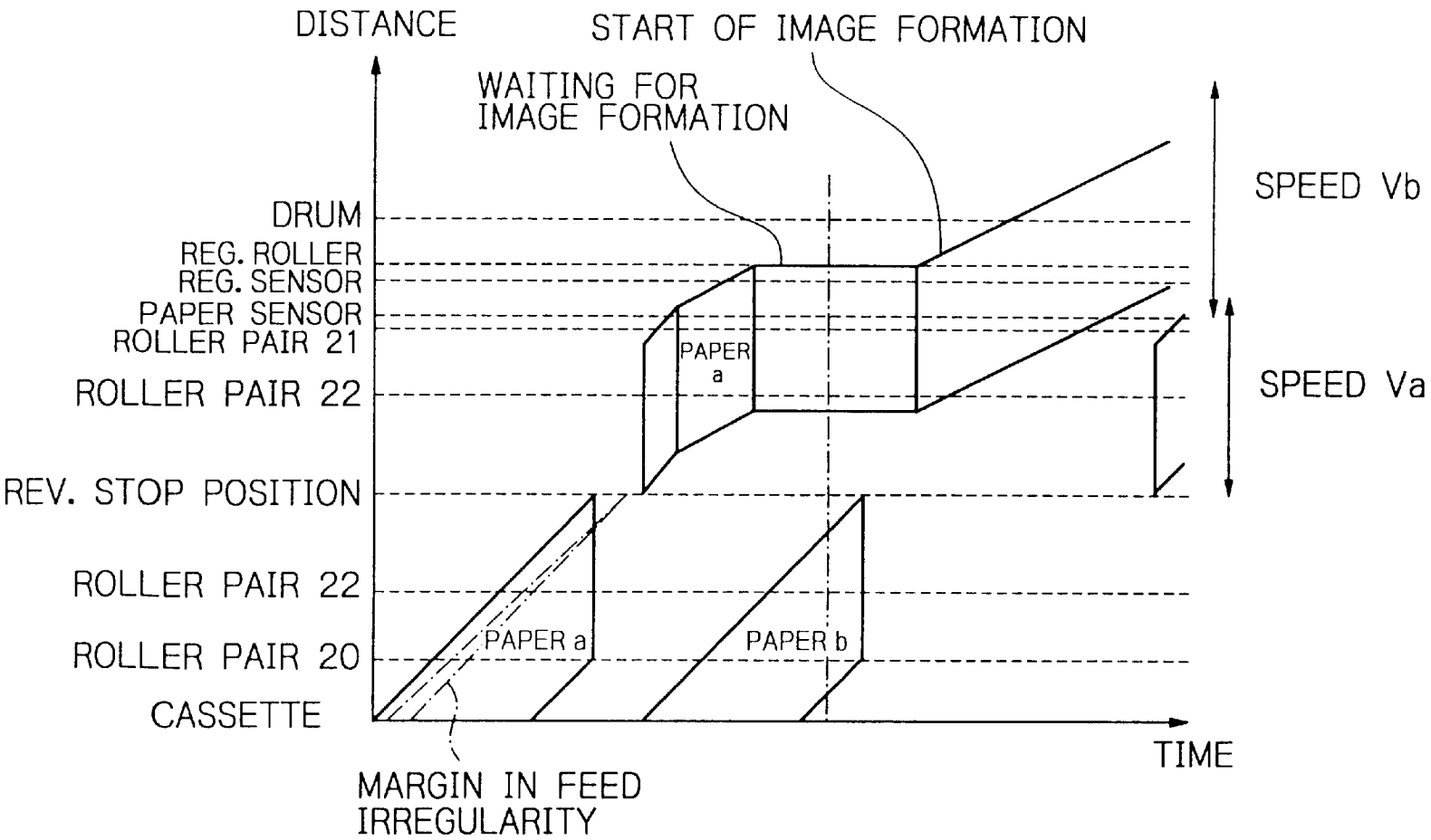

In the illustrative embodiment, the position where the paper sheet 3 being conveyed by the roller pair 21 should be stopped for a moment is substantially coincident with the timing for decelerating the conveying speed from Va to Vb. Alternatively, the paper sheet 3 may be brought to a stop at a position where the paper sheet 3 can be easily removed in the event of. e.g., a jam For example, assume that the paper sheet 3 is temporarily stopped at a position where its leading edge abuts against the registration roller pair 24, as shown in FIG. 26. Then, by driving the registration roller pair 24 after the generation of the writing signal, it is possible to convey the paper sheet 3 to the printer engine 2 accurately and rapidly, further enhancing the reliability of the apparatus 1.

Moreover, when the paper shoot 3 is temporarily stopped with its leading edge abutting against the registration roller pair 24, the registration roller pair 24 can convey the paper sheet 3 alone, i.e., the roller pair 21 does not have to be driven. As a result, the load to act on the paper sheet 3 is minimized. In addition, controlling only the drive of the registration roller pair 24 suffices.

Sixth Embodiment

Figure 27:
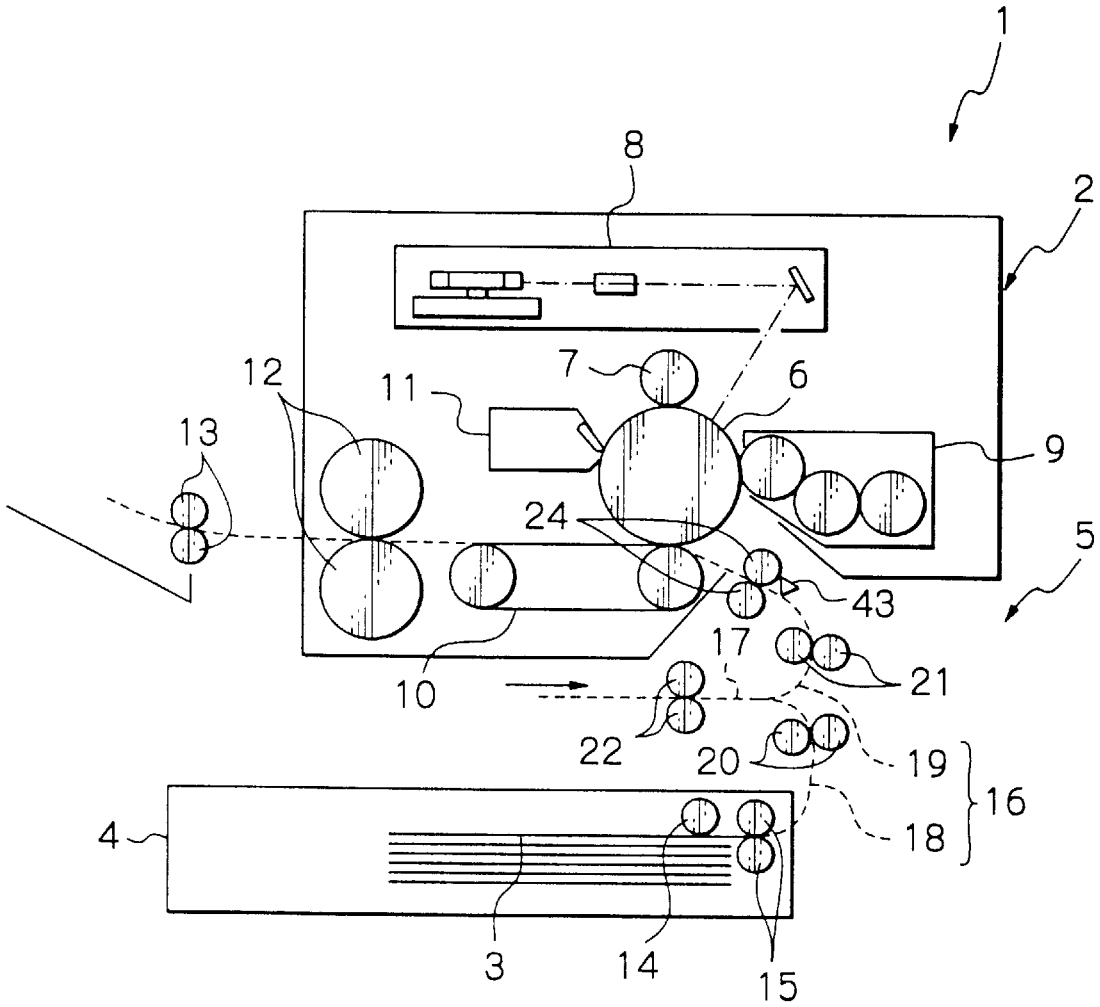
FIG. 27 is a view showing a sixth embodiment of the image forming apparatus in accordance with the present invention.

Reference will be made to FIG. 27 for describing a sixth embodiment of the present invention similar to the fifth embodiment. Identical structural elements are designated by identical reference numerals, and a detailed description thereof will not be made in order to avoid redundancy. As shown, this embodiment differs from the sixth embodiment in that a sensor 43 is substituted for the registration sensor 41 and paper sensor 23 or 42 and located at a position just short of the registration roller pair 24 in the direction of paper conveyance. The sensor 43 plays the role of the sensor 41 and that of the sensor 23 at the same time and allows the conveyance speed control, paper interval control and registration to be effected by sensing the paper sheet 3 only once.

Figure 28:
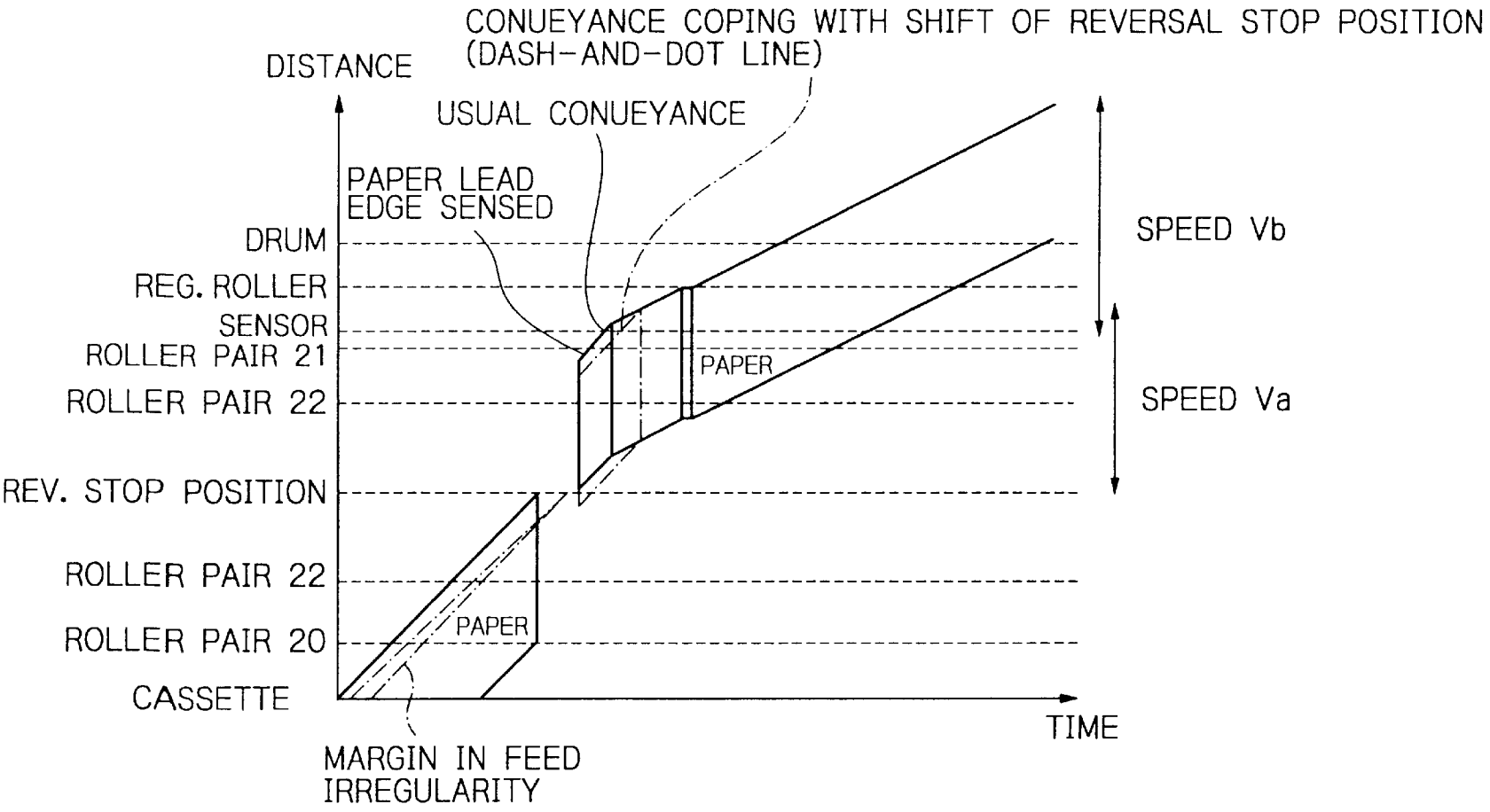
FIG. 28 is a diagram showing a paper conveying procedure particular to the sixth embodiment.

As shown in FIG. 28 specifically, the microcomputer 25 stops driving the roller pair 21 on the elapse of a preselected period of time since the sensor 43 has sensed the leading edge of the paper sheet 3. Assume that the period of time T in which the sensor 43 has sensed the leading edge of the paper sheet 3 is longer than the reference period of time T0. Then, the microcomputer 25 determines that the conveyance of the following paper sheet b is delayed or that the interval between successive paper sheets is greater than preselected one. In this case, the microcomputer 25 shifts the position for reducing the speed Va, which is higher than the speed Vb identical with the conveying speed assigned to the printer engine 2, to the speed Vb to a position downstream of the reference position in the direction of paper conveyance. This successfully reduces the interval between the paper sheets 3 without increasing the number of parts and thereby enhances productivity.

Furthermore, because the sensor 43 is located at a position short of the registration roller pair 24, it is capable of sensing the edge of the paper sheet 3 with high accuracy.

Seventh Embodiment

Figure 29:
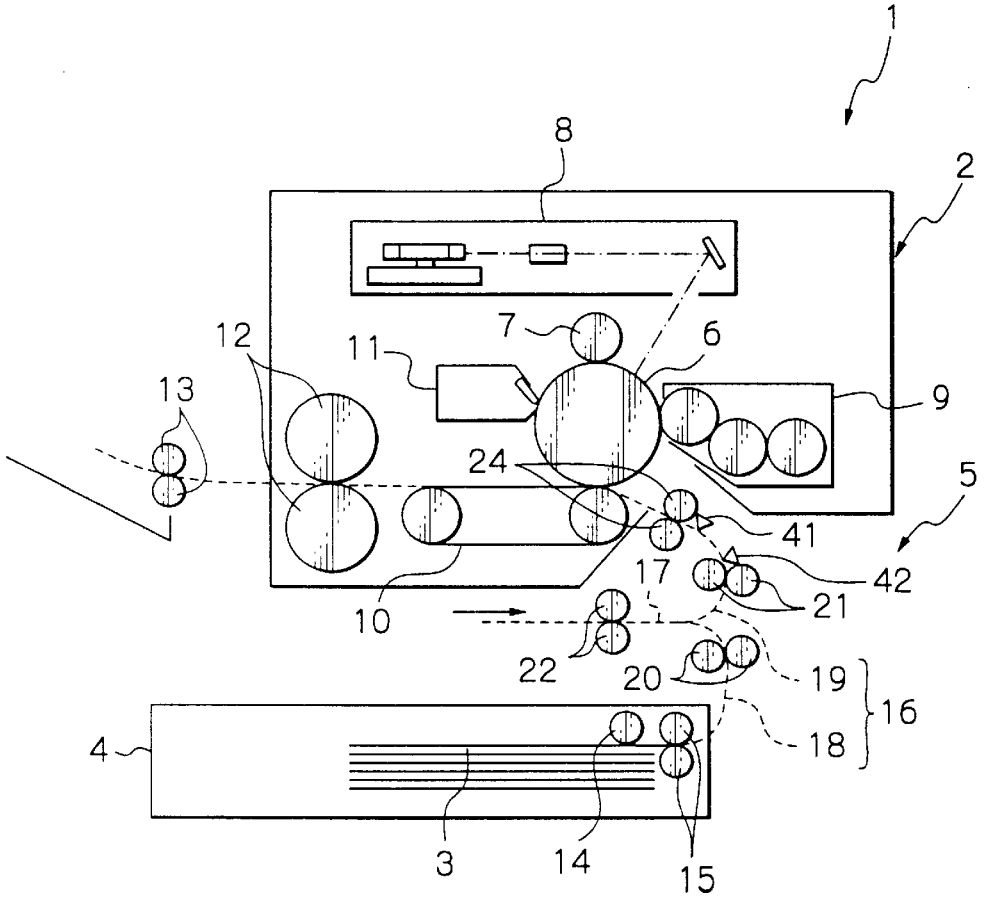
FIG. 29 is a view showing a seventh embodiment of the image forming apparatus in accordance with the present invention.
Figure 30:
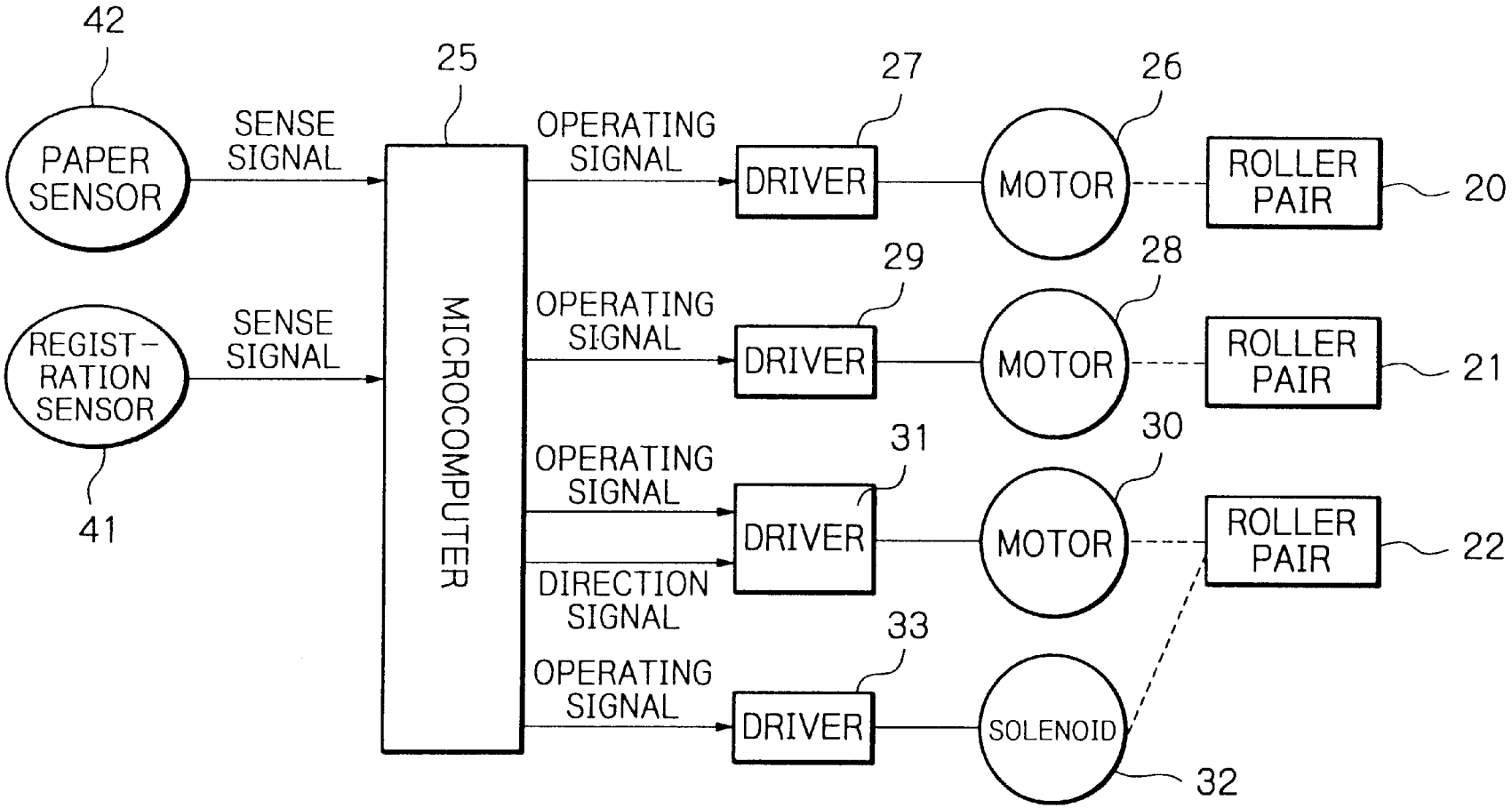
FIG. 30 is a block diagram schematically showing a control system included in the seventh embodiment.

Reference will be made to FIG. 29 for describing a seventh embodiment of the present invention similar to the third embodiment. Identical structural elements are designated by identical reference numerals, and a detailed description thereof will not be made in order to avoid redundancy. FIG. 30 shows a control system particular to the illustrative embodiment.

The position of the paper sheet 3 driven out of the switchback path 17 by the roller pair 22 involves some irregularity. Also, some irregularly occurs when the paper sheet 3 is being conveyed from the paper reversing position toward the registration roller pair 24. In light of this, in the illustrative embodiment, the paper sensor 42. senses the leading edge of the paper sheet 3 being conveyed away from the switchback path 17. The microcomputer 25 controls the speed of the paper sheet 3 on the basis of the resulting output of the paper sensor 42. In this sense. the microcomputer 25 implements speed control means and insures accurate paper conveyance. To control the paper conveying speed 3, the microcomputer 25 may control the timing for reducing the conveying speed from Vb to Vs (see FIG. 31) or may switch it from Vb to Vc that is an optimal speed.

Figure 31:
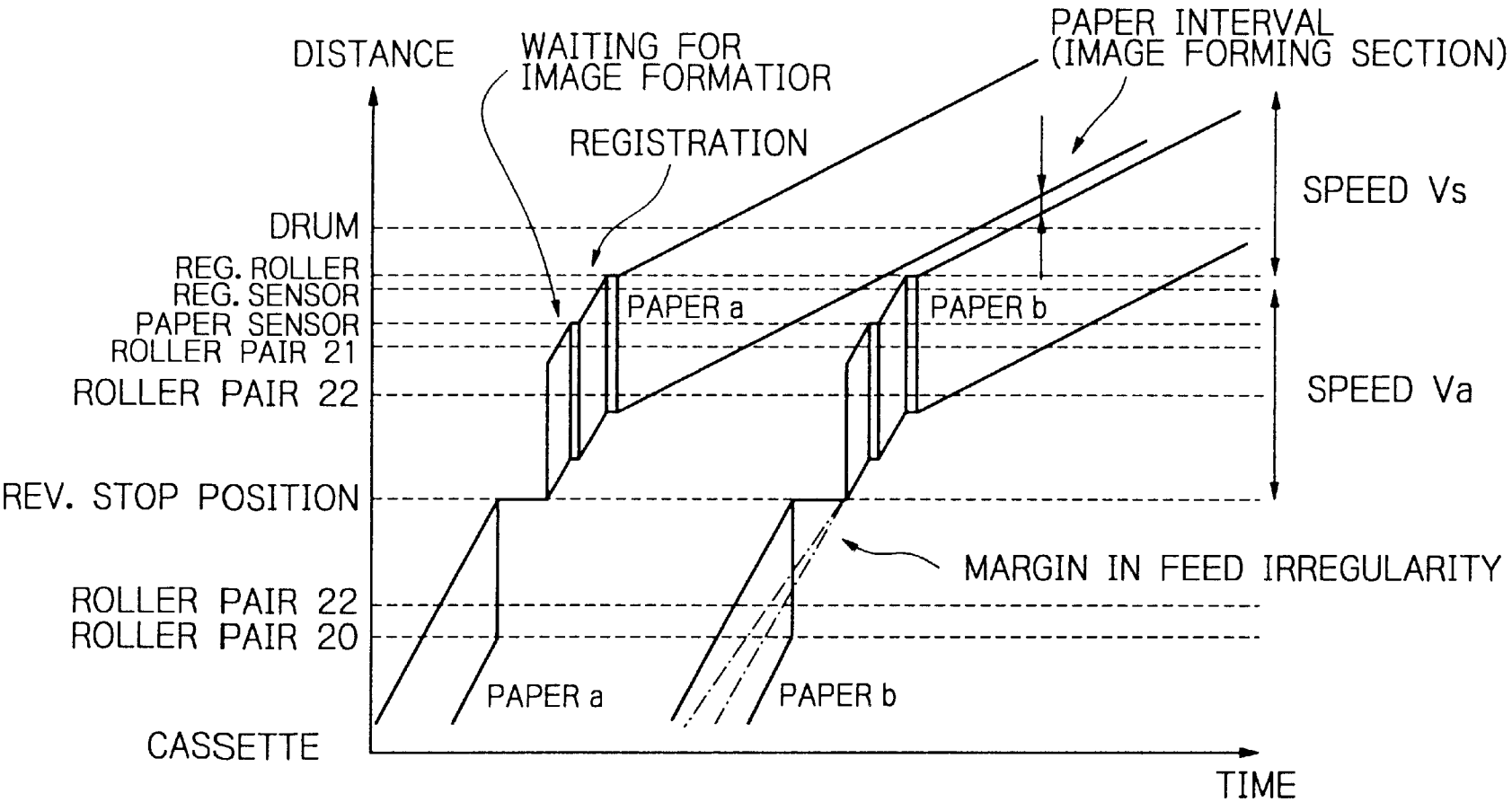
FIG. 31 is a diagram demonstrating a paper conveying operation available with the seventh embodiment.

Particularly, as shown in FIG. 31, after the paper sensor 42 has sensed the paper sheet 3. the controller 25 may stop the conveyance of the paper sheet 3 (Waiting for Image Formation) and control the conveying speed in terms of the duration of the stop. In this case, only if the paper sheet 3 is selectively conveyed at the speed Vb or Vs, the conveying speed does not have to be control led any further. This makes sophisticated control for continuously varying the conveying speed needless. Moreover, the microcomputer 25 does not have to calculate a conveying speed or the timing for varying it. That is, the conveying speed can be controlled only if the paper sheet 3 is brought to a stop after the paper sensor 42 has sensed it and if the conveyance is resumed on the elapse of a preselected period of time. Such control is simple and reduces the production cost.

Eighth Embodiment

Figure 32:
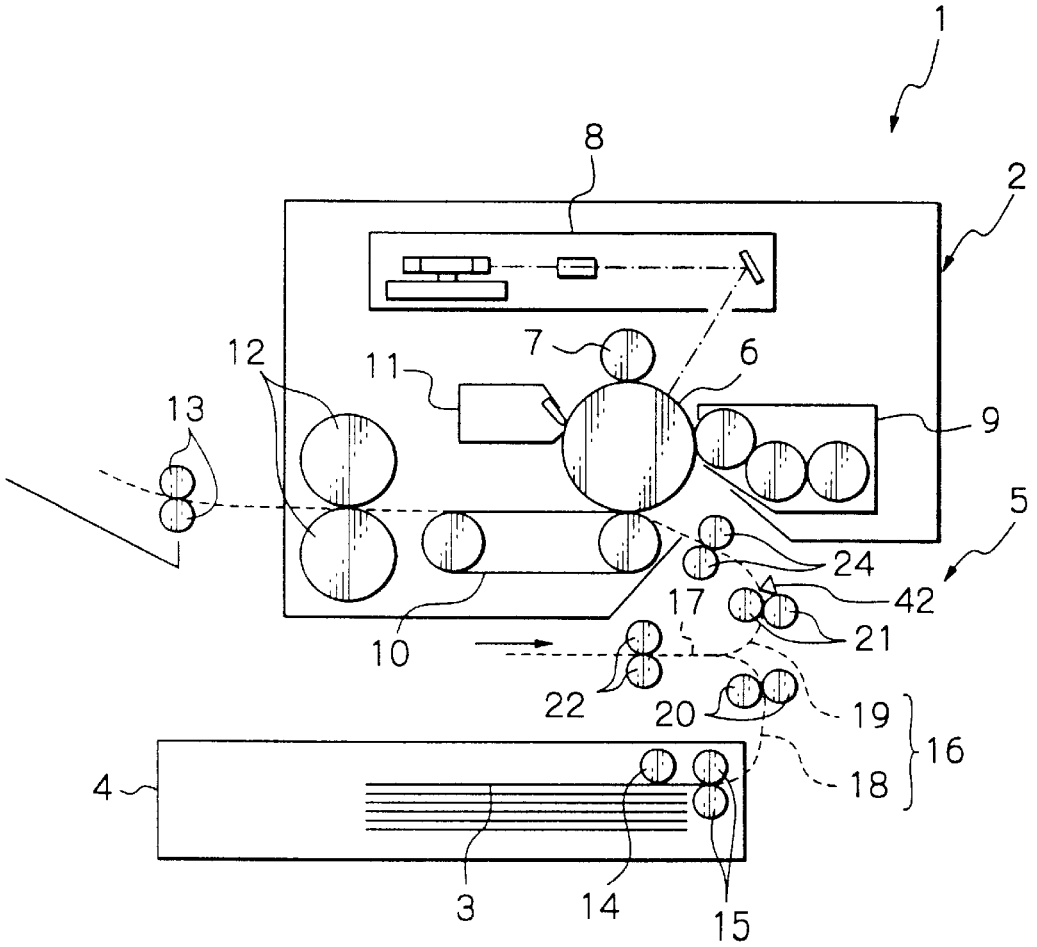
FIG. 32 is a view showing an eighth embodiment of the image forming apparatus in accordance with the present invention.
Figure 33:
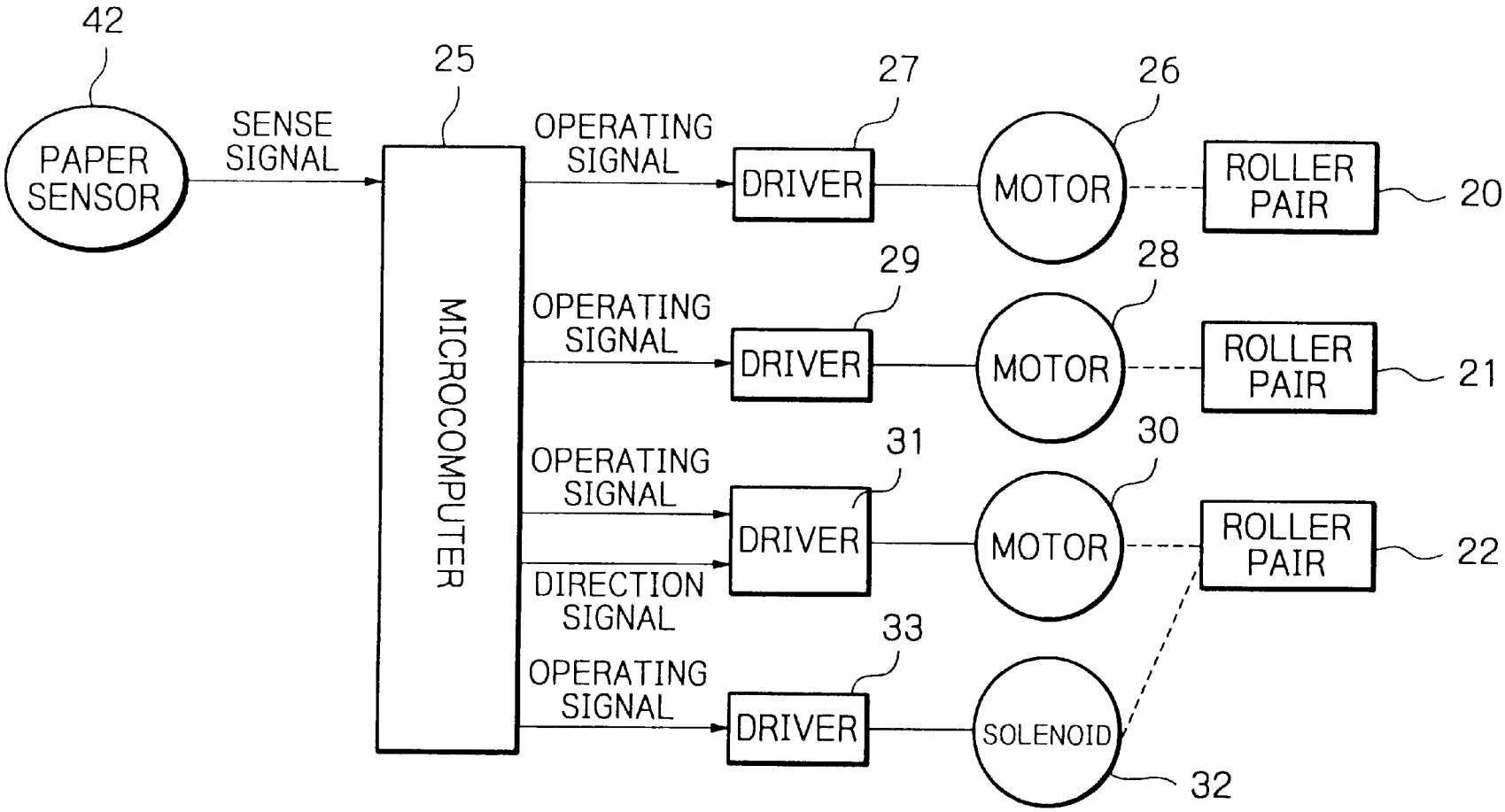
FIG. 33 is a block diagram schematically showing a control system included in the eighth embodiment.

Reference will be made to FIG. 32 for describing an eighth embodiment of the present invention similar to the seventh embodiment. Identical structural elements are designated by identical reference numerals, and a detailed description thereof will not be made in order to avoid redundancy. FIG. 33 shows a control system particular to the illustrative embodiment. As shown, this embodiment differs from the seventh embodiment in that it does not include the registration sensor 41 and causes the registration roller pair 24 to constantly rotate without performing the registering operation.

To accurately synchronize the paper sheet 3 to image formation, it has been customary with an image forming apparatus to temporarily stop the paper sheet 3 for the registering purpose when, e.g., the apparatus waits for the generation of image data. Therefore, when the operator uncovers the apparatus for dealing with a jam or for maintenance while the apparatus is in operation, it is quite likely that the paper sheet 3 is held in a halt in the above position. The paper sheet 3 must therefore be removed because the apparatus cannot continue its operation. Should the paper sheet 3 be abutted against and nipped by the registration roller pair 24 at its leading edge and be additionally nipped by the roller pair 21, only the leading edge of the paper sheet 3 would easily tear during manual work. The operator must therefore remove the paper sheet 3 with greatest care, resulting in inefficient work.

Figure 34:
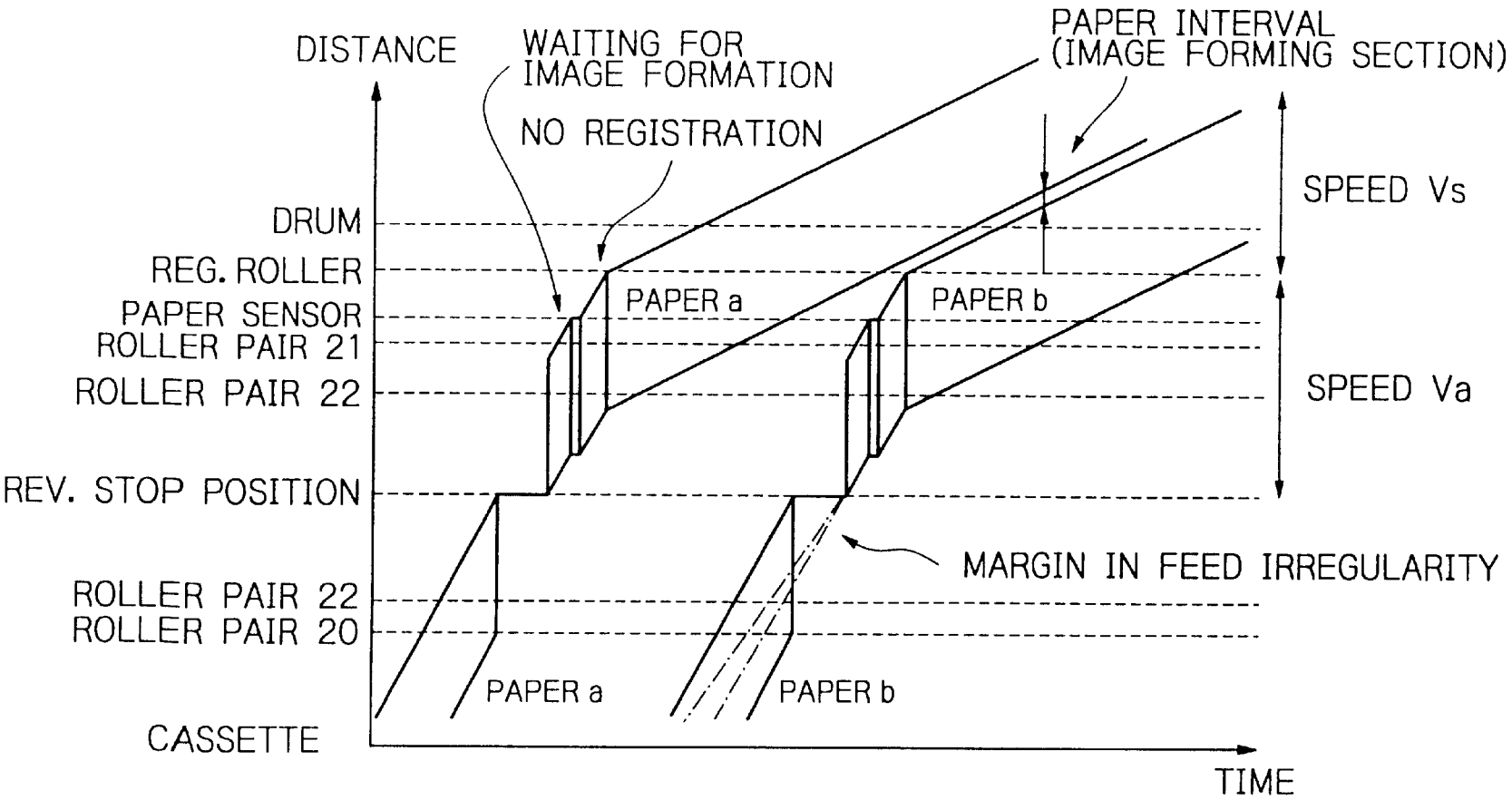
FIG. 34 is a diagram showing a paper conveying operation available with the eighth embodiment.

In light of the above, as shown in FIG. 34, the illustrative embodiment causes the registration roller pair 24 to constantly rotate without performing the registering operation. In addition, paying attention to the fact that the paper conveyance after the switchback path 17 can be effected independently of the paper conveyance before the same, the illustrative embodiment stops the paper conveyance for a moment after the paper sensor 42 has sensed the leading edge of the paper sheet 3, and waits for the end of image formation. The illustrative embodiment therefore successfully solves the above-described problem. The duration of the temporary stop may even be zero if image formation completes before the arrival of the paper sheet 3 at the stop position.

As stated above, the illustrative embodiment, omitted the conventional registration operation, makes it needless to stop and again drive the registration roller pair 24 rapidly at timings corresponding to the interval between successive paper sheets 3. This obviates the need for independent drive using a stepping motor or an exclusive clutch and thereby makes the apparatus 1 compact while reducing the product ion cost. Further, because the interval between paper sheets 3 does not increase at all despite the temporary stop of the paper sheet 3, it is possible to further reduce the above interval and therefore to enhance productivity.

Moreover, the paper sheet 3 is brought to a stop after it has been nipped by the roller pair 21. Therefore, even when the preceding paper sheet a waits for image formation over a long period of time, the following paper b can be independently conveyed as far as the reversal stop position without being effected by the roller pair 22. This simplifies control over the paper conveyance.

Ninth Embodiment

Figure 35:
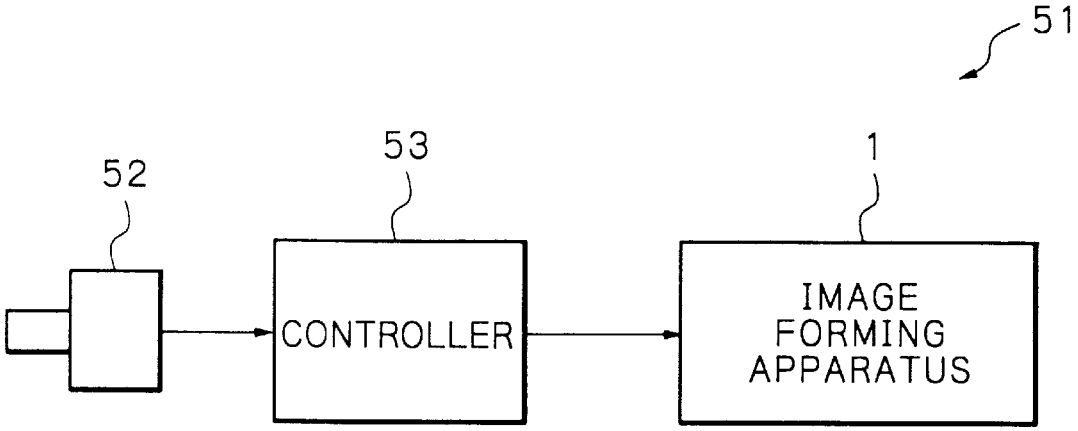
FIG. 35 is a view showing a ninth embodiment of the image forming apparatus in accordance with the present invention.

FIG. 35 schematically shows a printer 51 representative of a ninth embodiment of the present invention. As shown, the printer 51 includes the image forming apparatus 1 of any one of the foregoing embodiments, an input terminal 52 for receiving image data, and a controller 53 for causing the apparatus 1 to form an image on the paper sheet 3 in accordance with the image data.

Tenth Embodiment

Figure 36:
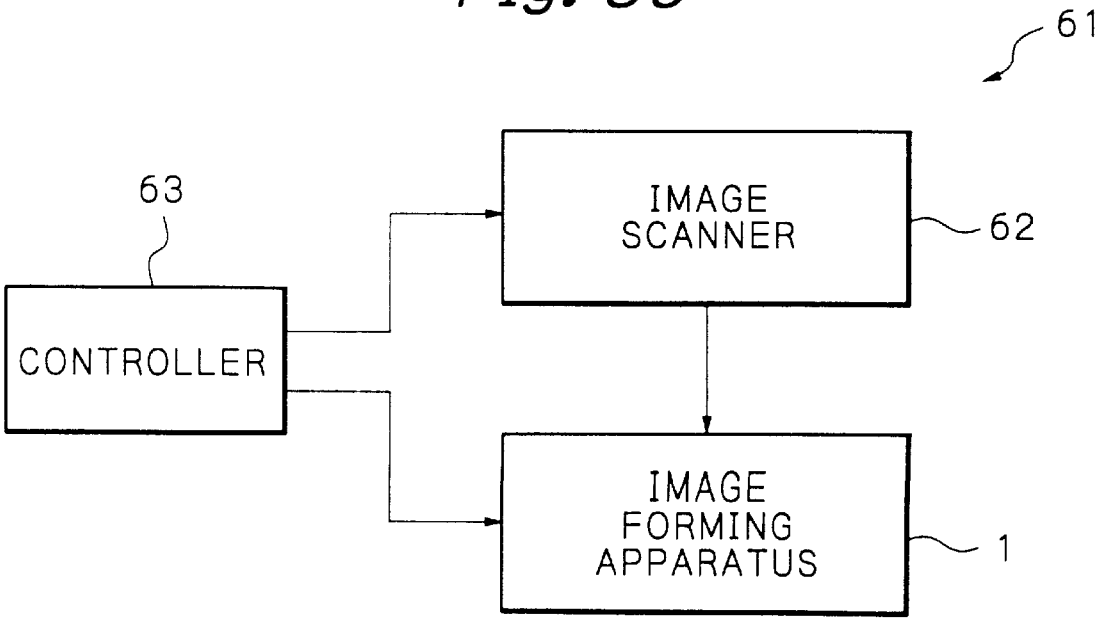
FIG. 36 is a view showing a tenth embodiment of the image forming apparatus in accordance with the present invention.

FIG. 36 schematically shows a copier 61 representative of a tenth embodiment of the present Invention. As shown, the copier 61 includes the image forming apparatus 1 of any one of the foregoing embodiments, an image scanner 62, and a controller 63 for causing the apparatus 1 to form an image on the paper sheet 3 in accordance with image data output from the image scanner 62.

Eleventh Embodiment

Figure 37:
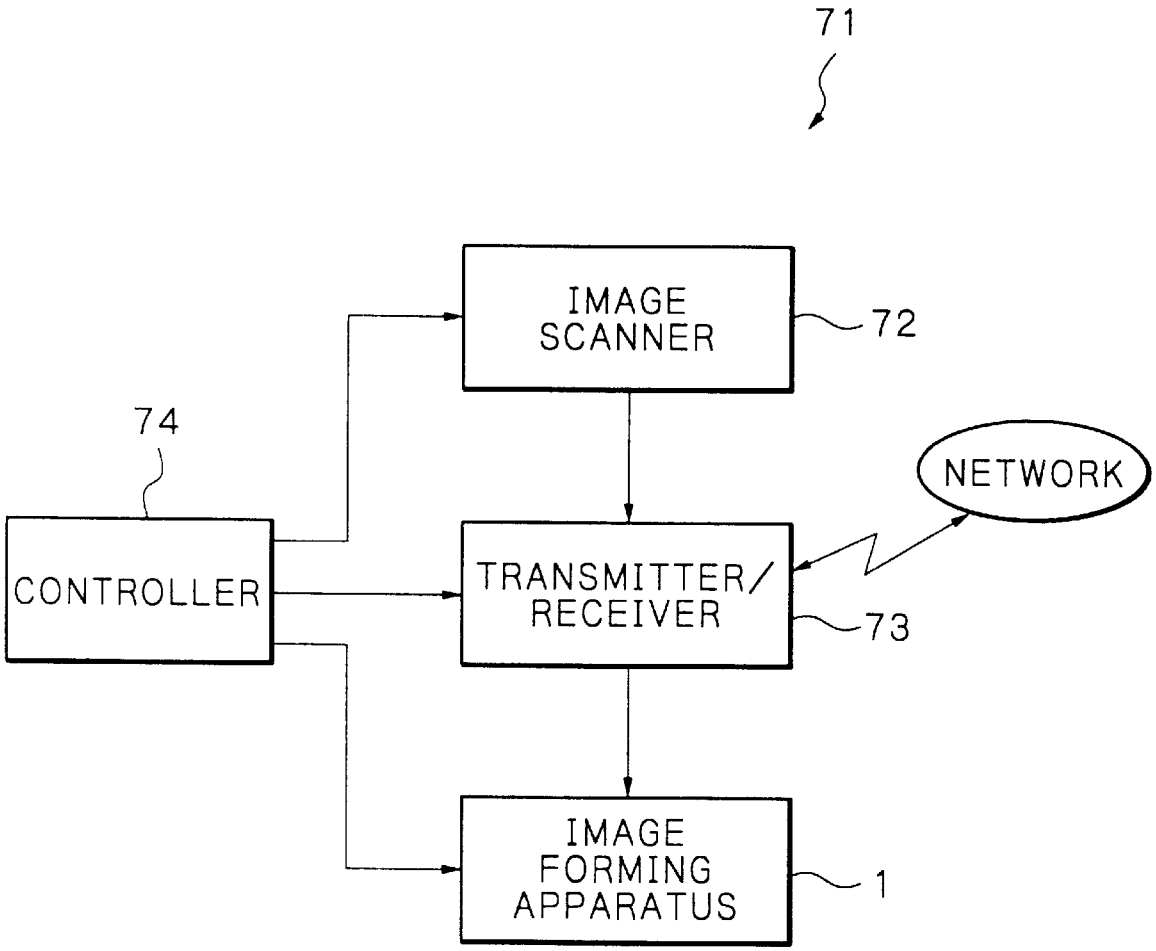
FIG. 37 is a view showing an eleventh embodiment of the image forming apparatus in accordance with the present invention.

FIG. 37 schematically shows a facsimile apparatus 71 representative of an eleventh embodiment of the present invention. As shown, the facsimile apparatus 71 includes the image forming apparatus 1 of any one of the foregoing embodiments, an image scanner 72, a transmitter/receiver 73 for interchanging image data with a remote station via a network, not shown, and a controller 74. By controlling the image scanner 72, apparatus 1 and transmitter/receiver 73, the controller 74 causes image data read out of a document by the image scanner 72 to be sent to a remote station via the transmitter/receiver 73 and network or causes the apparatus 1 to form an image on the paper sheet 3 in accordance with image data received from a remote station via the network and transmitter/receiver 73.

Twelfth Embodiment

Figure 38:
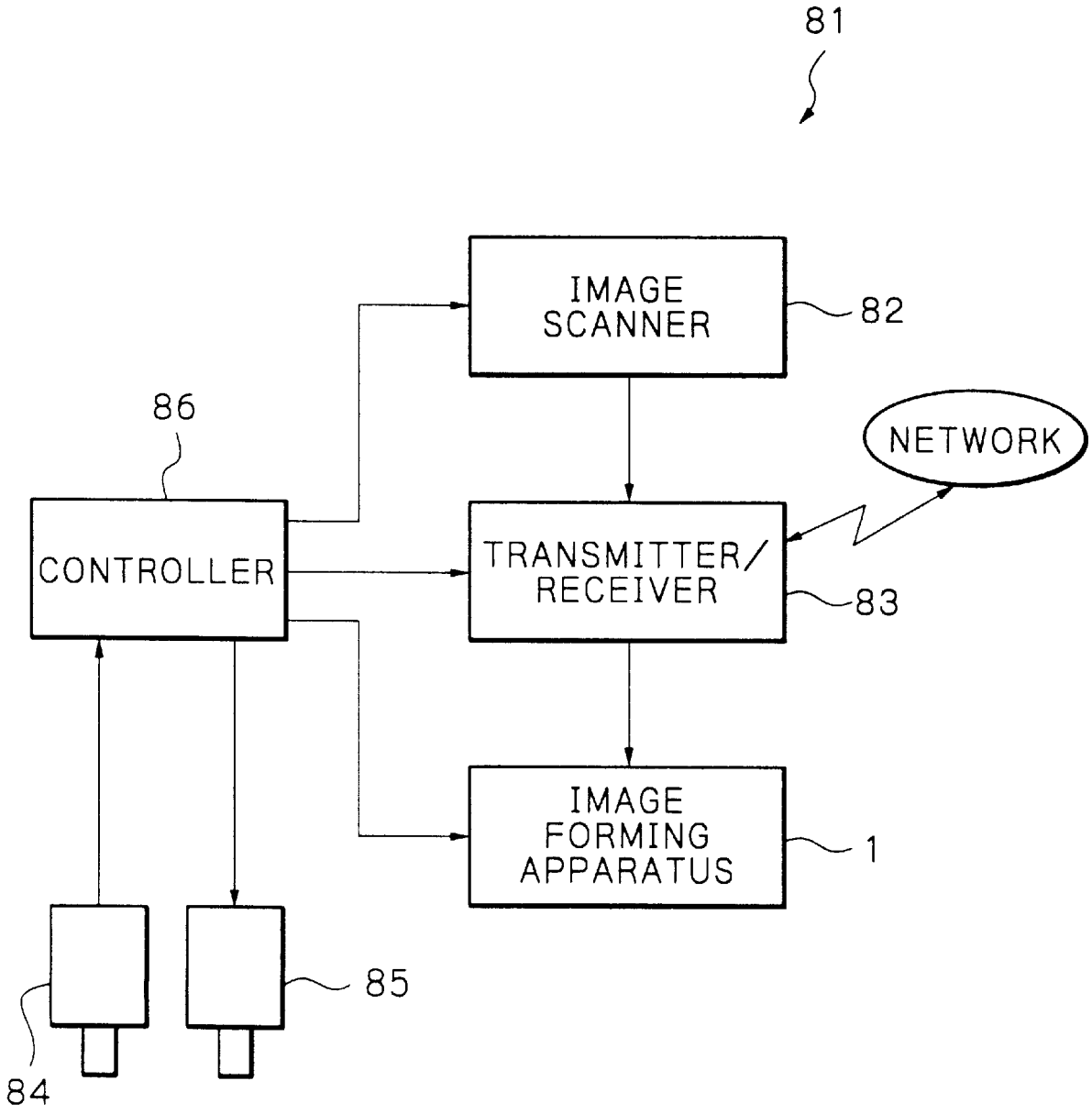
FIG. 38 is a view showing a twelfth embodiment of the image it forming apparatus in accordance with the present invention.

FIG. 38 schematically shows a multiplex machine 81 representative of a twelfth embodiment of the present invention. As shown, the multiplex machine 81 includes the image forming apparatus 1 of any one of the foregoing embodiments. an image scanner 82, a transmitter/receiver 83 for interchanging image data with a remote station via a network 90, an input terminal 84 for receiving image data, an output terminal 85 for outputting image data, and a controller 86. By controlling the apparatus 1 and transmitter/receiver 83, the controller 86 causes the apparatus 1 to form an image in accordance with image data input to the input terminal 84. Also, the controller 86 delivers image data read out of a docwument by the image scanner 82 to the outside via the output terminal 85. Further, the controller 86 causes image data read out by the image scanner 82 to be sent via the transmitter/receiver 83 and network 90 or causes the apparatus to form an image on the paper sheet 3 in accordance with image data received via the network 90 and transmitter/receiver 83.

While the foregoing embodiments have concentrated on the printer engine 2 using an electrophotographic system, the printer engine may be implemented by any other suitable printing system, e.g., an ink jet printing system.

The first to twelfth embodiments shown and described achieve various unprecedented advantages, as enumerated below.

(1) A paper sheet is received in a temporary paper storage for a moment. The temporary paper storage absorbs irregularity in the position of the leading edge of a paper sheet paid out from a paper stack. It is therefore possible to reduce the interval between successive paper sheets to be fed toward a printer engine without any transient acceleration of the paper sheets, thereby enhancing productivity as to image formation. The paper sheet can be stably conveyed despite that it is conveyed at a particular speed on each of transport paths preceding and following the temporary paper storage.

(2) The interval between successive paper sheets can be further reduced without the paper conveying speed being increased on the transport path adjoining the printer engine.

(3) It is not necessary to temporally stop the operation of the entire paper feeder even when a registering operation is affected at a position short of the printer engine. This also contributes to stable paper conveyance.

(4) The paper sheet can be stopped, reversed in the direction of conveyance and then conveyed at a different speed while being nipped by a roller pair. The paper feeder therefore does not need any speed control and therefore reduces the production cost of an image forming apparatus.

(5) A paper sheet leaving the temporary paper storage toward the transport path and a paper sheet entering the paper storage from the transport path can exist together in the paper storage while overlapping each other. This further reduces the interval between successive paper sheets and thereby further enhances productivity.

(6) A single sensor is capable of sensing the leading edge of the paper sheet entering the temporary paper storage and the leading edge of the paper sheet leaving the temporary paper storage. This is also successful to reduce the production cost of the apparatus.

(7) A registration sensor customarily used to set up a registration timing is not necessary. This is also successful to reduce the production cost of the apparatus.

(8) The paper sheet leaving the temporary paper storage toward the printer engine can be conveyed at a speed higher than a conveying speed assigned to the printer engine for image formation. It is therefore possible to reduce the interval between successive paper sheets and therefore to reduce the wear of the printer engine ascribable to an increase in the above interval. The apparatus therefore achieves accurate paper conveyance and high productivity.

(9) A paper reversing device conveys the paper sheet fed from the paper feeder to the transport path to a registration roller pair at a higher speed than the registration roller pair conveys it to the printer engine. It is therefore possible to reduce the interval between successive paper sheets and therefore to reduce the wear of the printer engine ascribable to an increase in the above interval. The apparatus therefore achieves accurate paper conveyance and high productivity.

(10) The degree of the speed at which the paper sheet is conveyed to the printer engine is variable to control the interval between successive paper sheets. It is therefore possible to reduce the wear of the printer engine ascribable to an increase in the above interval. The apparatus therefore achieves accurate paper conveyance and high productivity.

(11) A period of time over which the paper sheet is conveyed at the speed higher than the conveying speed assigned to the printer engine is variable to control the interval between successive paper sheets. It is therefore possible to reduce the wear of the printer engine ascribable to an increase in the above interval. The apparatus therefore achieves accurate paper conveyance and high productivity.

(12) The conveying speed of the paper sheet delivered to the transport path by the paper reversing device is increased on the basis of an interval between the time when the paper sheets begins to be delivered and the time when a paper sensor senses the paper sheet. It is therefore possible to reduce the interval between successive paper sheets and therefore to reduce the wear of the printer engine ascribable to an increase in the above interval. The apparatus therefore achieves accurate paper conveyance and high productivity.

(13) To maintain the interval between a preceding paper sheet and a following paper sheet substantially constant, the conveying speed of the following paper sheet is increased on the basis of an interval between the time when the trailing edge of the preceding paper sheet is sensed and the time when the leading edge of the following paper sheet is sensed. Therefore, even when the paper sheet has a substantial dimensional error in the direction of conveyance, it is possible to reduce the interval between successive paper sheets and therefore to reduce the wear of the printer engine ascribable to an increase in the above interval. The apparatus therefore achieves accurate paper conveyance and high productivity.

(14) The paper sheet is temporarily stopped at a preselected position on the transport path on the basis of the interval between the time when the paper sheets begins to be delivered by the paper reversing device and the time when the paper sensor senses the paper sheet. It is therefore possible to reduce the interval between successive paper sheets without increasing the number or parts or obstructing the paper conveyance of the paper feeder and therefore to reduce the wear of the printer engine ascribable to an increase in the above interval. The apparatus therefore achieves accurate paper conveyance and high productivity.

(15) The paper sheet delivered to the transport path by the paper reversing device is brought to a temporary stop on abutting against the registration roller pair. Therefore, when the conveyance of the paper sheet is resumed, the paper sheet can be conveyed to the printer engine rapidly and accurately. The apparatus therefore achieves accurate paper conveyance and high productivity.

(16) Although the interval between successive paper sheets may be irregular due to switchback effected in the temporary paper storage, speed control means corrects the irregularity by controlling the paper conveying speed. This is successful to further reduce the above interval. Further, the interval can be accurately maintained by a roller pair corresponding to the conventional registration roller and continuously driven, obviating the need for the registering operation.

(17) The paper conveying speed is controlled in terms of the duration of the stop of the paper sheet, obviating the need for sophisticated calculations of a speed and the duration of a speed change.

(18) The foregoing advantages (1) through (17) are achievable with any one of an electrophotographic image forming apparatus, a digital electrophotographic image forming apparatus, a printer, a copier, a facsimile apparatus, and a multiplex machine.

Thirteenth Embodiment

Figure 39:
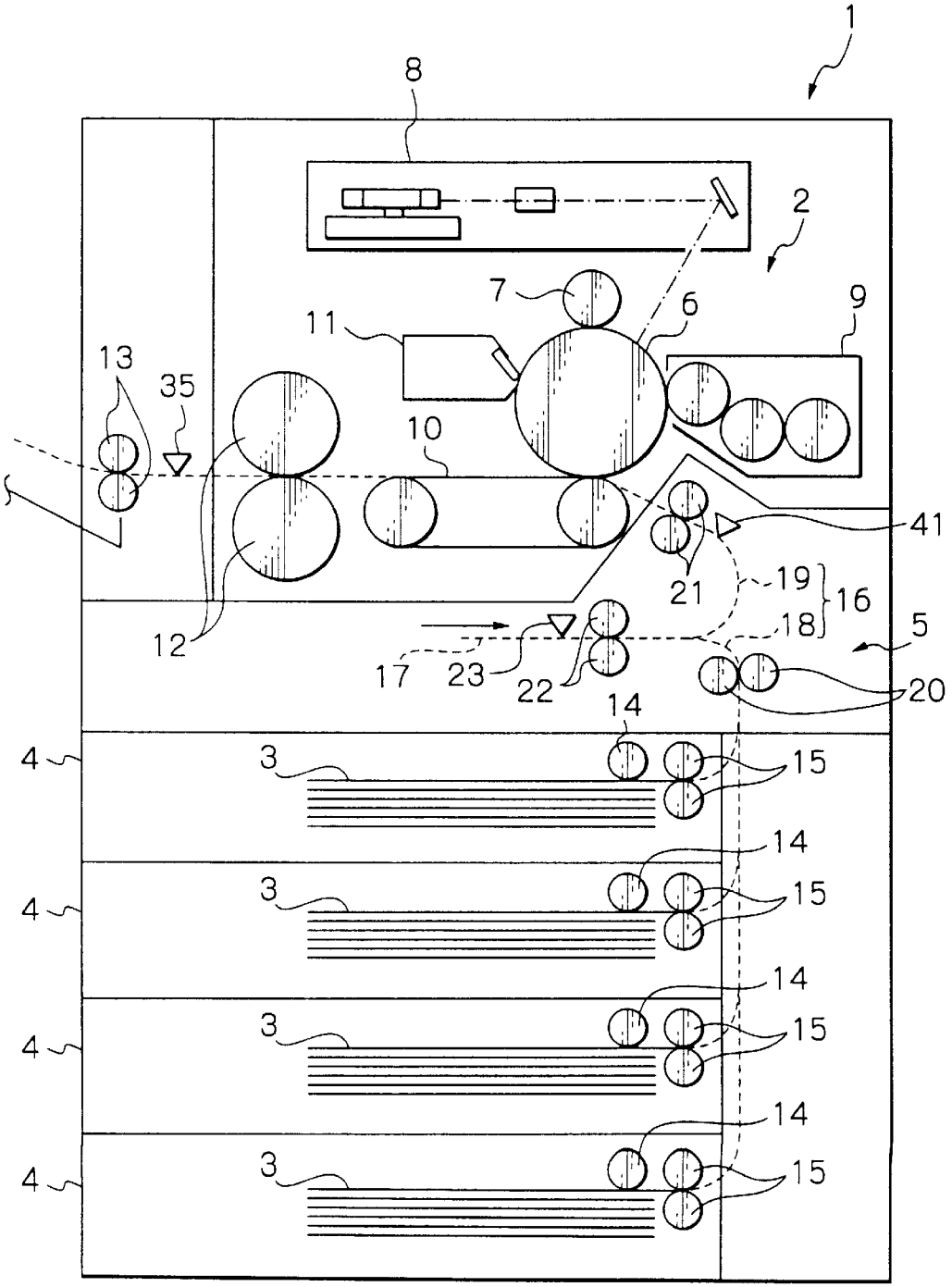
FIG. 39 is a view showing a thirteenth embodiment of the image forming apparatus in accordance with the present invention.

Referring to FIG. 39, a thirteenth embodiment of the present invention will be described. Structural elements identical with the structural elements of the first to twelfth embodiments are designated by identical reference numerals, and a detailed description thereof will not be made in order to avoid redundancy. As shown, the paper cassette 4 included in the image forming apparatus 1 has a front-loading configuration and made up of four cassettes 4 arranged one above the other. The cassettes 4 each can be pulled out toward the operator in order to replenish the paper sheets 3. A jam sensor 35 responsive to the paper sheet 3 is located on the path extending between the fixing unit 12 and the outlet roller pair 13.

Figure 40:
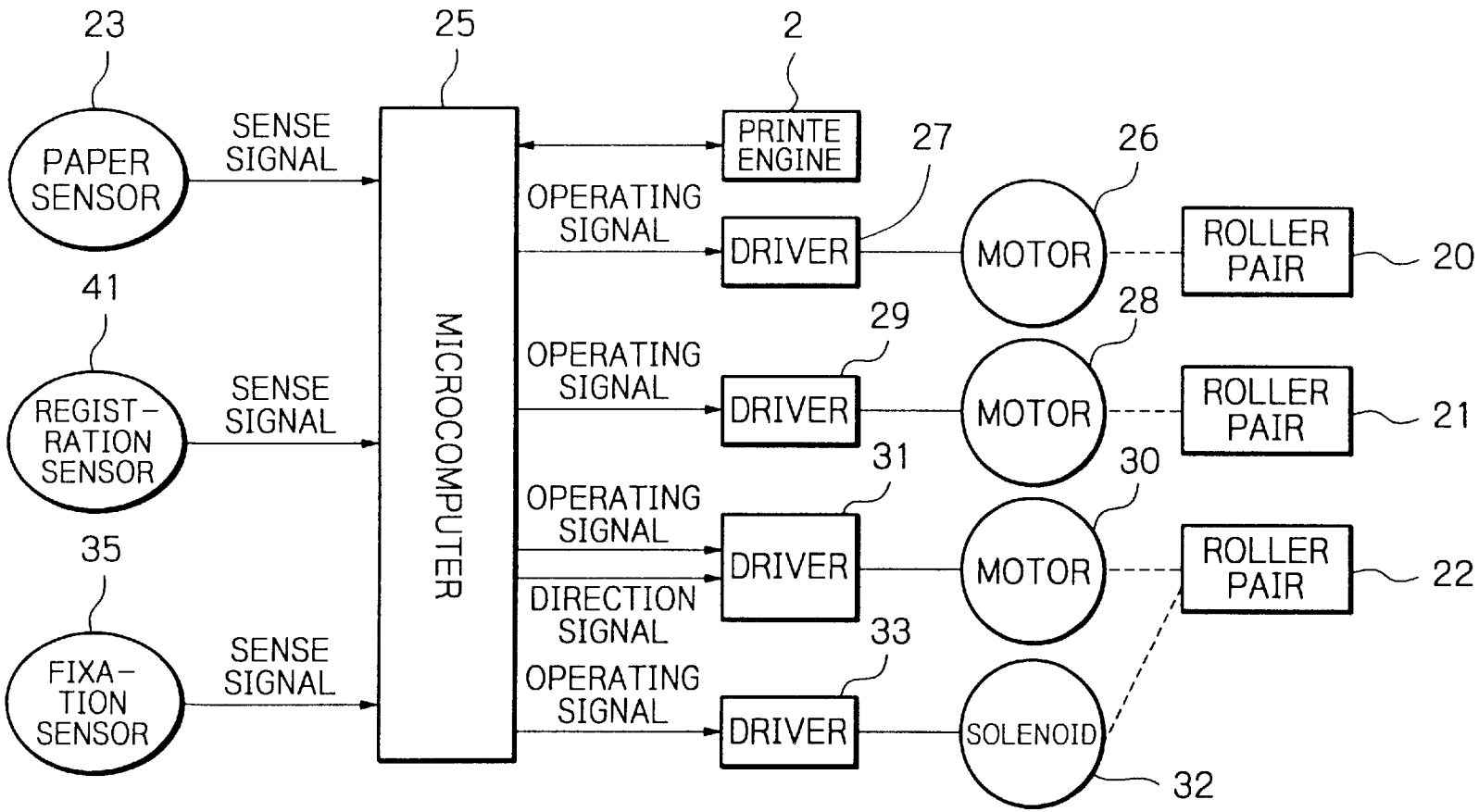
FIG. 40 is a block diagram schematically showing a control system included in the thirteenth embodiment.

FIG. 40 shows a control system particular to the illustrative embodiment. As shown, the printer engine 2 and jam sensor 35, as welt as various actuators and sensors, not shown, are connected to the microcomputer 25.

The apparatus 1 does not include a registration roller pair conventionally located in the vicinity of the printer engine 2. In the illustrative embodiment, the roller pair 21 plays the role of a registration roller pair at the same time. The registration roller pair 21 has a nip configuration capable of correcting the skew of the leading edge of the paper sheet 3 and performing the registering operation. This arrangement obviates the need for a registration roller pair and parts necessary for driving it and thereby reduces the overall size and production cost of the apparatus 1.

The registration sensor 41 is located at a position short of the roller pair 21 on the transport path 19. After the registration sensor 41 has sensed the leading edge of the paper sheet 3, the roller pair 22 stops conveying the paper sheet 3 on the elapse of a preselected period of time. As a result, the leading edge of the paper sheet 3 abuts against the roller pair 21 and is registered thereby. At this instant, the paper 3 is still nipped by the roller pair 22. It is therefore necessary to start feeding the paper sheet 3 such that the leading edge of the following paper sheet 3 does not reach the roller pair 22 until the end of the above registering operation. In this manner, the roller pairs 21 and 22 effect registration in place of the conventional registration roller pair, reducing the production cost of the apparatus 1.

Figure 41:
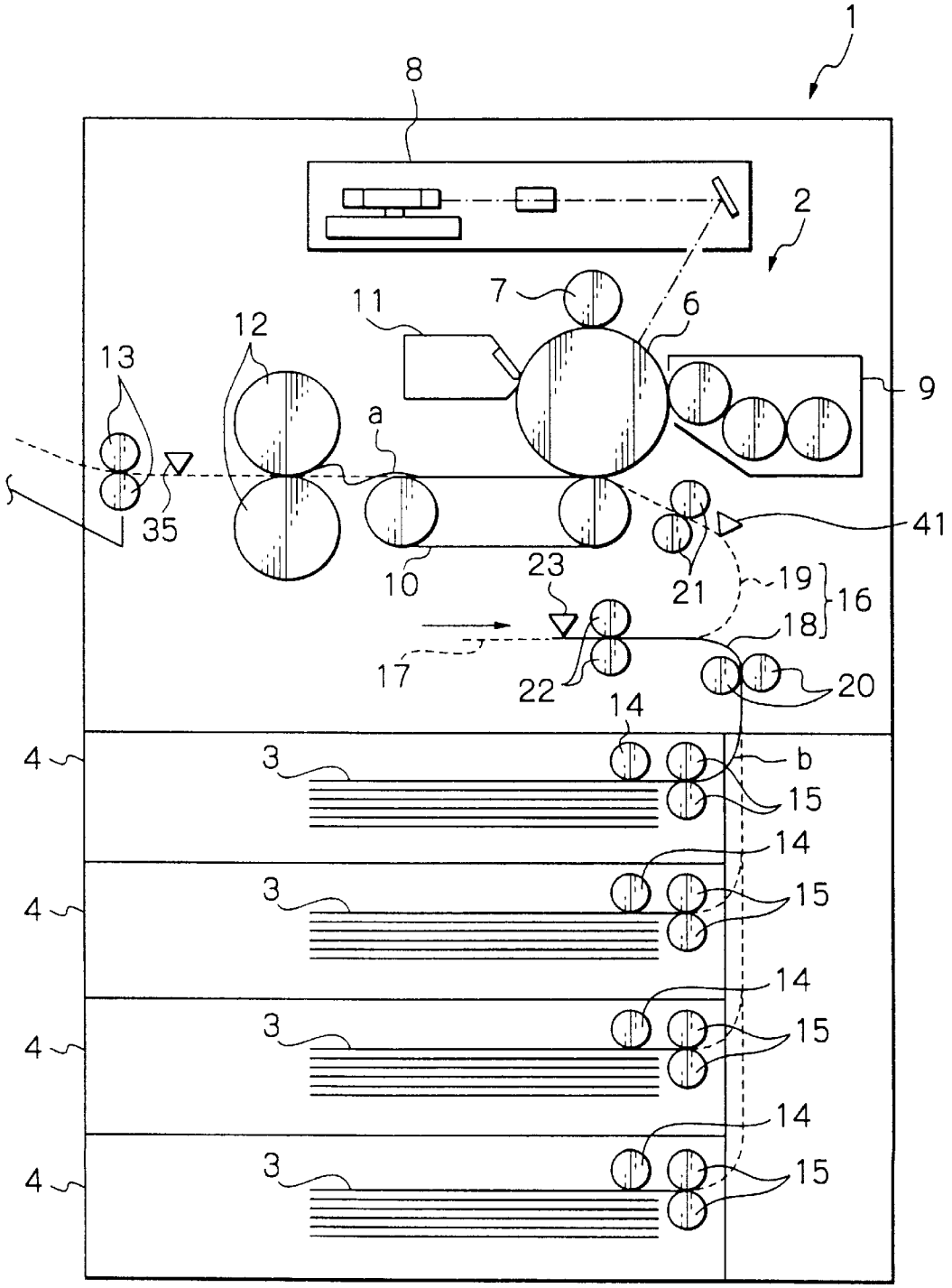
FIGS. 41 through 49 are views demonstrating the operation of the thirteenth embodiment.

As shown in FIG. 41, assume that the leading edge of the preceding paper a has failed to enter the fixing unit 12 and jammed the path short of the fixing unit 12. Then, the jam sensor 35 does not sense the leading edge of the paper sheet a in a preselected period of time and thereby detects the jam. At this instant, the following paper sheet b is being conveyed from any one of the cassettes 4 to the switchback path 17, as illustrated.

It has been customary with an image forming apparatus to interrupt paper conveyance immediately after a jam has been sensed in order to prevent the jam from being aggravated. This brings about a problem shown in FIG. 42 specifically. As shown, when the operator inadvertently pulls out the cassette 4 in order to remove the jamming paper sheet 3, the paper sheet 3 restricted by side fences 36, which are mounted on the cassette 4, and the separator roller pair 15 tears in its widthwise direction. The torn paper sheet 3 stops and damages a mechanisms for pulling out the cassette 4 as well as the separator roller pair 15. Further, the pieces of the torn paper sheet 3 remain in the vicinity of the separator roller pair 15 and cause another jam to occur when the apparatus again starts operating. To solve this problem, it is a common practice to construct the apparatus such that the operator can uncover the transport path 16 at the right-hand side of the apparatus, as seen in FIG. 41. This allows the operator to remove the jamming paper sheet 3 without tearing it. Such a configuration, however, forces the operator to remove the jamming paper sheet 3 in a low position at the right-hand side of the apparatus while avoiding articles around the apparatus, resulting in inefficient operation.

Figure 42:
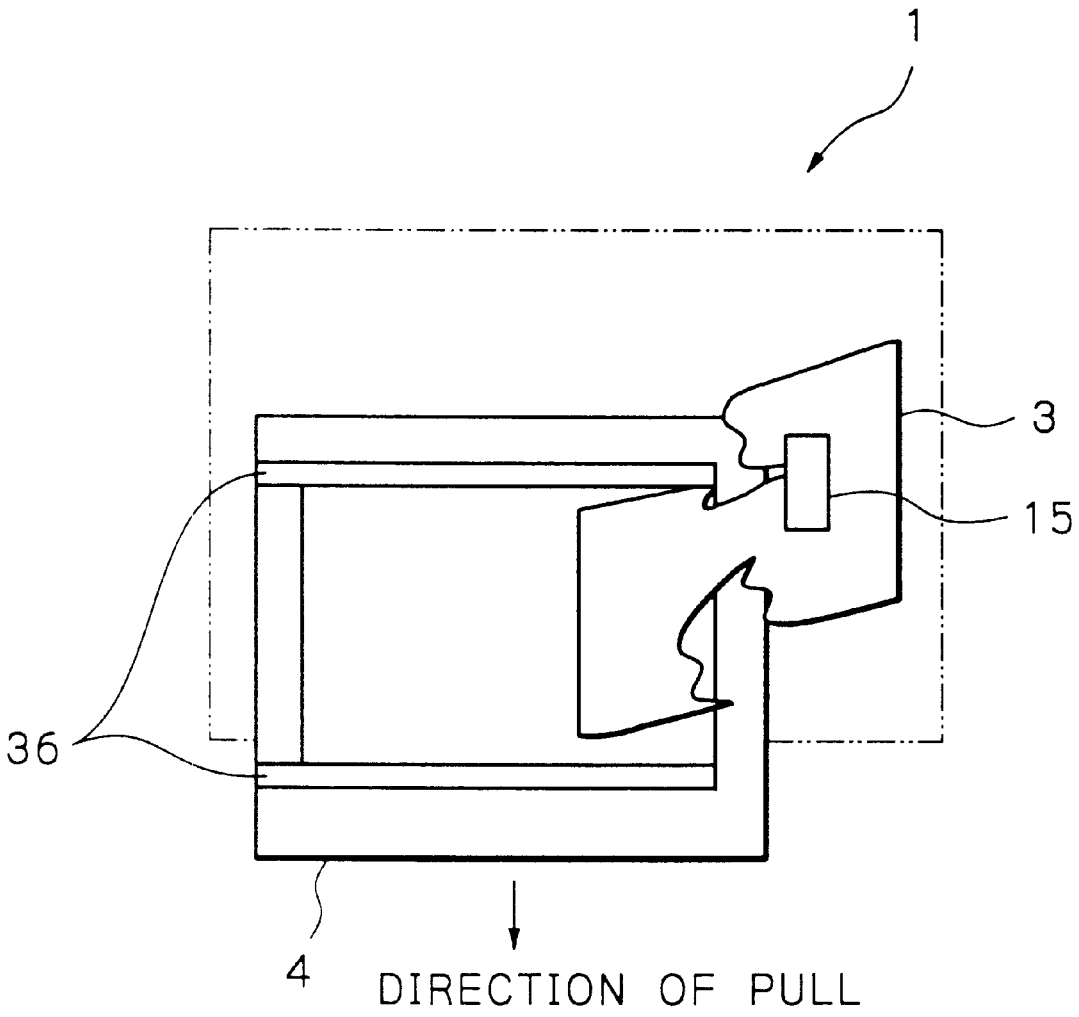
Figure 43:
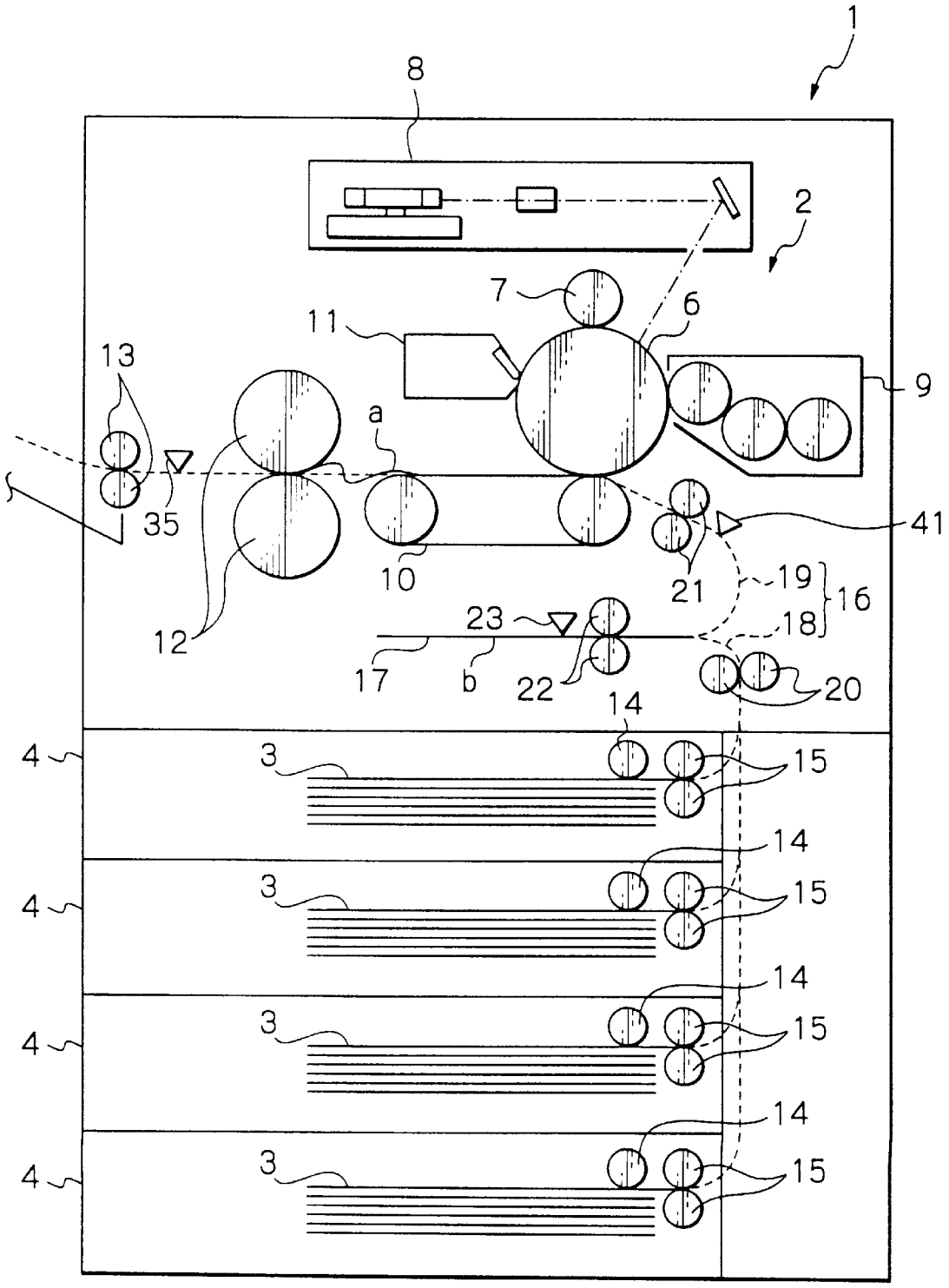

In the illustrative embodiment, when the jam sensor 35 senses the jam described above, the microcomputer 25 stops driving the motors 28 and 30 and interrupts the operation of the apparatus 1 immediately. This implements operation stopping means. At this instant, the roller pairs 20 and 22 and separator roller pair 15 are continuously rotated until the paper sheet b has been received in the switchback path 17. When the paper sensor 23 senses the paper sheet b, the roller pairs 20 and 22 and separator roller pair 15 are caused to stop rotating, as shown in FIG. 42.

In the above-described apparatus 1, when the preceding paper sheet a jams the path, the operator can pull out the cassette 4 and remove the paper sheet a without any trouble. Further, because the operator can deal with the jamming paper sheet a at the center of the apparatus 1, the operation is easy to perform as to the position. In addition, in an apparatus of the type including the switchback path 17 for reducing the interval between successive paper sheets 3, the easy operation is achievable without resorting to additional parts that would increase the cost and size of the apparatus.

Figure 44:
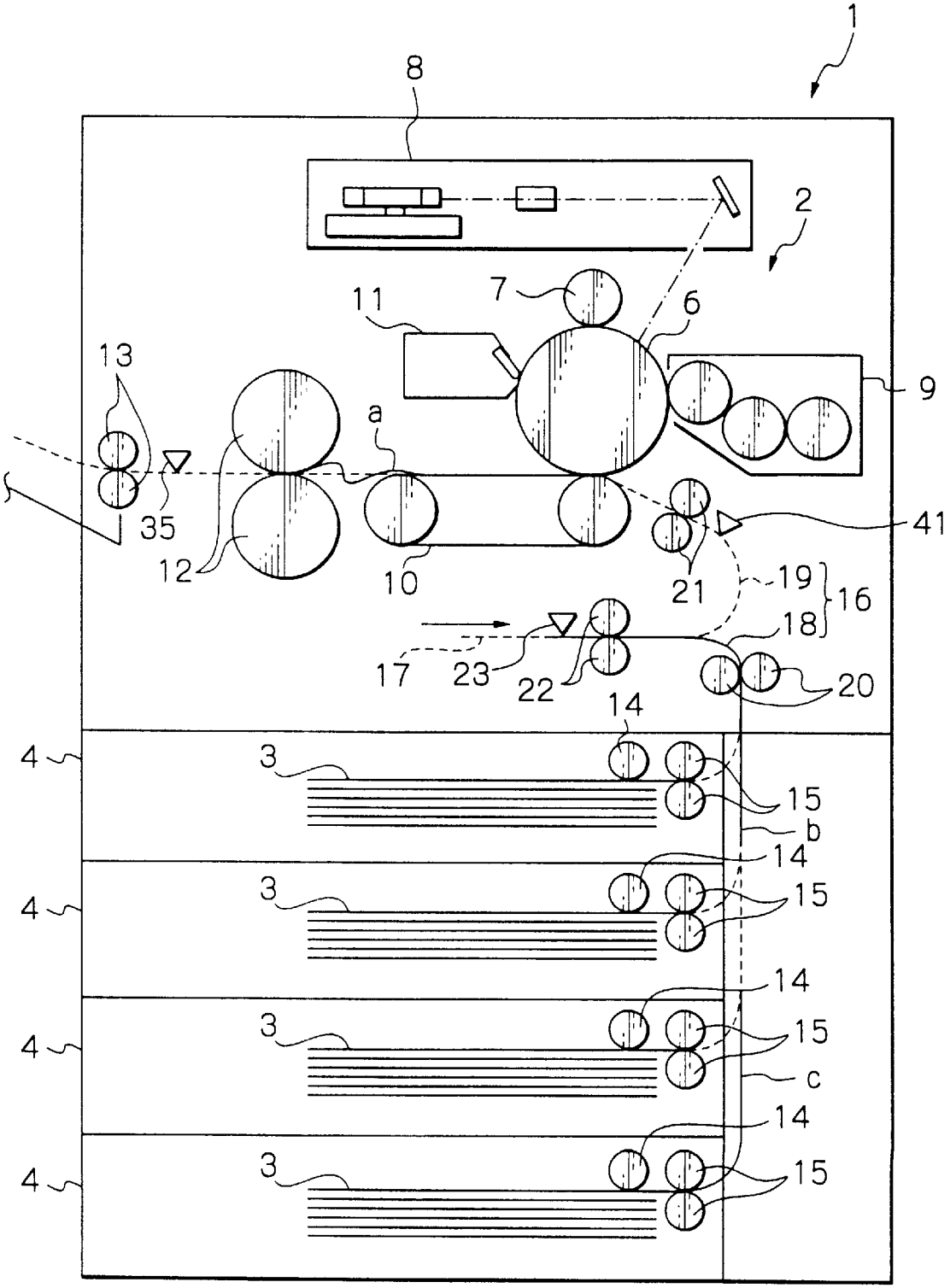

As shown in FIG. 44, assume that paper sheets 3 are being sequentially fed from the bottom cassette 4 when the jam sensor 35 senses the jam. Then, two paper sheets b and c exist on the transport path 18 extending to the switchback path 17 because the transport path 18 is long. In this case, the solenoid 32 releases the rollers 22 from each other. The paper sheet b is conveyed into the switchback path 17, and then the paper sheet c is conveyed into the switchback path 17. As a result, the paper sheet c moves into the switchback path 17 while contacting the lower surface of the paper sheet b.

Figure 45:
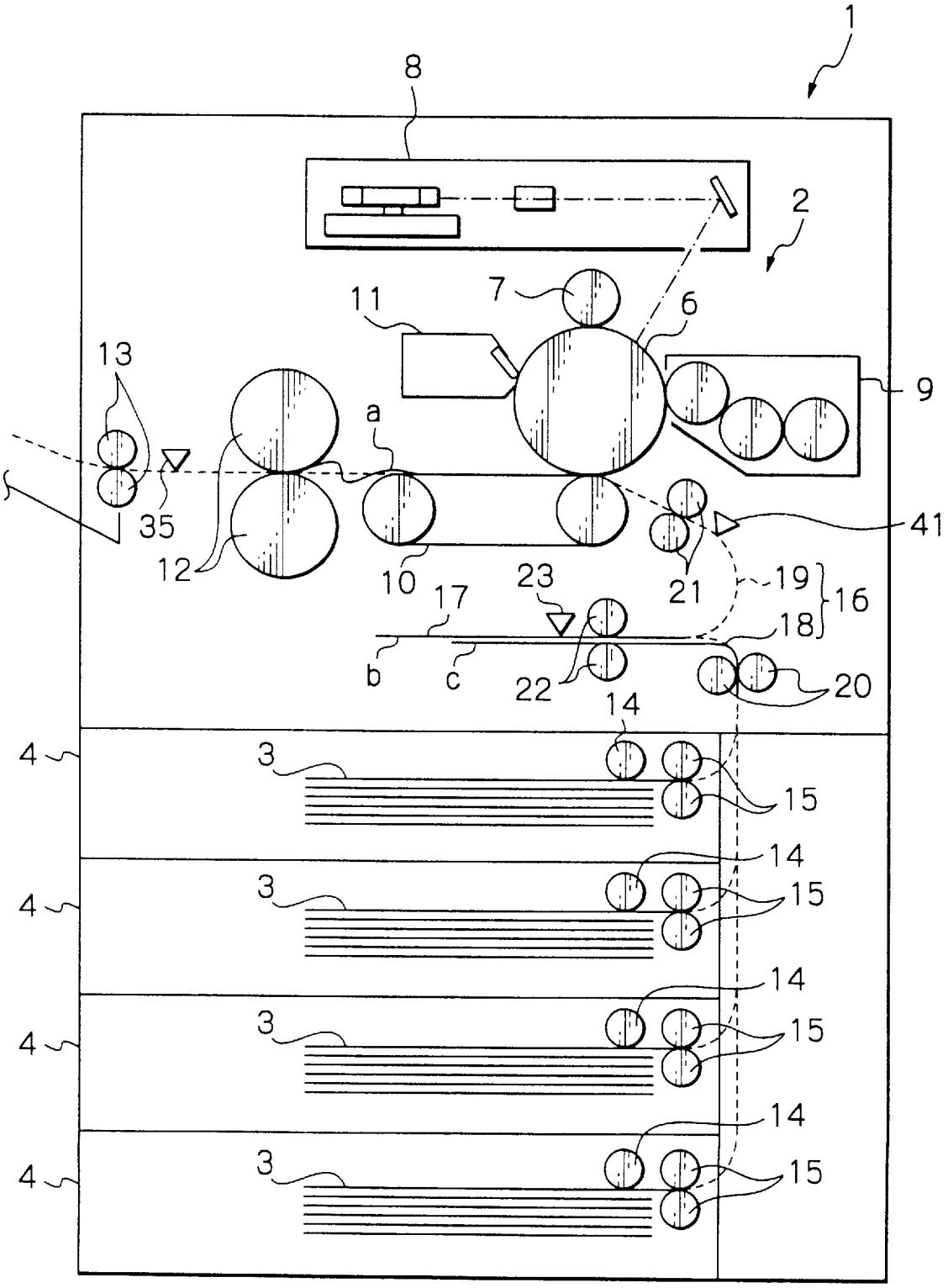

More specifically, when the trailing edge of the preceding paper sheet b moves away from the roller pair 20, it springs up to a horizontal position due to its stiffness and serves to guide the leading edge of the following paper sheet c in a direction suitable for stacking. Consequently, the paper sheets b and c are conveyed while overlapping each other without any conflict, as shown in FIG. 45.

As stated above, the switchback path 17 is capable of receiving a plurality of paper sheets 3. The paper conveyance is interrupted after both of the paper sheets b and c being conveyed from the bottom cassette 4 to the switchback path 17 have been fully received in the path 17. The paper sheets b and c can therefore be surely conveyed to the switchback path 17 despite the long transport path extending from the bottom cassette 4. It follows that the operator can easily remove the jamming paper sheet by pulling out the cassette 4 without any trouble. The paper sheets b and c have heretofore been removed independently of each other. By contrast, the illustrative embodiment stacks the paper sheets b and c and allows the operator to remove them together.

Figure 46:
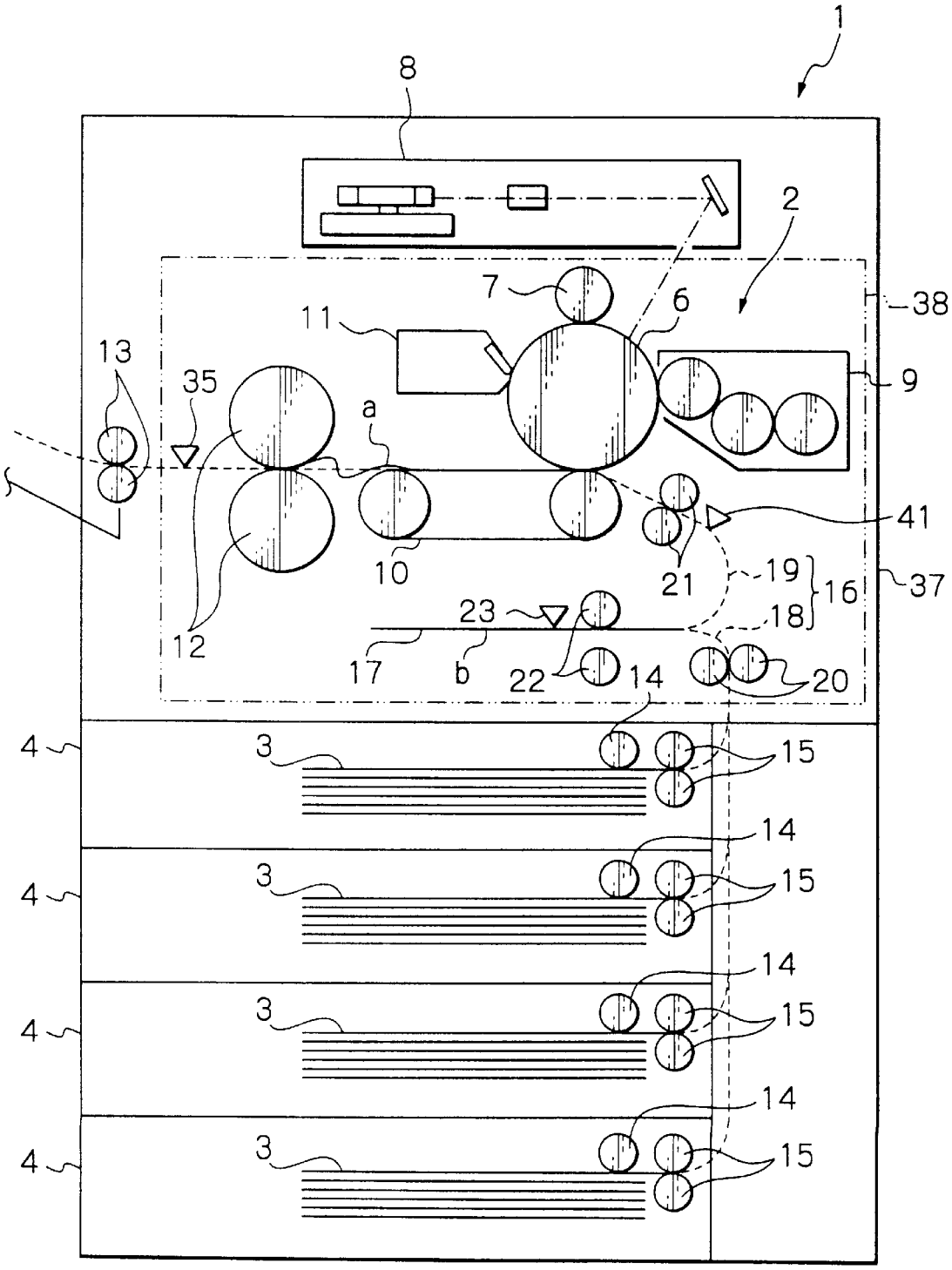

As shown in FIG. 46, the apparatus 1 includes a door 38 openably mounted on-the front thereof. The door 38 covers the printer engine 2 and switchback path 17 when closed or uncovers them when opened. By opening the door 38, the operator can easily remove the paper sheet b from the switchback path 17 and remove the jamming paper sheet a from the printer engine 2 at the same time.

Figure 47:
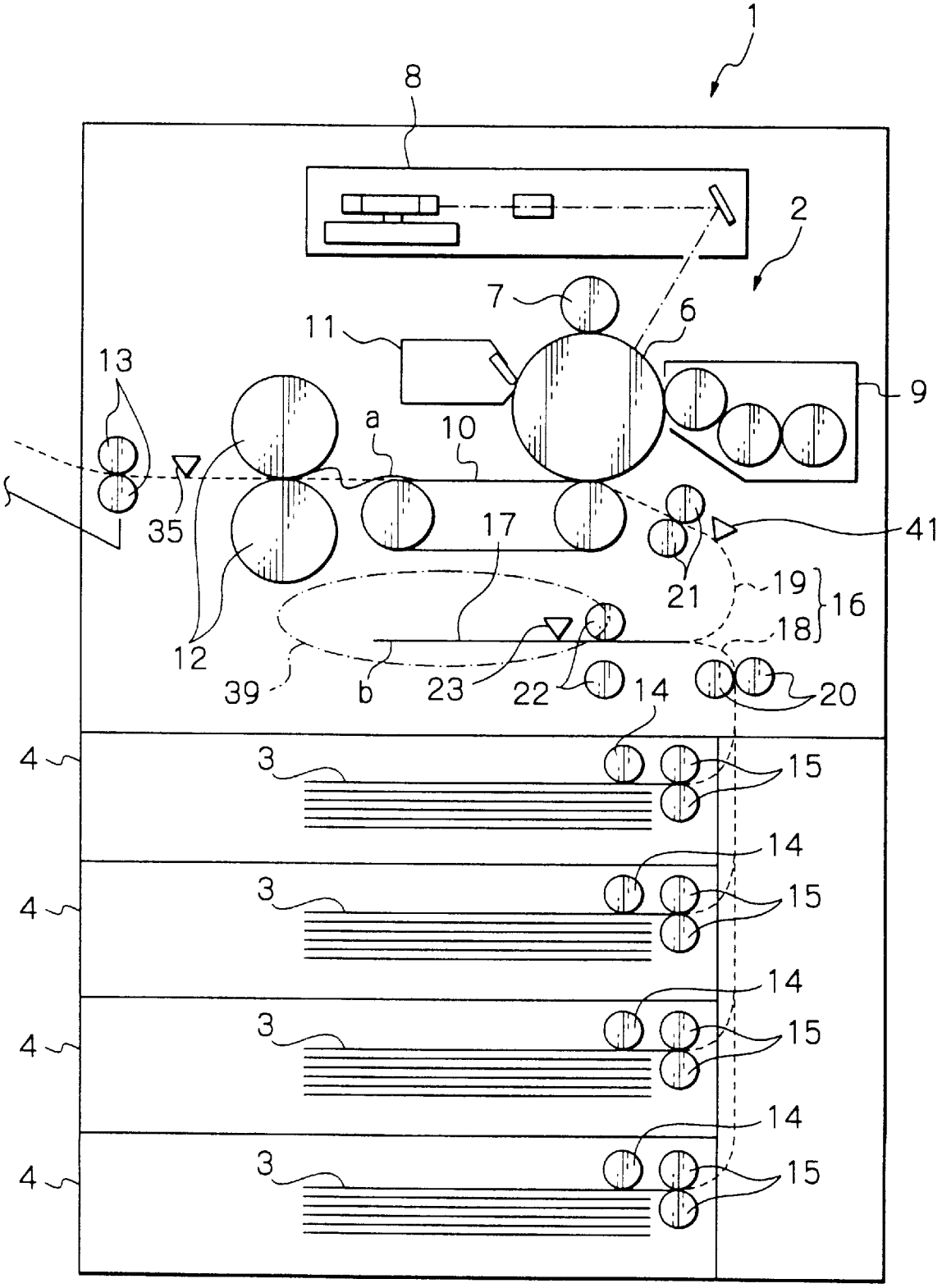
Figure 48:
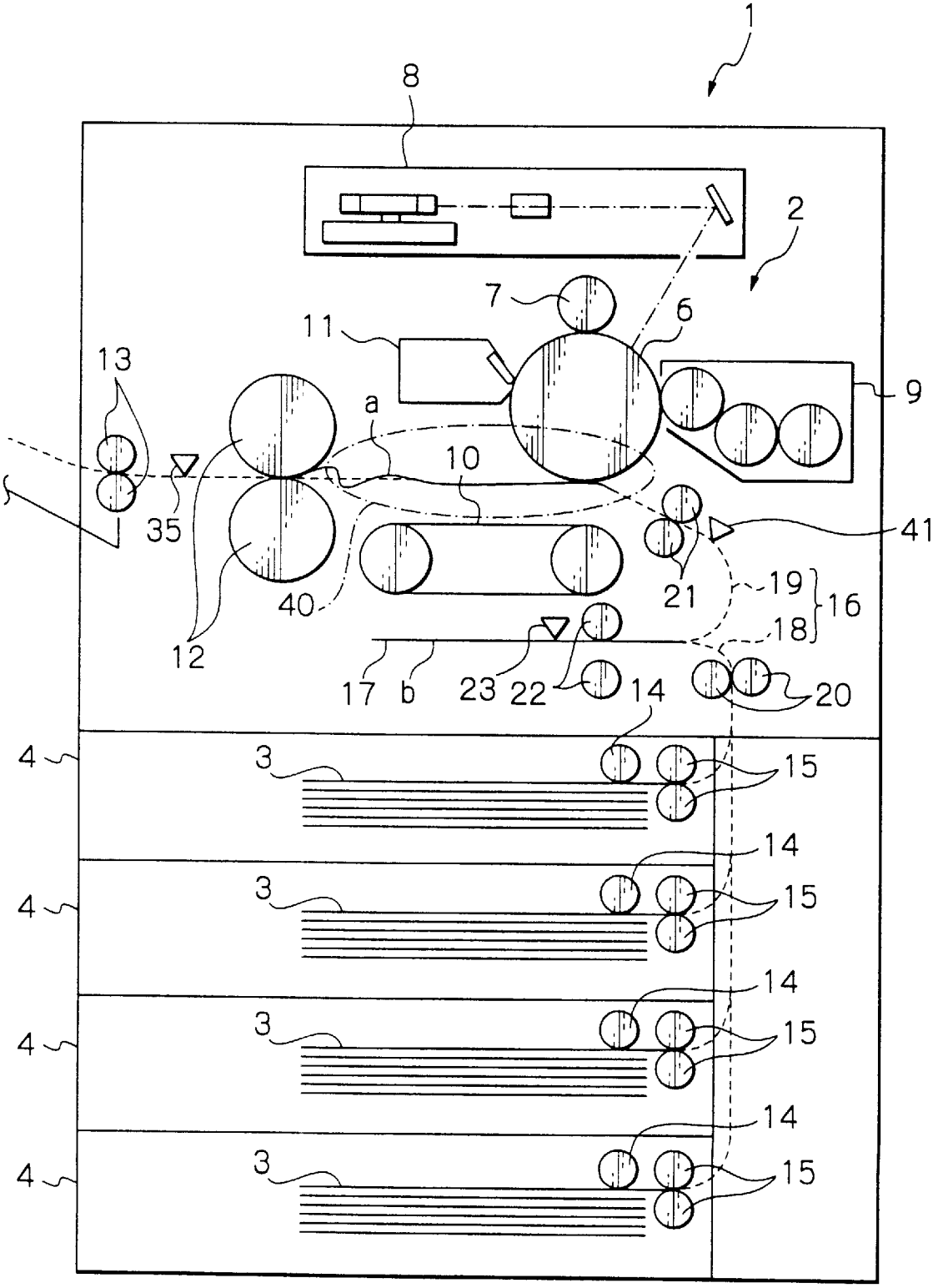

As shown in FIG. 47, the printer engine 2 including a horizontal transport path and the horizontal switchback path 17 are positioned one above the other while forming a space 39 therebetween. The operator can remove the paper sheet b from the switchback path 17 by inserting the operator's hand into the space 39, as shown in FIG. 47. As shown in FIG. 48, to remove the paper sheet a from the printer engine 2, the operator shifts part of the printer engine 2 (image transfer unit 10 in the illustrative embodiment) to the space 39 and then inserts the operator's hand into the resulting space 40. The paper sheets a and b can therefore be positioned close to each other. In addition, a broad space for dealing with a jam is available without increasing the overall size of the apparatus 1 and promotes easy removal of the jamming paper sheet.

Figure 49:
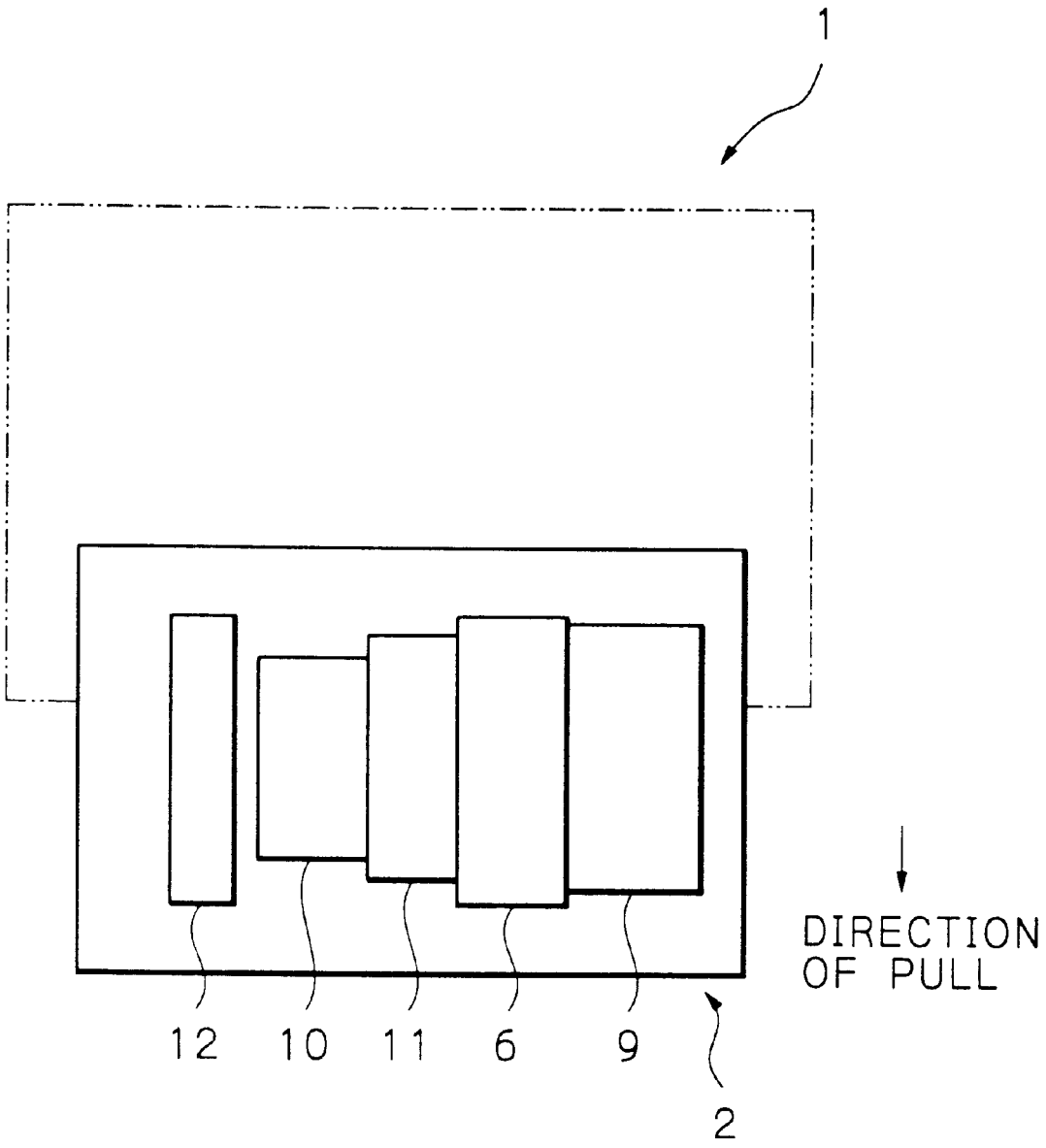

As shown in FIG. 49, the apparatus 1 is constructed such that the operator can pull out part of the printer engine 2 toward the operator. This kind of configuration is conventional. The illustrative embodiment, however, allows part of the printer engine 2 and the switchback path 17 to be pulled out integrally with each other. Therefore, even when the paper sheet 3 extends over both of the switchback path 17 and printer engine 2 at the time of a jam, the operator can pull out the printer engine 2 without tearing the paper sheet 3 in the widthwise direction. This successfully solves the previously stated problems. Moreover, because the paper sheet conveyed to the switchback path 17 is brought to a stop without fail at the time of a jam, there is no fear that a paper sheet extending over both of the cassette 2 and switchback path 17 tears.

The thirteenth embodiment described above achieves the following advantages.

(1) A temporary paper storage capable of temporarily storing a paper sheet absorbs irregularity in the position of the leading edge of a paper sheet fed from a paper stack. It is therefore possible to reduce the interval between successive paper sheets and enhance productivity without resorting to transient acceleration of paper conveyance.

(2) When a jam occurs on a transport path, a paper sheet being conveyed along part of the path extending to the temporary paper storage is received in the temporary paper storage without fail. Therefore, when the temporary paper storage is pulled out, no paper sheets are torn. This protects an image forming apparatus from damage or another jam.

(3) Even a plurality of paper sheets, which may exist on the path extending to the temporary paper storage, are surely received in the temporary paper storage. This is also successful to achieve the above advantage (2).

(4) By simply opening a single door, the operator can remove a paper sheet jamming a printer engine and a paper existing in the temporary paper storage at the same time. This promotes easy operation for dealing with a jam.

(5) A paper sheet jamming the printer engine and the paper sheet existing in the temporary paper storage are close to each other, further promoting easy operation for dealing with a jam.

(6) The operator can pull out the printer engine and temporary paper storage together and can therefore easily remove the paper sheet jamming the printer engine and the paper sheet existing in the temporary paper storage.

Various modifications will become possible for those skilled in the art after receiving the teachings of the present disclosure without departing from the scope thereof.

What is claimed is:

1. An image forming apparatus for single-sided operation comprising:

a printer engine for forming an image on a paper sheet;

a paper cassette loaded with a stack of paper sheets;

a paper feeder for feeding one of the paper sheets toward said printer engine at a time while separating the one paper sheet from the other paper sheets;

a temporary paper storage positioned on a transport path for temporarily storing the paper sheet fed from said paper cassette;

a roller separating mechanism for selectively causing rollers of a roller pair into or out of contact with each other; and a paper reversing device for positioning the paper sheet fed from said paper cassette in said temporary paper storage with a leading edge of said paper sheet at the head and then switching back said paper sheet toward said printer engine with a trailing edge of said paper sheet at the head;

wherein said paper feeder feeds the paper sheet at a particular speed on each of first part of the transport path extending between said paper cassette and said temporary paper storage and second part of said transport path extending between said temporary paper storage and said printer engine, said paper reversing device comprises said roller pair capable of nipping the paper sheet and reversibly rotated to position said paper sheet in said temporary paper storage and then deliver said paper sheet toward said printer engine, and said rollers allow, when released from each other, the paper sheet being delivered from said temporary paper storage toward the second part of the transport path and the paper sheet being received in said temporary paper storage from the first part of said transport path to exist together in said temporary paper storage while overlapping each other.

2. An apparatus as claimed in claim 1, wherein the paper sheet is conveyed at a higher speed on the first part of the transport path than on the second part of said transport path.

3. An apparatus as claimed in claim 2, wherein the paper sheet is conveyed and stopped at particular timings on each of the first part and the second part of the transport path.

4. An apparatus as claimed in claim 3, further comprising a paper sensor positioned in said temporary paper storage for sensing the paper sheets existing together in said temporary paper storage, but in a range where said paper sheets do not overlap each other, wherein said paper sensor senses both of the leading edge of the paper sheet entering said temporary paper storage in a direction of ingress and the leading edge of the paper sheet leaving said temporary paper storage in a direction of egress.

5. An apparatus as claimed in claim 4, further comprising a timing device for setting up, based on an output of said paper sensor representative of the leading edge of the paper sheet leaving said temporary paper storage, a registration timing for the paper sheet being delivered toward said printer engine.

6. An apparatus as claimed in claim 2, further comprising a paper sensor positioned in said temporary paper storage for sensing the paper sheets existing together in said temporary paper storage, but in a range where said paper sheets do not overlap each other, wherein said paper sensor senses both of the leading edge of the paper sheet entering said temporary paper storage in a direction of ingress and the leading edge of the paper sheet leaving said temporary paper storage in a direction of egress.

7. An apparatus as claimed in claim 6, further comprising a timing device for setting up, based on an output of said paper sensor representative of the leading edge of the paper sheet leaving said temporary paper storage, a registration timing for the paper sheet being delivered toward said printer engine.

8. An apparatus as claimed in claim 1, wherein the paper sheet is conveyed and stopped at particular timings on each of the first part and the second part of the transport path.

9. An apparatus as claimed in claim 8, further comprising a paper sensor positioned in said temporary paper storage for sensing the paper sheets existing together in said temporary paper storage, but in a range where said paper sheets do not overlap each other, wherein said paper sensor senses both of the leading edge of the paper sheet entering said temporary paper storage in a direction of ingress and the leading edge of the paper sheet leaving said temporary paper storage in a direction of egress.

10. An apparatus as claimed in claim 9, further comprising a timing device for setting up, based on an output of said paper sensor representative of the leading edge of the paper sheet leaving said temporary paper storage, a registration timing for the paper sheet being delivered toward said printer engine.

11. An apparatus as claimed in claim 1, further comprising a paper sensor positioned in said temporary paper storage for sensing the paper sheets existing together in said temporary paper storage, but in a range where said paper sheets do not overlap each other, wherein said paper sensor senses both of the leading edge of the paper sheet entering said temporary paper storage in a direction of ingress and the leading edge of the paper sheet leaving said temporary paper storage in a direction of egress.

12. An apparatus as claimed in claim 11, further comprising a timing device for setting up, based on an output of said paper sensor representative of the leading edge of the paper sheet leaving said temporary paper storage, a registration timing for the paper sheet being delivered toward said printer engine.

13. An apparatus as claimed in claim 1, wherein said printer engine forms an image with an electrophotographic process.

14. An apparatus as claimed in claim 13, wherein said printer engine forms an image with a digital electrophotographic process using a digital optical writing unit for optically writing a latent image on a photoconductive element.

15. An image forming apparatus for single-sided operation comprising:

a printer engine for forming an image on a paper sheet;

a paper cassette loaded with a stack of paper sheets;

a paper feeder for feeding one of the paper sheets toward said printer engine at a time while separating the one paper sheet from the other paper sheets;

a temporary paper storage positioned on a paper transport path for temporarily storing the paper sheet fed from said paper cassette; and a paper reversing device for positioning the paper sheet fed from said paper cassette in said temporary paper storage with a leading edge of said paper sheet at the head and then switching back said paper sheet toward said printer engine with a trailing edge of said paper sheet at the head;

wherein said paper feeder feeds the paper sheet from said temporary paper storage toward said printer engine at a speed higher than a paper conveying speed for image formation assigned to said printer engine.

16. An apparatus as claimed in claim 15, further comprising:

a registration sensor for sensing the leading edge of the paper sheet delivered to the transport path by said paper reversing device; and a registration roller pair for synchronizing a timing for conveying the paper sheet sensed by said registration sensor toward said printer engine to image formation of said printer engine;

wherein said paper feeder feeds the paper sheet delivered to the transport path by said paper reversing device to said registration roller pair at a higher speed than said registration roller pair conveys said paper sheet to said printer engine.

17. An apparatus as claimed in claim 16, wherein said paper feeder comprises a paper interval adjusting device for varying a degree of the speed at which the paper sheet is conveyed from said temporary paper storage to said printer engine.

18. An apparatus as claimed in claim 17, further comprising:

a paper sensor for sensing the paper sheet delivered to the transport path by said paper reversing device; and a timer for counting an interval between a time when said paper feeder starts conveying the paper sheet delivered to the transport path by said paper reversing device and a time when said paper sensor senses said paper sheet;

wherein said paper feeder increases, based on the interval counted by said timer, the speed at which the paper sheet delivered to the transport path by said paper reversing device is conveyed.

19. An apparatus as claimed in claim 17, further comprising:

a paper sensor for sensing the paper sheet delivered to the transport path by said paper reversing device; and a timer for counting an interval between a time when said paper sensor senses a trailing edge of a preceding paper sheet and a time when said paper sensor senses a leading edge of a following paper sheet;

wherein said paper feeder increases, based on the interval counted by said timer, the speed of the following paper sheet to thereby maintain a substantially constant interval between the trailing edge of the preceding paper sheet and the leading edge of said following paper sheet.

20. An apparatuses claimed in claim 17, further comprising:

a paper sensor for sensing the paper sheet delivered to the transport path by said paper reversing device; and a timer for counting an interval between a time when said paper feeder starts conveying the paper sheet delivered to the transport path by said paper reversing device and a time when said paper sensor senses said paper sheet;

wherein said paper feeder temporarily stops, based on the interval counted by said timer, a conveyance of the paper sheet at a preselected position on the transport path.

21. An apparatus as claimed in claim 16, wherein said paper feeder comprises a paper interval adjusting device for varying a period of time over which the paper sheet is conveyed from said temporary paper storage toward said printer engine at the speed higher than the paper conveying speed for image formation assigned to said printer engine.

22. An apparatus as claimed in claim 21, further comprising:

a paper sensor for sensing the paper sheet delivered to the transport path by said paper reversing device; and a timer for counting an interval between a time when said paper feeder starts conveying the paper sheet delivered to the transport path by said paper reversing device and a time when said paper sensor senses said paper sheet;

wherein said paper feeder increases, based on the interval counted by said timer, the speed at which the paper sheet delivered to the transport path by said paper reversing device is conveyed.

23. An apparatus as claimed in claim 21, further comprising:

a paper sensor for sensing the paper sheet delivered to the transport path by said paper reversing device; and a timer for counting an interval between a time when said paper sensor senses a trailing edge of a preceding paper sheet and a time when said paper sensor senses a leading edge of a following paper sheet;

wherein said paper feeder increases, based on the interval counted by said timer, the speed of the following paper sheet to thereby maintain a substantially constant interval between the trailing edge of the preceding paper sheet and the leading edge of said following paper sheet.

24. An apparatus as claimed in claim 21, further comprising:

a paper sensor for sensing the paper sheet delivered to the transport path by said paper reversing device; and a timer for counting an interval between a time when said paper feeder starts conveying the paper sheet delivered to the transport path by said paper reversing device and a time when said paper sensor senses said paper sheet;

wherein said paper feeder temporarily stops, based on the interval counted by said timer, a conveyance of the paper sheet at a preselected position on the transport path.

25. An apparatus as claimed in claim 16, further comprising:

a paper sensor for sensing the paper sheet delivered to the transport path by said paper reversing device; and a timer for counting an interval between a time when said paper feeder starts conveying the paper sheet delivered to the transport path by said paper reversing device and a time when said paper sensor senses said paper sheet;

wherein said paper feeder increases, based on the interval counted by said timer, the speed at which the paper sheet delivered to the transport path by said paper reversing device is conveyed.

26. An apparatus as claimed in claim 16, further comprising:

a paper sensor for sensing the paper sheet delivered to the transport path by said paper reversing device; and a timer for counting an interval between a time when said paper sensor senses a trailing edge of a preceding paper sheet and a time when said paper sensor senses a leading edge of a following paper sheet;

wherein said paper feeder increases, based on the interval counted by said timer, the speed of the following paper sheet to thereby maintain a substantially constant interval between the trailing edge of the preceding paper sheet and the leading edge of said following paper sheet.

27. An apparatus as claimed in claim 16, further comprising:

a paper sensor for sensing the paper sheet delivered to the transport path by said paper reversing device; and a timer for counting an interval between a time when said paper feeder starts conveying the paper sheet delivered to the transport path by said paper reversing device and a time when said paper sensor senses said paper sheet;

wherein said paper feeder temporarily stops, based on the interval counted by said timer, a conveyance of the paper sheet at a preselected position on the transport path.

28. An apparatus as claimed in claim 16, further comprising:

a paper sensor for sensing the paper sheet delivered to the transport path by said paper reversing device; and a timer for counting an interval between a time when said paper feeder starts conveying the paper sheet delivered to the transport path by said paper reversing device and a time when said paper sensor senses said paper sheet;

wherein said paper feeder, temporarily stops, based on the interval counted by said timer, a conveyance of the paper sheet at a preselected position on the transport path with the paper sheet delivered to the transport path by said paper reversing device abutting against said registration roller pair.

29. An apparatus as claimed in claim 28, wherein said paper sensor and said registration sensor comprise a single sensor.

30. An apparatus as claimed in claim 16, further comprising:

a paper sensor for sensing the paper sheet at a position between said temporary paper storage and said printer engine, but closer to said temporary paper storage than said registration sensor; and a speed controller for controlling, based on an output of said paper sensor, a speed at which said paper reversing device conveys the paper sheet.

31. An apparatus as claimed in claim 30, wherein said speed controller controls the speed in accordance with a period of time over which a conveyance of the paper sheet by said paper reversing device is interrupted after said paper sensor has sensed the leading edge of said paper sheet.

32. An apparatus as claimed in claim 15, wherein said paper feeder comprises a paper interval adjusting device for varying a degree of the speed at which the paper sheet is conveyed from said temporary paper storage to said printer engine.

33. An apparatus as claimed in claim 32, further comprising:

a paper sensor for sensing the paper sheet delivered to the transport path by said paper reversing device; and a timer for counting an interval between a time when said paper feeder starts conveying the papers sheet delivered to the transport path by said paper reversing device and a time when said paper sensor senses said paper sheet;

wherein said paper feeder increases, based on the interval counted by said timer, the speed at which the paper sheet delivered to the transport path by said paper reversing device is conveyed.

34. An apparatus as claimed in claim 32, further comprising:

a paper sensor for sensing the paper sheet delivered to the transport path by said paper reversing device; and a timer for counting an interval between a time when said paper sensor senses a trailing edge of a preceding paper sheet and a time when said paper sensor senses a leading edge of a following paper sheet;

wherein said paper feeder increases, based on the interval counted by said timer, the speed of the following paper sheet to thereby maintain a substantially constant interval between the trailing edge of the preceding paper sheet and the leading edge of said following paper sheet.

35. An apparatus as claimed in claim 32, further comprising:

a paper sensor for sensing the paper sheet delivered to the transport path by said paper reversing device; and a timer for counting an interval between a time when said paper feeder starts conveying the paper sheet delivered to the transport path by said paper reversing device and a time when said paper sensor senses said paper sheet;

wherein said paper feeder temporarily stops, based on the interval counted by said timer, a conveyance of the paper sheet at a preselected position on the transport path.

36. An apparatus as claimed in claim 15, wherein said paper feeder comprises a paper interval adjusting device for varying a period of time over which the paper sheet is conveyed from said temporary paper storage toward said printer engine at the speed higher than the paper conveying speed for image formation assigned to said printer engine.

37. An apparatus as claimed in claim 36, further comprising:

a paper sensor for sensing the paper sheet delivered to the transport path by said paper reversing device; and a timer for counting an interval between a time when said paper feeder starts conveying the paper sheet delivered to the transport path by said paper reversing device and a time when said paper sensor senses said paper sheet;

wherein said paper feeder increases, based on the interval counted by said timer, the speed at which the paper sheet delivered to the transport path by said paper reversing device is conveyed.

38. An apparatus as claimed in claim 36, further comprising:

a paper sensor for sensing the paper sheet delivered to the transport path by said paper reversing device; and a timer for counting an interval between a time when said paper feeder starts conveying the paper sheet delivered to the transport path by said paper reversing device and a time when said paper sensor senses said paper sheet;

wherein said paper feeder temporarily stops, based on the interval counted by said timer, a conveyance of the paper sheet at a preselected position on the transport path.

39. An apparatus as claimed in claim 15, further comprising:

a paper sensor for sensing the paper sheet delivered to the transport path by said paper reversing device; and a timer for counting an interval between a time when said paper feeder starts conveying the paper sheet delivered to the transport path by said paper reversing device and a time when said paper sensor senses said paper sheet;

wherein said paper feeder increases, based on the interval counted by said timer, the speed at which the paper sheet delivered to the transport path by said paper reversing device is conveyed.

40. An apparatus as claimed in claim 15, further comprising:

a paper sensor for sensing the paper sheet delivered to the transport path by said paper reversing device; and a timer for counting an interval between a time when said paper sensor senses a trailing edge of a preceding paper sheet and a time when said paper sensor senses a leading edge of a following paper sheet;

wherein said paper feeder increases, based on the interval counted by said timer, the speed of the following paper sheet to thereby maintain a substantially constant interval between the trailing edge of the preceding paper sheet and the leading edge of said following paper sheet.

41. An apparatus as claimed in claim 15, further comprising:

a paper sensor for sensing the paper sheet delivered to the transport path by said paper reversing device; and a timer for counting an interval between a time when said paper feeder starts conveying the paper sheet delivered to the transport path by said paper reversing device and a time when said paper sensor senses said paper sheet;

wherein said paper feeder temporarily stops, based on the interval, counted by said timer, a conveyance of the paper sheet at a preselected position on the transport path.

42. An apparatus as claimed in claim 15, further comprising:

a paper sensor for sensing the paper sheet at a position between said temporary paper storage and said printer engine, but closer to said temporary paper storage than to said printer engine; and a speed controller for controlling a speed of the paper sheet conveyed by said paper reversing device in accordance with an output of said paper sensor.

43. An apparatus as claimed in claim 42, wherein said speed controller controls the speed in accordance with a period of time over which a conveyance of the paper sheet by said paper reversing device is interrupted after said paper sensor has sensed the leading edge of said paper sheet.

44. An apparatus as claimed in claim 15, wherein said printer engine forms an image with an electrophotographic process.

45. An apparatus as claimed in claim 44, wherein said printer engine forms an image with a digital electrophotographic process using a digital optical writing unit for optically writing a latent image on a photoconductive element.

46. A printer comprising:

an image forming apparatus for single-sided operation;

an input terminal for receiving image data; and a controller for causing said image forming device to form an image on a paper sheet in accordance with the image data;

said image forming apparatus comprising:

a printer engine for forming an image on a paper sheet;

a paper cassette loaded with a stack of paper sheets;

a paper feeder for feeding one of the paper sheets toward said printer engine at a time while separating the one paper sheet from the other paper sheets;

a temporary paper storage positioned on a paper transport path for temporarily storing the paper sheet fed from said paper cassette;

a roller separating mechanism for selectively causing rollers of a roller pair into or out of contact with each other; and a paper reversing device for positioning the paper sheet fed from said paper cassette in said temporary paper storage with a leading edge of said paper sheet at the head and then switching back said paper sheet to thereby deliver said paper sheet toward said printer engine with a trailing edge of said paper sheet at the head;

wherein said paper feeder feeds the paper sheet at a particular speed on each of first part of the transport path extending between said paper cassette and said temporary paper storage and second part of the transport path extending between said temporary paper storage and said printer engine, said paper reversing device comprises said roller pair capable of nipping the paper sheet and reversibly rotated to position said paper sheet in said temporary paper storage and then deliver said paper sheet toward said printer engine, and said rollers allow, when released from each other, the paper sheet being delivered from said temporary paper storage toward the second part of the transport path and the paper sheet being received in said temporary paper storage from the first part of said transport path to exist together in said temporary paper storage while overlapping each other.

47. A copier comprising:

an image scanner for reading a document image;

an image forming apparatus for single-sided operation; and a controller for controlling said image scanner and said image forming apparatus such that said image forming apparatus forms an image on a paper sheet in accordance with image data output from said image scanner and representative of the document image;

said image forming apparatus comprising:

a printer engine for forming an image on a paper sheet;

a paper cassette loaded with a stack of paper sheets;

a paper feeder for feeding one of the paper sheets toward said printer engine at a time while separating the one paper sheet from the other paper sheets;

a temporary paper storage positioned on a paper transport path for temporarily storing the paper sheet fed from said paper cassette;

a pressing/releasing device for selectively moving rollers of a roller pair into or out of contact with each other; and a paper reversing device for positioning the paper sheet fed from said paper cassette in said temporary paper storage with a leading edge of said paper sheet at the head and then switching back said paper sheet to thereby deliver said paper sheet toward said printer engine with a trailing edge of said paper sheet at the head;

wherein said paper feeder feeds the paper sheet at a particular speed on each of first part of the transport path extending between said paper cassette and said temporary paper storage and second part of the transport path extending between said temporary paper storage and said printer engine, said paper reversing device comprises said roller pair capable of nipping the paper sheet and reversibly rotated to position said paper sheet in said temporary paper storage and then deliver said paper sheet toward said printer engine, and said rollers allow, when released from each other, the paper sheet being delivered from said temporary paper storage toward the second part of the transport path and the paper sheet being received in said temporary paper storage from the first part of said transport path to exist together in said temporary paper storage while overlapping each other.

48. A facsimile apparatus comprising:

an image scanner for reading a document image;

an image forming apparatus for single-sided operation;

a transmitter/receiver for interchanging image data with a remote station via a network; and a controller for controlling said image scanner, said image forming apparatus and said transmitter/receiver such that image data output from said image scanner and representative of the document image is sent to the remote station via the network, or said image forming apparatus forms an image on a paper sheet in accordance with image data received from the remote station via said network and said transmitter/receiver;

said image forming apparatus comprising:

a printer engine for forming an image on a paper sheet;

a paper cassette loaded with a stack of paper sheets;

a paper feeder for feeding one of the paper sheets toward said printer engine at a time while separating the one paper sheet from the other paper sheets;

a temporary paper storage positioned on a paper transport path for temporarily storing the paper sheet fed from said paper cassette;

a pressing/releasing device for selectively moving rollers of a roller pair into or out of contact with each other; and a paper reversing device for positioning the paper sheet fed from said paper cassette in said temporary paper storage with a leading edge of said paper sheet at the head and then switching back said paper sheet to thereby deliver said paper sheet toward said printer engine with a trailing edge of said paper sheet at the head;

wherein said paper feeder feeds the paper sheet at a particular speed on each of first part of the transport path extending between said paper cassette and said temporary paper storage and second part of the transport path extending between said temporary paper storage and said printer engine, said paper reversing device comprises said roller pair capable of nipping the paper sheet and reversibly rotated to position said paper sheet in said temporary paper storage and then deliver said paper sheet toward said printer engine, and said rollers allow, when released from each other, the paper sheet being delivered from said temporary paper storage toward the second part of the transport path and the paper sheet being received in said temporary paper storage from the first part of said transport path to exist together in said temporary paper storage while overlapping each other.

49. A multiplex machine comprising:

an image scanner for reading a document image;

an image forming apparatus for single-sided operation;

a transmitter/receiver for interchanging image data with a remote station via a network; an input terminal for receiving image data;

an output terminal for outputting image data; and a controller for controlling said image scanner, said image forming apparatus and said transmitter/receiver such that said image forming apparatus forms an image in accordance with the image data received via said input terminal, or image data output from said image scanner and representative of the document image are output to an outside of said multiplex machine via said output terminal or sent to the remote terminal via said transmitter/receiver and the network, or said image forming apparatus forms an image on a paper sheet in accordance with image data received from the remote terminal via said network and said transmitter/receiver;

said image forming apparatus comprising:

a printer engine for forming an image on a paper sheet;

a paper cassette loaded with a stack of paper sheets;

a paper feeder for feeding one of the paper sheets toward said printer engine at a time while separating the one paper sheet from the other paper sheets;

a temporary paper storage positioned on a paper transport path for temporarily storing the paper sheet fed from said paper cassette;

a pressing/releasing device for selectively moving rollers of a roller pair into or out of contact with each other; and a paper reversing device for positioning the paper sheet fed from said paper cassette in said temporary paper storage with a leading edge of said paper sheet at the head and then switching back said paper sheet to thereby deliver said paper sheet toward said printer engine with a trailing edge of said paper sheet at the head;

wherein said paper feeder feeds the paper sheet at a particular speed on each of first part of the transport path extending between said paper cassette and said temporary paper storage and second part of the transport path extending between said temporary paper storage and said printer engine, said paper reversing device comprises said roller pair capable of nipping the paper sheet and reversibly rotated to position said paper sheet in said temporary paper storage and then deliver said paper sheet toward said printer engine, and said rollers allow, when released from each other, the paper sheet being delivered from said temporary paper storage toward the second part of the transport path and the paper sheet being received in said temporary paper storage from the first part of said transport path to exist together in said temporary paper storage while overlapping each other.

50. A printer comprising:

an image forming apparatus for single-sided operation;

an input terminal for receiving image data; and a controller for causing said image forming apparatus to form an image on a paper sheet in accordance with the image data;

said image forming apparatus comprising:

a printer engine for forming an image on a paper sheet;

a paper cassette loaded with a stack, of paper sheets;

a paper feeder for feeding one of the paper sheets toward said printer engine at a time while separating the one paper sheet from the other paper sheets;

a temporary paper storage positioned on a paper transport path for temporarily storing the paper sheet fed from said paper cassette; and a paper reversing device for positioning the paper sheet fed from said paper cassette in said temporary paper storage with a leading edge of said paper sheet at the head and then switching back said paper sheet to thereby deliver said paper sheet toward said printer engine with a trailing edge of said paper sheet at the head;

wherein said paper feeder feeds the paper sheet from said temporary paper storage toward said printer engine at a speed higher than a paper conveying speed for image formation assigned to said printer engine.

51. A copier comprising:

an image scanner for reading a document image;

an image forming apparatus for single-sided operation; and a controller for controlling said image scanner and said image forming apparatus such that said image forming apparatus forms an image on a paper sheet in accordance with image data output from said image scanner and representative of the document image;

said image forming apparatus comprising:

a printer engine for forming an image on a paper sheet;

a paper cassette loaded with a stack of paper sheets;

a paper feeder for feeding one of the paper sheets toward said printer engine at a time while separating the one paper sheet from the other paper sheets;

a temporary paper storage positioned on a paper transport path for temporarily storing the paper sheet fed from said paper cassette; and a paper reversing device for positioning the paper sheet fed from said paper cassette in said temporary paper storage with a leading edge of said paper sheet at the head and then switching back said paper sheet to thereby deliver said paper sheet toward said printer engine with a trailing edge of said paper sheet at the head;

wherein said paper feeder feeds the paper sheet from said temporary paper storage toward said printer engine at a speed higher than a paper conveying speed for image formation assigned to said printer engine.

52. A facsimile apparatus comprising:

an image scanner for reading a document image;

an image forming apparatus for single-sided operation;

a transmitter/receiver for interchanging image data with a remote station via a network; and a controller for controlling said image scanner, said image forming apparatus and said transmitter/receiver such that image data output from said image scanner and representative of the document image are sent to the remote station via the network, or said image forming apparatus forms an image on a paper sheet in accordance with image data received from the remote station via said network and said transmitter/receiver;

said image forming apparatus comprising:

a printer-engine for forming an image on a paper sheet;

a paper cassette loaded with a stack of paper sheets;

a paper feeder for feeding one of the paper sheets toward said printer engine at a time while separating the one paper sheet from the other paper sheets;

a temporary paper storage positioned on a paper transport path for temporarily storing the paper sheet fed from said paper cassette; and a paper reversing device for positioning the paper sheet fed from said paper cassette in said temporary paper storage with a leading edge of said paper sheet at the head and then switching back said paper sheet to thereby deliver said paper sheet toward said printer engine with a trailing edge of said paper sheet at the head;

wherein said paper feeder feeds the paper sheet from said temporary paper storage toward said printer engine at a speed higher than a paper conveying speed for image formation assigned to said printer engine.

53. A multiplex machine comprising:

an image scanner for reading a document image;

an image forming apparatus for single-sided operation;

a transmitter/receiver for interchanging image data with a remote station via a network;

an input terminal for receiving image data;

an output terminal for outputting image data; and a controller for controlling said image scanner, said image forming apparatus and said transmitter/receiver such that said image forming apparatus forms an image in accordance with the image data received via said input terminal, or image data output from said image scanner and representative of the document image are output to an outside of said multiplex machine via said output terminal or sent to the remote terminal via said transmitter/receiver and the network, or said image forming apparatus forms an image on a paper sheet in accordance with image data received from the remote terminal via said network and said transmitter/receiver;

said image forming apparatus comprising:

a printer engine for forming an image on a paper sheet;

a paper cassette loaded with a stack of paper sheets;

a paper feeder for feeding one of the paper sheets toward said printer engine at a time while separating the one paper sheet from the other paper sheets;

a temporary paper storage positioned on a paper transport path for temporarily storing the paper sheet fed from said paper cassette; and a paper reversing device for positioning the paper sheet fed from said paper cassette in said temporary paper storage with a leading edge of said paper sheet at the head and then switching back said paper sheet to thereby deliver said paper sheet toward said printer engine with a trailing edge of said paper sheet at the head;

wherein said paper feeder feeds the paper sheet from said temporary paper storage toward said printer engine at a speed higher than a paper conveying speed for image formation assigned to said printer engine.

54. An image forming apparatus for single-sided operation comprising:

a printer engine for forming an image on a paper sheet;

paper stacking means for stacking paper sheets thereon;

paper feeding means for feeding one of the paper sheets toward said printer engine at a time while separating the one paper sheet from the other paper sheets;

temporary paper storage means positioned on a paper transport path for temporarily storing the paper sheet fed from said paper stacking means;

a pressing/releasing means for selectively moving rollers of a roller pair into or out of contact with each other; and paper reversing means for positioning the paper sheet fed from said paper stacking means in said temporary paper storage means with a leading edge of said paper sheet at the head and then switching back said paper sheet toward said printer engine with a trailing edge of said paper sheet at the head;

wherein said paper feeding means feeds the paper sheet at a particular speed on each of first part of the transport path extending between said paper stacking means and said temporary paper storage means and second part of the transport path extending between said temporary paper storage means and said printer engine, said paper reversing means comprises said roller pair capable of nipping the paper sheet and reversibly rotated to position said paper sheet in said temporary paper storage means and then deliver said paper sheet toward said printer engine, and said rollers allow, when released from each other, the paper sheet being delivered from said temporary paper storage means toward the second part of the transport path and the paper sheet being received in said temporary paper storage means from the first part of said transport path to exist together in said temporary paper storage means while overlapping each other.

55. An image forming apparatus for single-sided operation comprising:

a printer engine for forming an image on a paper sheet;

paper stacking means for stacking paper sheets thereon;

paper feeding means for feeding one of the paper sheets toward said printer engine at a time while separating the one paper sheet from the other paper sheets;

temporary paper storage means positioned on a paper transport path for temporarily storing the paper sheet fed from said paper stacking means; and paper reversing means for positioning the paper sheet fed from said paper stacking means in said temporary paper storage means with a leading edge of said paper sheet at the head and then switching back said paper sheet toward said printer engine with a trailing edge of said paper sheet at the head;

wherein said paper feeding means feeds the paper sheet from said temporary paper storage means toward said printer engine at a speed higher than a paper conveying speed for image formation assigned to said printer engine.

56. A printer comprising:

an image forming apparatus for single-sided operation;

an input terminal for receiving image data; and control means for causing said image forming apparatus to form an image on a paper sheet in accordance with the image data;

said image forming apparatus comprising:

a printer engine for forming an image on a paper sheet;

paper stacking means for stacking paper sheets thereon;

paper feeding means for feeding one of the paper sheets toward said printer engine at a time while separating the one paper sheet from the other paper sheets;

temporary paper storage means positioned on a paper transport path for temporarily storing the paper sheet fed from said paper stacking means;

a pressing/releasing means for selectively moving rollers of a roller pair into or out of contact with each other; and paper reversing means for positioning the paper sheet fed from said paper stacking means in said temporary paper storage means with a leading edge of said paper sheet at the head and then switching back said paper sheet toward said printer engine with a trailing edge of said paper sheet at the head;

wherein said paper feeding means feeds the paper sheet at a particular speed on each of first part of the transport path extending between said paper stacking means and said temporary paper storage means and second part of the transport path extending between said temporary paper storage means and said printer engine, said paper reversing means comprises said roller pair capable of nipping the paper sheet and reversibly rotated to position said paper sheet in said temporary paper storage means and then deliver said paper sheet toward said printer engine, and said rollers allow, when released from each other, the paper sheet being delivered from said temporary paper storage means toward the second part of the transport path and the paper sheet being received in said temporary paper storage means from the first part of said transport path to exist together in said temporary paper storage means while overlapping each other.

57. A copier comprising:

image scanning means for reading a document image;

an image forming apparatus for single-sided operation; and control means for controlling said image scanning means and said image forming apparatus such that said image forming apparatus forms an image on a paper sheet in accordance with image data output from said image scanning means and representative of the document image;

said image forming apparatus comprising:

a printer engine for forming an image on a paper sheet;

paper stacking means for stacking paper sheets thereon;

paper feeding means for feeding one of the paper sheets toward said printer engine at a time while separating the one paper sheet from the other paper sheets;

temporary paper storage means positioned on a paper transport path for temporarily storing the paper sheet fed from said paper stacking means;

a pressing/releasing means for selectively moving rollers of a roller pair into or out of contact with each other; and paper reversing means for positioning the paper sheet fed from said paper stacking means in said temporary paper storage means with a leading edge of said paper sheet at the head and then switching back said paper sheet toward said printer engine with a trailing edge of said paper sheet at the head;

wherein said paper feeding means feeds the paper sheet at a particular speed on each of first part of the transport path extending between said paper stacking means and said temporary paper storage means and second part of the transport path extending between said temporary paper storage means and said printer engine, said paper reversing means comprises said roller pair capable of nipping the paper sheet and reversibly rotated to position said paper sheet in said temporary paper storage means and then deliver said paper sheet toward said printer engine, and said rollers allow, when released from each other, the paper sheet being delivered from said temporary paper storage means toward the second part of the transport path and the paper sheet being received in said temporary paper storage means from the first part of said transport path to exist together in said temporary paper storage means while overlapping each other.

58. A facsimile apparatus comprising:

image scanning means for reading a document image;

an image forming apparatus for single-sided operation;

transmitting/receiving means for interchanging image data with a remote station via a network; and controller means for controlling said image scanning means, said image forming apparatus and said transmitting/receiving means such that image data output from said image scanning means and representative of the document image are sent to the remote station via the network, or said image forming apparatus forms an image on a paper sheet in accordance with image data received from the remote station via said network and said transmitting/receiving means;

said image forming apparatus comprising:

a printer engine for forming an image an a paper sheet;

paper stacking means for stacking paper sheets thereon;

paper feeding means for feeding one of the paper sheets toward said printer engine at a time while separating the one paper sheet from the other paper sheets;

temporary paper storage means positioned on a paper transport path for temporarily storing the paper sheet fed from said paper stacking means;

a pressing/releasing means for selectively moving rollers of a roller pair into or out of contact with each other; and paper reversing means for positioning the paper sheet fed from said paper stacking means in said temporary paper storage means with a leading edge of said pager sheet at the head and then switching back said paper sheet toward said printer engine with a trailing edge of said paper sheet at the head;

wherein said paper feeding means feeds the paper sheet at a particular speed on each of first part of the transport path extending between said paper stacking means and said temporary paper storage means and second part of the transport path extending between said temporary paper storage means and said printer engine, said paper reversing means comprises said roller pair capable of nipping the paper sheet and reversibly rotated to position said paper sheet in said temporary paper storage means and then deliver said paper sheet toward said printer engine, and said rollers allow, when released from each other, the paper sheet being delivered from said temporary paper storage means toward the second part of the transport path and the paper sheet being received in said temporary paper storage means from the first part of said transport path to exist together in said temporary paper storage means while overlapping each other.

59. A multiplex machine comprising:

image scanning means for reading a document image;

an image forming apparatus for single-sided operation;

transmitting/receiving means for interchanging image data with a remote station via a network;

an input terminal for receiving image data;

an output terminal for outputting image data; and control means for controlling said image scanning means, said image forming apparatus and said transmitting/receiving means such that said image forming apparatus forms an image in accordance with the image data received via said input terminal, or image data output from said image scanning means and representative of the document image are output to an outside of said multiplex machine via said output terminal or sent to the remote terminal via said transmitting/receiving means and the network, or said image forming apparatus forms an image on a paper sheet in accordance with image data received from the remote terminal via said network and said transmitting/receiving means;

said image forming apparatus comprising:

a printer engine for forming an image on a paper sheet;

paper stacking means loaded with a stack of paper sheets;

paper feeding means for feeding one of the paper sheets toward said printer engine at a time while separating the one paper sheet from the other paper sheets;

temporary paper storage means positioned on a paper transport path for temporarily storing the paper sheet fed from said paper stacking means;

a pressing/releasing means for selectively moving rollers of a roller pair into or out of contact with each other; and paper reversing means for positioning the paper sheet fed from said paper stacking means in said temporary paper storage means with a leading edge of said paper sheet at the head and then switching back said paper sheet toward said printer engine with a trailing edge of said paper sheet at the head;

wherein said paper feeding means feeds the paper sheet at a particular speed on each of first part of the transport path extending between said paper stacking means and said temporary paper storage means and second part of the transport path extending between said temporary paper storage means and said printer engine, said paper reversing means comprises said roller pair capable of nipping the paper sheet and reversibly rotated to position said paper sheet in said temporary paper storage means and then deliver said paper sheet toward said printer engine, and said rollers allow, when released from each other, the paper sheet being delivered from said temporary paper storage means toward the second part of the transport path and the paper sheet being received in said temporary paper storage means from the first part of said transport path to exist together in said temporary paper storage means while overlapping each other.

60. A printer comprising:

an image forming apparatus for single-sided operation;

an input terminal for receiving image data; and control means for causing said image forming apparatus to form an image on a paper sheet in accordance with the image data;

said image forming apparatus comprising:

a printer engine for forming an image on a paper sheet;

paper stacking means for stacking paper sheets thereon;

paper feeding means for feeding one of the paper sheets toward said printer engine at a time while separating the one paper sheet from the other paper sheets;

temporary paper storage means positioned on a paper transport path for temporarily storing the paper sheet fed from said paper stacking means; and paper reversing means for positioning the paper sheet fed from said paper stacking means in said temporary paper storage means with a leading edge of said paper sheet at the head and then switching back said paper sheet toward said printer engine with a trailing edge of said paper sheet at the head;

wherein said paper feeding means feeds the paper sheet from said temporary paper storage means toward said printer engine at a speed higher than a paper conveying speed for image formation assigned to said printer engine.

61. A copier comprising:

image scanning means for reading a document image;

an image forming apparatus for single-sided operation; and control means for controlling said image scanning means and said image forming apparatus such that said image forming apparatus forms an image on a paper sheet in accordance with image data output from said image scanning means and representative of the document image;

said image forming apparatus comprising:

a printer engine for forming an image on a paper sheet;

paper stacking means for stacking paper sheets thereon;

paper feeding means for feeding one of the paper sheets toward said printer engine at a time while separating the one paper sheet from the other paper sheets;

temporary paper storage means positioned on a paper transport path for temporarily storing the paper sheet fed from said paper stacking means; and paper reversing means for positioning the paper sheep fed from said paper stacking means in said temporary paper storage means with a leading edge of said paper sheet at the head and then switching back said paper sheet toward said printer engine with a trailing edge of said paper sheet at the head;

wherein said paper feeding means feeds the paper sheet from said temporary paper storage means toward said printer engine at a speed higher than a paper conveying speed for image format assigned to said printer engine.

62. A facsimile apparatus comprising:

image scanning means for reading a document image;

an image forming apparatus for single-sided operation;

transmitting/receiving means for interchanging image data with a remote station via a network; and control means for controlling said image scanning means, said image forming apparatus and said transmitting/receiving means such that image data output from said image scanning means and representative of the document image are sent to the remote station via the network, or said image forming apparatus forms an image on a paper sheet in accordance with image data received from the remote station via said network and said transmitting/receiving means;

said image forming apparatus comprising:

a printer engine for forming an image on a paper sheet;

paper stacking means for stacking paper sheets thereon;

paper feeding means for feeding one of the paper sheets toward said printer engine at a time while separating the one paper sheet from the other paper sheets;

temporary paper storage means positioned on a paper transport path for temporarily storing the paper sheet fed from said paper stacking means; and paper reversing means for positioning the paper sheet fed from said paper stacking means in said temporary paper storage means with a leading edge of said paper sheet at the head and than switching back said paper sheet toward said printer engine with a trailing edge of said paper sheet at the head;

wherein said paper feeding means feeds the paper sheet from said temporary paper storage means toward said printer engine at a speed higher than a paper conveying speed for image formation assigned to said printer engine.

63. A multiplex machine comprising:

image scanning means for reading a document image;

an image forming apparatus for single-sided operation;

transmitting/receiving means for interchanging rage data with a remote station via a network;

an input terminal for receiving image data;

an output terminal for outputting image data; and control means for controlling said image scanning means, said image forming apparatus and said transmitting/receiving means such that said image forming apparatus forms an image in accordance with the image data received via said input terminal, or image data output from said image scanning means and representative of the document image are output to an outside of said multiplex machine; via said output terminal or sent to the remote terminal via said transmitting/receiving means and the network, or said image forming apparatus forms an image on a paper sheet in accordance with image data received from the remote station via said network and said transmitting/receiving means;

said image forming apparatus comprising:

a printer engine for forming an image on a paper sheet;

paper stacking means for stacking paper sheets thereon;

paper feeding means for feeding one of the paper sheets toward said printer engine at a time while separating the one paper sheet from the other paper sheets;

temporary paper storage means positioned on a paper transport path for temporarily storing the paper sheet fed from said paper stacking means; and paper reversing means for positioning the paper sheet fed from said paper stacking means in said temporary paper storage means with a leading edge of said paper sheet at the head and then switching back said paper sheet toward said printer engine with a trailing edge of said paper sheet at the head;

wherein said paper feeding means feeds the paper sheet from said temporary paper storage means toward said printer engine at a speed higher than a paper conveying speed for image formation assigned to said printer engine.

64. An image forming apparatus comprising:

an image forming section for forming an image on a paper sheet;

a paper stacking section for stacking paper sheets thereon;

a paper feeder for feeding one of the paper sheets from said paper stacking section to said image forming section at a time while separating the one paper sheet from the other paper sheets;

a temporary paper storage positioned on a paper transport path for temporarily storing the paper sheet fed from said paper stacking section; and a paper reversing device for positioning the taper sheet fed from said paper stacking section in said temporary paper storage with a leading edge of said paper sheet at the head and then switching back said paper sheet toward said image forming section with trailing edge of said paper sheet at the head;

a registering device for performing a registering operation for adjusting a timing at which said paper feeder should feed the paper sheet and a timing at which said paper reversing device should deliver the paper sheet, thereby synchronizing a timing of delivery of the paper sheet toward said image forming section to image formation; and a paper sensor positioned in said temporary paper storage for sensing the paper sheet;

wherein said paper feeder effects a feed of the paper sheet from said paper stacking section toward said temporary paper storage and a feed of the paper sheet from said temporary paper storage toward said image forming section independently of each other; and wherein said registering device performs the registering operation in response to an output of said paper sensor representative of the paper, whereby when said paper feeder temporarily stops conveying the paper sheet, said registering device conveys part of said paper sheet toward said image forming section to a position where a trailing edge of said paper sheet does not obstruct an entry of a paper sheet following said paper sheet into said temporary paper storage.

65. An apparatus as claimed in claim 64, further comprising a speed varying device for causing, after the registering operation, said paper feeder to convey the paper sheet registered a speed higher than a paper conveying speed assigned to said image forming section over a preselected period of time.

66. An apparatus as claimed in claim 65, wherein said paper feeder comprises:

a first roller pair positioned on part of the transport path extending between said paper stacking section and said temporary paper storage for conveying the paper sheet; and a second roller pair positioned on part of the transport path extending between said temporary paper storage and said image forming section for conveying the paper sheet;

wherein said paper reversing device comprises a third roller pair reversibly rotatable while nipping the paper sheet to thereby receive said paper sheet in said temporary paper storage and then deliver said paper sheet toward said image forming section; and wherein said registering means performs the registering operation by adjusting a timing at which said second roller pair conveys the paper sheet and a timing at which said third roller pair conveys said paper sheet.

67. An apparatus as claimed in claim 65, wherein said sheet feeder comprises:

a first roller pair positioned on part of the transport path extending between said paper stacking section and said temporary paper storage for conveying the paper sheet; and a second roller pair positioned on part of the transport path extending between said temporary paper storage and said image forming section for conveying the paper sheet;

wherein said paper reversing means comprises a third roller pair reversibly rotatable while nipping the paper sheet to thereby receive said paper sheet in said temporary paper storage and then deliver said paper sheet toward said image forming section; and wherein said speed varying means causes, after the registering operation, said second roller pair and said third roller pair to convey the paper sheet registered at a speed higher than the paper conveying speed assigned to said image forming section over the preselected period of time.

68. An apparatus as claimed in claim 65, wherein said sheet feeder comprises:

a first roller pair positioned on part of the transport path extending between said paper stacking section and said temporary paper storage for conveying the paper sheet; and a second roller pair positioned on part of the transport path extending between said temporary paper storage and said image forming section for conveying the paper sheet;

wherein said paper reversing means, comprises a third roller pair reversibly rotatable while nipping the paper sheet to thereby receive said paper sheet in said temporary paper storage and then deliver said paper sheet toward said image forming section; and wherein said registering device causing, in response to an output of said paper sensor representative of the paper sheet, said third roller pair to convey said paper sheet until a leading edge of said paper sheet abuts against said second roller pair.

69. An apparatus as claimed in claim 64, wherein said sheet feeder comprises:

a first roller pair positioned on part of the transport path extending between said paper stacking section and said temporary paper storage for conveying the paper sheet; and a second roller pair positioned on part of the transport path extending between said temporary paper storage and said image forming section for conveying the paper sheet;

wherein said paper reversing device comprises a third roller pair reversibly rotatable while nipping the paper sheet to thereby receive said paper sheet in said temporary paper storage and then deliver said paper sheet toward said image forming section; and wherein said paper feeder causes said first roller pair and said second roller pair to rotate independently of each other to thereby convey the paper sheet from said paper stacking section toward said temporary paper storage even during the registering operation.

70. An apparatus as claimed in claim 64, wherein said sheet feeder comprises:

a first roller pair positioned on part of the transport path extending between said paper stacking section and said temporary paper storage for conveying the paper sheet; and a second roller pair positioned on part of the transport path extending between said temporary paper storage and said image forming section for conveying the paper sheet;

wherein said paper reversing device comprises a third roller pair reversibly rotatable while nipping the paper sheet a thereby receive said paper sheet in said temporary paper storage and then deliver said paper sheet toward said image forming section; and wherein said registering device causes said second roller pair and said third roller pair to convey the paper sheet toward said image forming apparatus until a trailing edge of said paper sheet in a direction of conveyance moves away from said third roller pair, and then interrupts a rotation of said second roller pair until said image forming section starts an image forming operation to thereby perform the registering operation, whereby said paper sheet is prevented from overlapping, at a position of said third roller pair, a paper sheet following said paper sheet and being driven into said temporary paper storage by said first roller pair and said third roller pair.

71. An apparatus as claimed in claim 64, wherein said image forming section forms an image with an electrophotographic process.

72. An apparatus as claimed in claim 71, wherein said image forming section forms an image with a digital electrophotographic process using a digital optical writing unit for optically writing a latent image on a photoconductive element.

73. An image forming apparatus comprising:

an image forming section for forming an image on a paper sheet;

a paper stacking section for stacking paper sheets thereon;

a paper feeder for feeding one of the paper sheets from said paper stacking section to said image forming section at a image while separating the one paper sheet from the other paper sheets;

a temporary paper storage positioned on a paper transport path for temporarily storing the paper sheet fed from said paper stacking section; and a paper reversing device for positioning the paper sheet fed from said paper stacking section in said temporary paper storage with a leading edge of said paper sheet at the head and then switching back said paper sheet toward said image forming section with trailing edge of said paper sheet at the head; and a registering device for performing a registering operation for adjusting a timing at which said paper feeder should feed the paper sheet and a timing at which said paper reversing device should deliver the paper sheet, thereby synchronizing a timing of delivery of the paper sheet toward said image forming section to image formation;

wherein said paper feeder effects a feed of the paper sheet from said paper stacking section toward said temporary paper storage and a feed of the paper sheet from said temporary paper storage toward said image forming section independently of each other; and wherein when said paper feeder temporarily stops conveying the paper sheet, said registering device conveys part of said paper sheet toward said image forming section to a position where a trailing edge of said paper sheet does not obstruct an entry of a paper sheet following said paper sheet into said temporary paper storage.

74. An apparatus as claimed in claim 73, further comprising a speed varying device for causing, after the registering operation, said paper feeder to convey the paper sheet registered at a speed higher than a paper conveying speed assigned to said image forming section over a preselected period of time.

75. An apparatus as claimed in claim 74, wherein said paper feeder comprises:

a first roller pair positioned on part of the transport path extending between said paper stacking section and said temporary paper storage for conveying the paper sheet; and a second roller pair positioned on part of the transport path extending between said temporary paper storage and said image forming section for conveying the paper sheet;

wherein said paper reversing device comprises a third roller pair reversibly rotatable while nipping the paper sheet to thereby receive said paper sheet in said temporary paper storaged and then deliver said paper sheet toward said image forming section; and wherein said registering device performs the registering operation by adjusting a timing at which said second roller pair conveys the paper sheet and a timing at which said third roller pair conveys said paper sheet.

76. An apparatus as claimed in claim 74, wherein said sheet feeder comprises:

a first roller pair positioned on part of the transport path extending between said paper stacking section and said temporary paper storage for conveying the paper sheet; and a second roller pair positioned on part of the transport path extending between said temporary paper storage and said image forming section for conveying the paper sheet;

wherein said paper reversing device comprises a third roller pair reversibly rotatable while nipping the paper sheet to thereby receive said paper sheet in said temporary paper storage and then deliver said paper sheet toward said image forming section; and wherein said speed varying means causes, after the registering operation, said second roller pair and said third roller pair to convey the paper sheet registered at a speed higher than the paper conveying speed assigned to said image forming section over the preselected period of time.

77. An apparatus as claimed in claim 73, wherein said paper feeder comprises:

a first roller pair positioned on part of the transport path extending between said paper stacking section and said temporary paper storage for conveying the paper sheet; and a second roller pair positioned on part of the transport path extending between said temporary paper storage and said image forming section for conveying the paper sheet;

wherein said paper reversing device comprises a third roller pair reversibly rotatable while nipping the paper sheet to thereby receive said paper sheet in said temporary paper storage and then deliver said paper sheet toward said image forming section; and wherein said registering means performs the registering operation by adjusting a timing at which said second roller pair conveys the paper sheet and a timing at which said third roller pair conveys said paper sheet.

78. An apparatus as claimed in claim 73, wherein said sheet feeder comprises:

a first roller pair positioned on part of the transport path extending between said paper stacking section and said temporary paper storage for conveying the paper sheet; and a second roller pair positioned on part of the transport path extending between said temporary paper storage and said image forming section for conveying the paper sheet;

wherein said paper reversing device comprises a third roller pair reversibly rotatable while nipping the paper sheet to thereby receive said paper sheet in said temporary paper storage and then deliver said paper sheet toward said image forming section; and wherein said paper feeder causes said first roller pair and said second roller pair to rotate independently of each other to thereby convey the paper sheet from said paper stacking section toward said temporary paper storage even during the registering operation.

79. An apparatus as claimed in claim 73, wherein said sheet feeder comprises:

a first roller pair positioned on part of the transport path extending between said paper stacking section and said temporary paper storage for conveying the paper sheet; and a second roller pair positioned on part of the transport path extending between said temporary paper storage and said image forming section for conveying the paper sheet;

wherein said paper reversing device comprises a third roller pair reversibly rotatable while nipping the paper sheet to thereby receive said paper sheet in said temporary paper storage and then deliver said paper sheet toward said image forming section; and wherein said registering device causes said second roller pair and said third roller pair to convey the paper sheet toward said image forming apparatus until a trailing edge of said paper sheet in a direction of conveyance moves away from said third roller pair, and then interrupt a rotation of said second roller pair until said image forming section starts an image forming operation to thereby perform the registering operation, whereby said paper sheet is prevented from overlapping, at a position of said third roller pair, a paper sheet following said paper sheet and being driven into said temporary paper storage by said first roller pair and said third roller pair.

80. An apparatus as claimed in claim 73, wherein said image forming section forms an image with an electrophotographic process.

81. An apparatus as claimed in claim 80, wherein said image forming section forms an image with a digital electrophotographic process using a digital optical writing unit for optically writing a latent image on a photoconductive element.

82. An image forming apparatus comprising:

image forming means for forming an image on a paper sheet;

paper stacking means for stacking paper sheets thereon;

paper feeding means for feeding one of the paper sheets from said paper stacking means to said image forming means at a time while separating the one paper sheet from the other paper sheets;

temporary paper storage means positioned on a paper transport path for temporarily storing the paper sheet fed from said paper stacking means; and paper reversing means for positioning the paper sheet fed from said paper stacking means in said temporary paper storage means with a leading edge of said paper sheet at the head and then switching back said paper sheet toward said image forming means with a trailing edge of said paper sheet at the head;

registering means for performing a registering operation for adjusting a timing at which said paper feeding means should feed the paper sheet and a timing at which said paper reversing means should deliver the paper sheet, thereby synchronizing a timing of delivery of the paper sheet toward said image forming means to image formation; and a paper sensor positioned in said temporary paper storage means for sensing the paper sheet;

wherein said paper feeding means effects a feed of the paper sheet from said paper stacking means toward said temporary paper storage means and a feed of the paper sheet from said temporary paper storage means toward said image forming means independently of each other; and wherein said registering means performs the registering operation in response to an output of said paper sensor representative of the paper, whereby when said paper feeding means temporarily stops conveying the paper sheet, said registering means conveys part of said paper sheet toward said image forming means to a position where a trailing edge of said paper sheet does not obstruct an entry of a paper sheet following said paper sheet into said temporary paper storage means.

83. An image forming apparatus for single-sided operation comprising:

image forming means for forming an image on a paper sheet;

paper stacking means for stacking paper sheets thereon;

paper feeding means for feeding one of the paper sheets from said paper stacking means to said image forming means at a time while separating the one paper sheet from the other paper sheets;

temporary paper storage means positioned on a paper transport path for temporarily storing the paper sheet fed from said paper stacking means; and paper reversing means for positioning the paper sheet fed from said paper stacking means in said temporary paper storage means with a leading edge of said paper sheet at the head and then switching back said paper sheet toward said image forming means with a trailing edge of said paper sheet at the head; and registering means for performing a registering operation for adjusting a timing at which said paper feeding means should feed the paper sheet and a timing at which said paper reversing means should deliver the paper sheet thereby synchronizing a timing of delivery of the paper sheet toward said image forming means to the image formation;

wherein said paper feeding means effects a feed of the paper sheet from said paper stacking means toward said temporary paper storage means and a feed of the paper sheet from said temporary paper storage means toward said image forming means independently of each other; and wherein when said paper feeding means temporarily stops conveying the paper sheet said registering means conveys part of said paper sheet toward said image forming means to a position where a trailing edge of said paper sheet does not obstruct an entry of a paper sheet following said paper sheet into said temporary paper storage means.

84. An image forming apparatus for single-sided operation comprising:

an image forming section for forming an image on a paper sheet;

a paper stacking section for stacking paper sheets thereon;

a paper feeder for feeding one of the paper sheets from said paper stacking section to said image forming section at a time while separating the one paper sheet from the other paper sheets;

a temporary paper storage positioned on a paper transport path for temporarily storing the paper sheet fed from said paper stacking section;

a paper reversing device for positioning the paper sheet fed from said paper stacking section in said temporary paper storage with a leading edge of said paper sheet at the head and then switching back said paper sheet toward said image forming section with a trailing edge of said paper sheet at the head;

a pressing/releasing device for selectively moving rollers of a roller pair into or out of contact with each other;

a jam sensor positioned on the transport path or a transport path following said transport path for sensing a paper jam;

a stopping device for stopping an operation of said image forming section and an operation of said paper feeder when said jam sensor senses a paper jam; and a storing device for causing, when said stopping device stops the operations, said paper feeder to continuously convey the paper sheet being conveyed along the transport path between said paper stacking section and said temporary paper storage to said temporary paper storage;

wherein said paper stacking section has a front-loading configuration, and said paper reversing device comprises said roller pair capable of nipping the paper sheet and reversibly rotated to position said paper sheet in said temporary paper storage and then deliver said paper sheet toward said printer engine, and said rollers allow, when released from each other, the paper sheet being delivered from said temporary paper storage toward the second part of the transport path and the paper sheet being received in said temporary paper storage from the first part of said transport path to exist together in said temporary paper storage while overlapping each other.

85. An apparatus as claimed in claim 84, wherein said temporary paper storage is capable of receiving a plurality of paper sheets in a stack, whereby when even a plurality of paper sheets are being conveyed along the transport path between said paper stacking section and said temporary paper storage, said storing device causes all of said plurality of paper sheets to be received in said temporary paper storage.

86. An apparatus as claimed in claim 85, further comprising a casing accommodating an apparatus body, and a door openably mounted on said casing for covering, when closed, a paper transport path formed in said image forming section and said temporary par storage.

87. An apparatus as claimed in claim 86, wherein when said door is opened, said image forming section and said temporary paper storage are capable of being pulled out integrally with each other.

88. An apparatus as claimed in claim 86, wherein said image forming section and said temporary paper storage are positioned one above the other.

89. An apparatus as claimed in claim 88, wherein when said door is opened, said image forming section and said temporary paper storage are capable of being pulled out integrally with each other.

90. An apparatus as claimed in claim 84, further comprising a casing accommodating an apparatus body, and a door openably mounted on said casing for covering, when closed, a paper transport path formed in said image forming section and said temporary paper storage.

91. An apparatus as claimed in claim 90, wherein when said door is opened, said image forming section and said temporary paper storage are capable of being pulled out integrally with each other.

92. An image forming apparatus for single-sided operation comprising:

image forming means for forming an image on a paper sheet;

paper stacking means for stacking paper sheets thereon:

paper feeding means for feeding one of the paper sheets from said paper stacking means to said image forming means at a time while separating the one paper sheet from the other paper sheets;

temporary paper storage means positioned on a paper transport path for temporarily storing the paper sheet fed from said paper stacking means;

a pressing/releasing device for selectively moving rollers of a roller pair into or out of contact with each other;

paper reversing means for positioning the paper sheet fed from said paper stacking means in said temporary paper storage means with a leading edge of said paper sheet at the head and then switching back said paper sheet toward said image forming means with a trailing edge of said paper sheet at the head;

jam sensing means positioned on the transport path or a transport path following said transport path for sensing a paper jam;

stopping means for stopping an operation of said image forming means and an operation of said paper feeding means when said jam sensing means senses a paper jam; and storing means for causing, when said stopping means stops the operations, said paper feeding means to continuously convey the paper sheet being conveyed along the transport path between said paper stacking means and said temporary paper storage means to said temporary paper storage means;

wherein said paper stacking means has a front-loading configuration, and said paper reversing device comprises said roller pair capable of nipping the paper sheet and reversibly rotated to position said paper sheet in said temporary paper storage and then deliver said paper sheet toward said printer engine, and said rollers allow, when released from each other, the paper sheet being delivered from said temporary paper storage toward the second part of the transport path and the paper sheet being received in said temporary paper storage from the first part of said transport path to exist together in said temporary paper storage while overlapping each other.

* * * * *